US010328730B2

(12) United States Patent
Shirota et al.

(10) Patent No.: US 10,328,730 B2
(45) Date of Patent: Jun. 25, 2019

(54) RECORDING APPARATUS

(71) Applicant: SEIKO EPSON CORPORATION, Tokyo (JP)

(72) Inventors: Kenichi Shirota, Suwa (JP); Yoshiyuki Okazawa, Shiojiri (JP); Tetsuya Tamura, Matsumoto (JP); Kensuke Tamai, Shiojiri (JP); Shintaro Miyamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 193 days.

(21) Appl. No.: 15/625,420

(22) Filed: Jun. 16, 2017

(65) Prior Publication Data

US 2017/0361634 A1 Dec. 21, 2017

(30) Foreign Application Priority Data

Jun. 20, 2016 (JP) ..... 2016-121854
Jun. 24, 2016 (JP) ..... 2016-125658
Jun. 24, 2016 (JP) ..... 2016-125682

(51) Int. Cl.
*B41J 29/02* (2006.01)
*B41J 29/13* (2006.01)

(52) U.S. Cl.
CPC ..... *B41J 29/02* (2013.01); *B41J 29/13* (2013.01)

(58) Field of Classification Search
CPC ..... B41J 29/02; B41J 29/13
See application file for complete search history.

(56) References Cited

U.S. PATENT DOCUMENTS 9,199,478 B2 * 12/2015 Suzuki ..... B41J 2/17553
2009/0022539 A1 1/2009 Iwama et al.
2014/0292172 A1 10/2014 Kawata et al.

FOREIGN PATENT DOCUMENTS

JP 2005-253037 A 9/2005
JP 2007-196583 A 8/2007
JP 2007-203485 A 8/2007
JP 2009-023808 A 2/2009
JP 2011-020454 A 2/2011
JP 2011-020828 A 2/2011
JP 2014-192862 A 10/2014

* cited by examiner

*Primary Examiner* — Thinh H Nguyen
(74) *Attorney, Agent, or Firm* — Workman Nydegger

(57) ABSTRACT

A recording apparatus includes a housing which configures at least a portion of an outside of an apparatus main body which is provided with a recorder which performs recording on a medium, a lid body which opens and closes at least a portion of a top portion of the apparatus main body and is capable of tilting, and a tilting shaft of the lid body, in which the tilting shaft is capable of being displaced in a direction intersecting an axial line direction of the tilting shaft, and in which the lid body is capable of tilting from a closed state in which a gap between the housing and an end portion of an opposite side from a free end side is filled to an opened state by the displacement of the tilting shaft.

19 Claims, 55 Drawing Sheets

RECORDING APPARATUS

BACKGROUND

1. Technical Field

The present invention relates to a recording apparatus which is provided with a housing which configures at least a portion of the outside of an apparatus main body which includes a recorder which performs recording on a medium, and a lid body which opens and closes at least a portion of a top portion of the apparatus main body and is capable of tilting.

2. Related Art

A recording apparatus which performs recording on a medium is integrally provided with a recording mechanism unit which performs recording on a medium, and a reading mechanism unit which reads a document, and a medium supply port for supplying a medium to the recording mechanism unit is provided on a rear top portion of the apparatus main body (for example, refer to JP-A-2011-20828, JP-A-2005-253037, and JP-A-2011-20454).

In the recording apparatus which is described in JP-A-2011-20828, JP-A-2005-253037, and JP-A-2011-20454, a lid body which opens and closes a medium supply port is provided as an example of the lid body, and it is possible to close the lid body when the recording apparatus is not in use. Furthermore, the lid body is configured to function as a medium support which supports the medium which is fed from the medium supply port. Hereinafter, the lid body which opens and closes the medium supply port will be referred to as a medium supply port cover to distinguish the lid body from other lid bodies.

As an example of the lid body, the recording apparatus which is described in JP-A-2011-20828 is provided with a lid body which opens and closes a document stand. The document stand is provided on a scanner unit which corresponds to the reading mechanism unit. Hereinafter, this lid body will be referred to as a document cover.

A medium supply port cover which covers the medium supply port is provided on the medium supply port, and when the recording mechanism unit is not in use, it is possible to cover the medium supply port using the medium supply port cover, and it is possible to prevent the falling of foreign matter into the medium supply port.

However, in a case in which an image which is read using the reading mechanism unit is recorded on a recording medium using the recording mechanism unit, the reading mechanism unit is operated in a state in which the medium supply port cover is opened to open the medium supply port.

When the reading mechanism unit or the document cover tilts with respect to the top portion of the recording mechanism unit to open and close in a state in which a clip or the like is placed on the top surface of the reading mechanism unit, the clip or the like may fall into the medium supply port which is provided on the rear top portion of the recording apparatus main body as foreign matter.

Therefore, there is a case in which a regulating member which prevents the falling of foreign matter into the medium supply port is provided.

A lid body which is similar to that described above opens and closes through tilting around a tilting shaft. In this configuration, a gap between the lid body and the housing of the apparatus, more specifically, a gap between an end portion of the opposite side of the lid body from a free end side (an end portion of the tilting shaft side: hereinafter referred to as "tilting shaft side end portion") and the housing becomes a gap which is necessary for the lid body to tilt. When this gap is not present, the tilting shaft side end portion of the lid body comes into contact with the housing, and the lid body is not capable of tilting any further. However, when the gap between the tilting shaft side end portion of the lid body and the housing is too large, this leads to dust and the like easily infiltrating the inner portion of the apparatus, and is unfavorable from the perspective of the external appearance of the apparatus. It is also unfavorable from the perspective of the external appearance of the apparatus to provide the tilting shaft of the lid body such that the tilting shaft is exposed to the outside of the apparatus in order to avoid the problem which is described above.

The recording apparatus which is described in JP-A-2005-253037 is provided with a foreign matter falling prevention cover which prevents the falling of foreign matter into the medium supply port, and is configured such that when the scanner unit is opened from the state in which the medium supply port cover is closed, the foreign matter falling prevention cover comes into contact with the bottom surface of the medium supply port cover, pushes up the medium supply port cover, and the distal end side of the medium supply port cover lifts up. According to this configuration, in the recording apparatus which is described in JP-A-2005-253037, damage to the medium supply port cover which is caused by the scanner unit opening in a state in which the medium supply port cover is closed is prevented.

However, depending on the user, there is a case in which an operation of opening the scanner unit is performed in a state in which the document cover which is provided on the scanner unit is opened. In this case, there is a case in which the medium supply port cover closes the document cover against the will of the user. Since the medium supply port cover assumes an angular posture so as to come into contact with the document cover, the medium supply port cover may be damaged by the opening of the scanner unit.

On the other hand, it is considered to greatly separate the medium supply port cover from the document cover such that the two do not interfere with each other in order to avoid the problem which is described above; however, in this case, a large gap is formed between the two in the state in which both are closed, and this is unfavorable from the perspective of external appearance.

SUMMARY

An advantage of some aspects of the invention is to provide a recording apparatus which is capable of suitably opening and closing a lid body while maintaining a small gap between a tilting shaft side end portion of a lid body and a housing. Another advantage of some aspects of the invention is to suppress or avoid damage to at least one of the covers without greatly separating the covers from each other in a recording apparatus which is provided with a medium supply port cover which opens and closes a medium supply port and a document cover which opens and closes a document stand. Still another advantage of some aspects of the invention is to provide a recording apparatus which is capable of achieving both a suppression of falling of foreign matter into the medium supply port and securing ease of use in the area of the medium supply port.

According to an aspect of the invention, a recording apparatus includes a housing which configures at least a portion of an outside of an apparatus main body which is provided with a recorder which performs recording on a medium, a lid body which opens and closes at least a portion of a top portion of the apparatus main body and is capable of tilting, and a tilting shaft of the lid body, in which the tilting shaft is capable of being displaced in a direction intersecting an axial line direction of the tilting shaft, and in which the lid body is capable of tilting from a closed state in which a gap between the housing and an end portion of an opposite side from a free end side is filled to an opened state by the displacement of the tilting shaft.

According to this aspect, the tilting shaft of the lid body which opens and closes at least a portion of the top portion of the apparatus main body and is capable of tilting is capable of being displaced in a direction which intersects the axial line direction, and the lid body is capable of tilting from a closed state in which a gap between the end portion of the opposite side from the free end side and the housing is filled to an opened state by the displacement of the tilting shaft, and so it is possible to suitably open and close the lid body while maintaining a small gap between the housing and the tilting shaft side end portion of the lid body.

In the recording apparatus, the tilting shaft may be configured using a hinge member which is provided to be capable of sliding in a direction including a vertical direction component with respect to the apparatus main body.

According to this aspect, the tilting shaft is configured using a hinge member which is provided to be capable of sliding in a direction including a vertical direction component with respect to the apparatus main body, and so it is possible to realize a configuration in which the tilting shaft is displaced in a direction which intersects the axial line direction with a simple structure and at low cost.

In the recording apparatus, the hinge member may be biased in a direction including a vertical downward direction component by a biasing unit.

According to this aspect, since the hinge member is biased in a direction including a vertical downward direction component by a biasing unit, it is possible to maintain a state in which the gap between the lid body and the housing is filled, that is, it is possible to maintain a state which is favorable from the perspective of external appearance.

In the recording apparatus, a plurality of pairs of the hinge member and the biasing unit may be provided along a tilting axial line direction of the lid body, and a biasing force of the biasing unit may be set to a magnitude at which the lid body is tilted without the hinge member which is in a position close to a side portion lifting up using the hinge member which is in a distant position from the side portion as a fulcrum when lifting up the side portion of the lid body in the tilting axial line direction to open the lid body.

According to this aspect, a plurality of the hinge members are provided along a tilting axial line direction of the lid body, and a biasing force of the biasing unit is set to a magnitude at which the lid body is tilted without the hinge member which is in a position close to a side portion lifting up using the hinge member which is in a distant position from the side portion as a fulcrum when lifting up the side portion of the lid body in the tilting axial line direction to open the lid body, and so it is possible to suitably open the lid body when the user lifts up the side portion of the lid body in the tilting axial line direction to open the lid body.

In the recording apparatus, the hinge member may be provided on an inside of the housing, and the hinge member may be concealed on an inside of the housing when the lid body is closed.

According to this aspect, since the hinge member is concealed on an inside of the housing when the lid body is closed, it is possible to improve the external appearance of the recording apparatus in a state in which the lid body is closed.

In the recording apparatus, the hinge member may be provided with a spring member which biases the lid body in a closing direction when the lid body is opened at an opening angle from a closed state to a predetermined opening angle, and biases the lid body in an opening direction when the lid body is further opened at the opening angle in a range from the predetermined opening angle to a further opened state.

According to this aspect, since the hinge member may be provided with a spring member which biases the lid body in a closing direction when the lid body is opened at an opening angle in a range from a closed state to a predetermined opening angle, and biases the lid body in an opening direction when the lid body is further opened at an opening angle in a range from the predetermined opening angle to a further opened state, the ease of use is improved during opening and closing of the lid body.

According to another aspect, a recording apparatus includes a medium supply port which is provided on a top portion of an apparatus main body to be capable of setting a medium therethrough, the apparatus main body being provided with a recorder which performs recording on the medium, a reading mechanism unit which is provided on the top portion of the apparatus main body to be capable of opening and closing and which reads a document, a medium supply port cover which opens and closes the medium supply port and is provided on the apparatus main body, and a document cover which is a cover which opens and closes a document stand with which the reading mechanism unit is provided, has a same opening direction as the medium supply port cover, and is provided on the reading mechanism unit, in which the document cover and the medium supply port cover are in a positional relationship in which a distal end of the medium supply port cover comes into contact with the document cover in a process in which the reading mechanism unit is opened from a state in which the reading mechanism unit and the medium supply port cover are closed and the document cover is opened, and the document cover applies an external force to the medium supply port cover in the opening direction.

According to this aspect, the document cover and the medium supply port cover are in a positional relationship in which a distal end of the medium supply port cover comes into contact with the document cover in a process in which the reading mechanism unit is opened from a state in which the reading mechanism unit and the medium supply port cover are closed and the document cover is opened, and the document cover applies an external force to the medium supply port cover in the opening direction, and so it is possible to suppress or avoid damage to the medium supply port cover when opening the reading mechanism unit from a state in which the reading mechanism unit and the medium supply port cover are closed and the document cover is opened. As a result, it is no longer necessary to greatly separate the document cover from the medium supply port cover, and it is possible to realize a favorable external appearance of the apparatus.

In the recording apparatus, in the process in which the reading mechanism unit is opened from a state in which the reading mechanism unit and the medium supply port cover are closed and the document cover is opened, a repulsive force which the document cover receives from the medium supply port cover may not exceed a magnitude which is necessary for closing the document cover.

According to this aspect, in the process in which the reading mechanism unit is opened from a state in which the reading mechanism unit and the medium supply port cover are closed and the document cover is opened, a repulsive force which the document cover receives from the medium supply port cover may not exceed a magnitude which is necessary for closing the document cover, and so it is possible to avoid a problem of unintentionally closing the document cover in the process in which the reading mechanism unit is opened from a state in which the reading mechanism unit and the medium supply port cover are closed and the document cover is opened.

The recording apparatus may further include a rocking member which is capable of engaging with the document cover and the medium supply port cover and is capable of rocking, in which the rocking member may be configured to rock to push up the medium supply port cover when the document cover is opened from a state in which the reading mechanism unit, and the document cover and the medium supply port cover are closed.

According to this aspect, since the rocking member is configured to rock to push up the medium supply port cover when the document cover is opened from a state in which the reading mechanism unit, and the document cover and the medium supply port cover are closed, it is possible to render the contact angle of the medium supply port cover with respect to the document cover less acute when opening the reading mechanism unit by also opening the medium supply port cover by a certain degree in advance when the document cover is opened.

As a result, it is possible to more reliably suppress or avoid damage to the medium supply port cover when the reading mechanism unit is opened from a state in which the reading mechanism unit, and the document cover and the medium supply port cover are closed.

In the recording apparatus, in the process in which the reading mechanism unit is opened from a state in which the reading mechanism unit and the medium supply port cover are closed and the document cover is opened, an angle from a contact position at which the medium supply port cover comes into contact with the document cover, formed between a top surface of the document cover of a tilting shaft side of the document cover and a top surface of the medium supply port cover may be an acute angle.

According to this aspect, in the process in which the reading mechanism unit is opened from a state in which the reading mechanism unit and the medium supply port cover are closed and the document cover is opened, an angle from a contact position at which the medium supply port cover comes into contact with the document cover, formed between a top surface of the document cover of a tilting shaft side of the document cover and a top surface of the medium supply port cover is an acute angle, and so it is possible to more smoothly open the medium supply port cover, and as a result, it is possible to more reliably suppress or avoid damage to the medium supply port cover.

In the recording apparatus, a first inclined surface may be formed on a distal end of the medium supply port cover, a second inclined surface which faces the first inclined surface may be formed on a base end side of the document cover, and when the reading mechanism unit is opened from a state in which the reading mechanism unit, the document cover, and the medium supply port cover are closed, the second inclined surface may be provided to push up the first inclined surface in a direction in which the medium supply port cover opens.

According to this aspect, when the reading mechanism unit is opened from a state in which the reading mechanism unit, the document cover, and the medium supply port cover are closed, the second inclined surface is provided with a configuration to push up the first inclined surface in a direction in which the medium supply port cover opens, and so it is possible to suppress or avoid damage to the medium supply port cover when the reading mechanism unit is opened from a state in which the reading mechanism unit, the document cover, and the medium supply port cover are closed.

In the recording apparatus, in plan view of the document cover and the medium supply port cover, at least a portion of the second inclined surface may overlap the first inclined surface.

According to this aspect, since in plan view of the document cover and the medium supply port cover, at least a portion of the second inclined surface overlaps the first inclined surface, it is possible to realize a favorable external appearance of the apparatus without the inside of the document cover and the medium supply port cover, that is, the top portion of the apparatus main body being exposed in plan view of the document cover and the medium supply port cover.

In the recording apparatus, a reading mechanism unit which reads a document and a medium supply port which it capable of setting the medium through the medium supply port may be included on a top portion of the apparatus main body, the lid body may open and close the medium supply port, the reading mechanism unit may include a document cover which opens and closes a document stand on which the document is placed and has a same opening direction as the lid body, the lid body and the document cover may have widths corresponding to a horizontal width of the apparatus main body and a top surface of the lid body and a top surface of the document cover may form the same surface, and an end portion of an opposite side from the free end side of the lid body and a rear surface of the apparatus main body may form the same surface.

According to this aspect, it is possible to obtain a recording apparatus with an excellent external appearance.

In the recording apparatus, a reading mechanism unit which reads a document and a medium supply port which is capable of supplying the medium may be included on a top portion of the apparatus main body, the reading mechanism unit may include a document cover which opens and closes a document stand on which a document is placed, the lid body may open and close the medium supply port, and the recording apparatus may further include a regulating member which is capable of assuming a storage state in which the regulating member is positioned on an inside of the lid body and is closed in a state in which the lid body is closed, and a regulating state in which the regulating member opens together with an opening operation of the lid body and forms a surface which intersects a top surface of the document cover to regulate slipping and falling of an object from a top surface of the document cover into the medium supply port, and a biasing member which biases the regulating member from the storage state to the regulating state.

According to this aspect, since the regulating member is biased by the biasing member from the storage state to the regulating state, it is possible to transition the regulating member from the storage state to the regulating state together with the opening and closing of the lid body.

Therefore, in the state in which the lid body and the medium supply port are opened, regardless of the opening/closing state of the document cover, the regulating member always assumes the regulating state, that is, the state in which the falling of foreign matter into the medium supply port is regulated, and it is possible to more reliably suppress or avoid the falling of foreign matter into the medium supply port.

The recording apparatus may further include a regulating member which is capable of assuming a storage state in which the regulating member is positioned on an inside of the medium supply port cover and is closed in a state in which the medium supply port cover is closed, and a regulating state in which the regulating member opens together with an opening operation of the medium supply port and forms a surface which intersects a top surface of the document cover to regulate slipping and falling of an object from a top surface of the document cover into the medium supply port, and a biasing member which biases the regulating member from the storage state to the regulating state.

According to this aspect, since the regulating member is biased by the biasing member from the storage state to the regulating state, it is possible to transition the regulating member from the storage state to the regulating state together with the opening and closing of the medium supply port cover. Therefore, in the state in which the medium supply port cover and the medium supply port are opened, regardless of the opening/closing state of the document cover, the regulating member always assumes the regulating state, that is, the state in which the falling of foreign matter into the medium supply port is regulated, and it is possible to more reliably suppress or avoid the falling of foreign matter into the medium supply port.

In the recording apparatus, the regulating member may be configured to be capable of switching between the storage state and the regulating state by tilting.

According to this aspect, it is possible to realize a configuration which switches between the storage state and the regulating state with a simple structure.

In the recording apparatus, the regulating member may be configured to be capable of switching between the storage state and the regulating state by tilting.

According to this aspect, it is possible to realize a configuration which switches between the storage state and the regulating state with a simple structure.

In the recording apparatus, the regulating member may be provided with an induction portion with which the lid body comes into contact and which leads the regulating member to the storage state when the lid body is changed from an opened state to a closed state.

According to this aspect, due to the regulating member being provided with the induction portion, it is possible to smoothly transition the regulating member to the storage state using the change from the opened state to the closed state of the lid body.

In the recording apparatus, the regulating member may be provided with an induction portion with which the medium supply port cover comes into contact and which leads the regulating member to the storage state when the medium supply port cover is changed from an opened state to a closed state.

According to this aspect, due to the regulating member being provided with the induction portion, it is possible to smoothly transition the regulating member to the storage state using the change from the opened state to the closed state of the medium supply port cover.

BRIEF DESCRIPTION OF THE DRAWINGS

The invention will be described with reference to the accompanying drawings, wherein like numbers reference like elements.

DESCRIPTION OF EXEMPLARY EMBODIMENTS

Description will be given of the recording apparatus according to the embodiment of the invention with reference to the drawings. In the embodiment which is described hereinafter, description will be given of an ink jet printer (hereinafter simply referred to as a printer) as an example of the recording apparatus. The same configurations in each of the examples of the embodiment will be described only in the first example, the same reference symbols will be applied, and description of the configuration thereof will be omitted in the following examples.

First Embodiment

First, description will be given of an outline of the printer according to the first embodiment of the invention.

Figure 1:
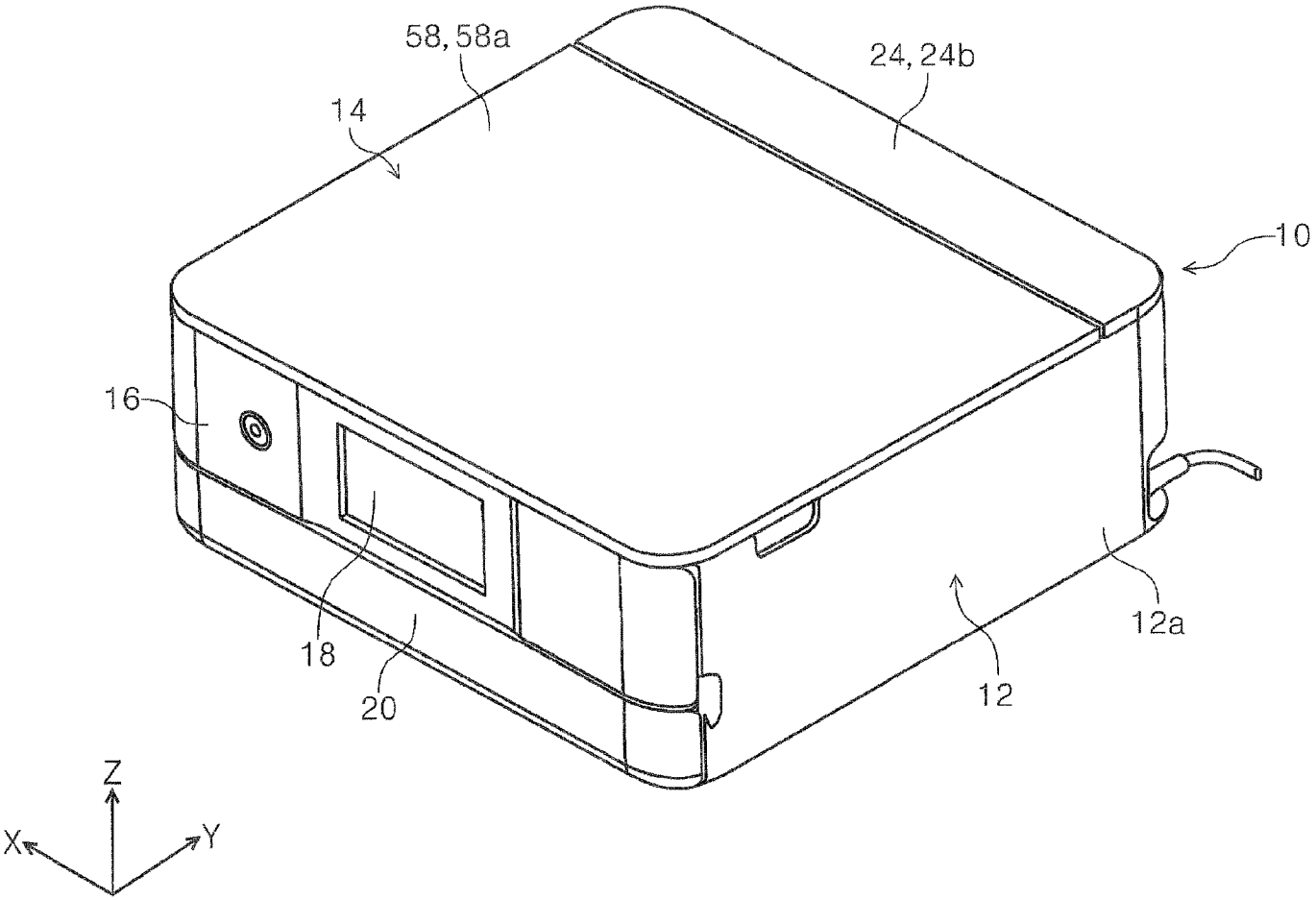
FIG. 1 is an external perspective diagram of a printer according to an embodiment.
Figure 2:
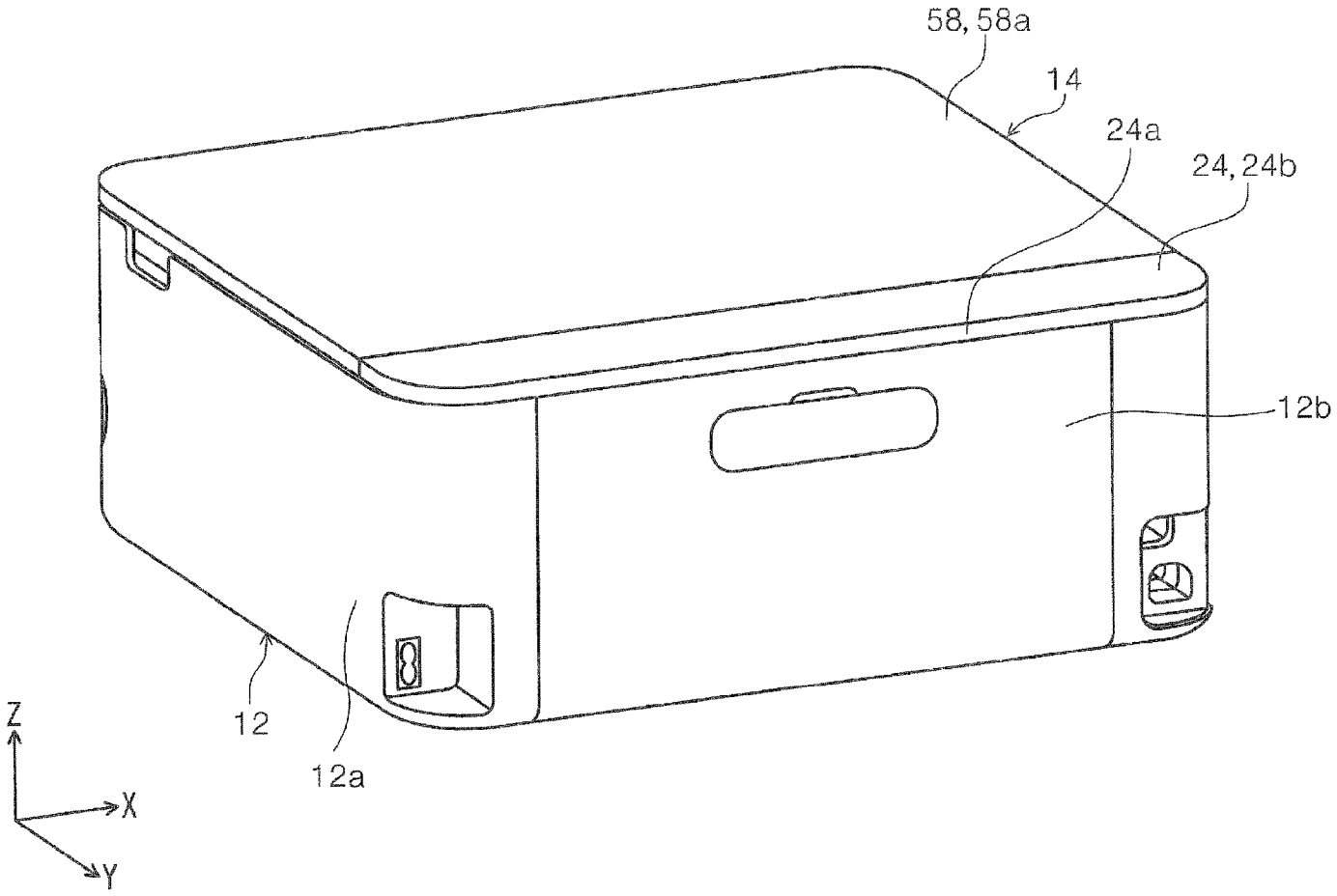
FIG. 2 is an external perspective diagram of the printer according to the embodiment as viewed from the rear surface side.
Figure 3:
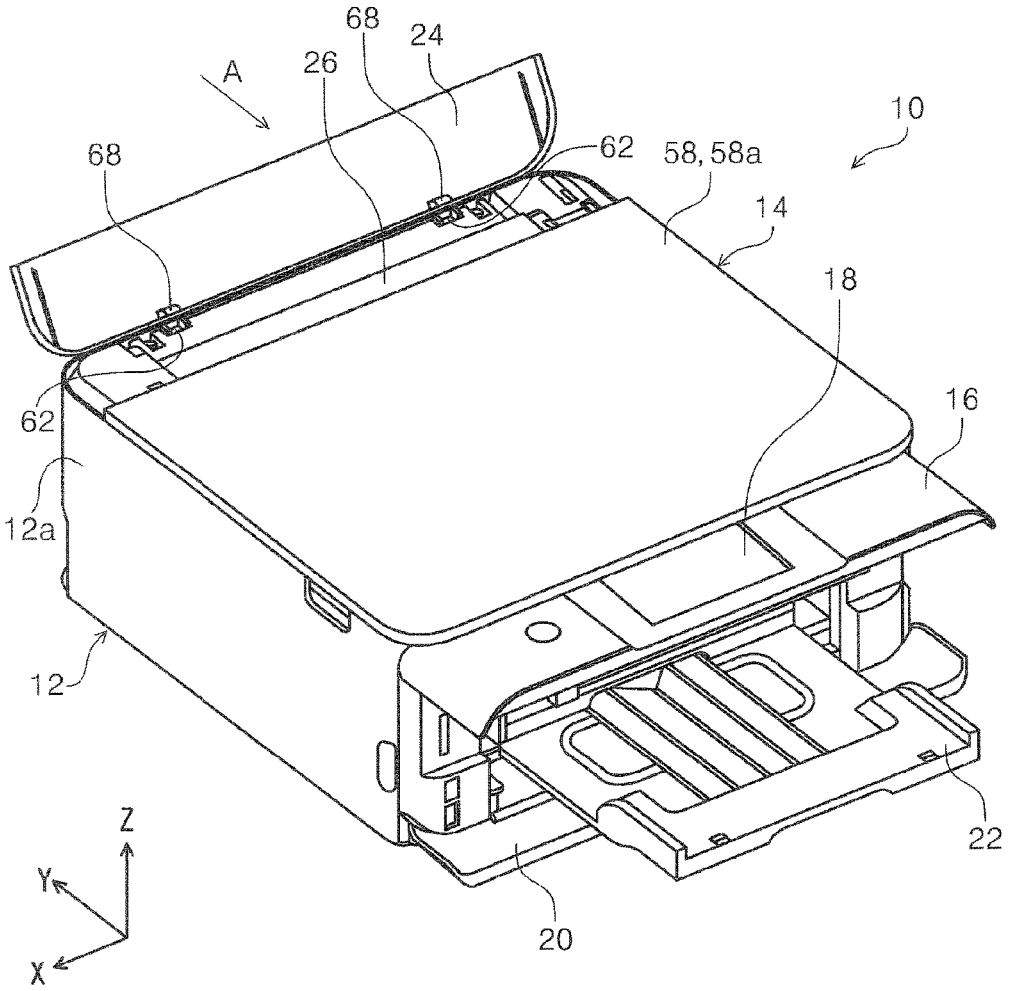
FIG. 3 is a perspective diagram illustrating a state in which a paper output tray is extended to the front of the apparatus in the printer according to the embodiment.
Figure 4:
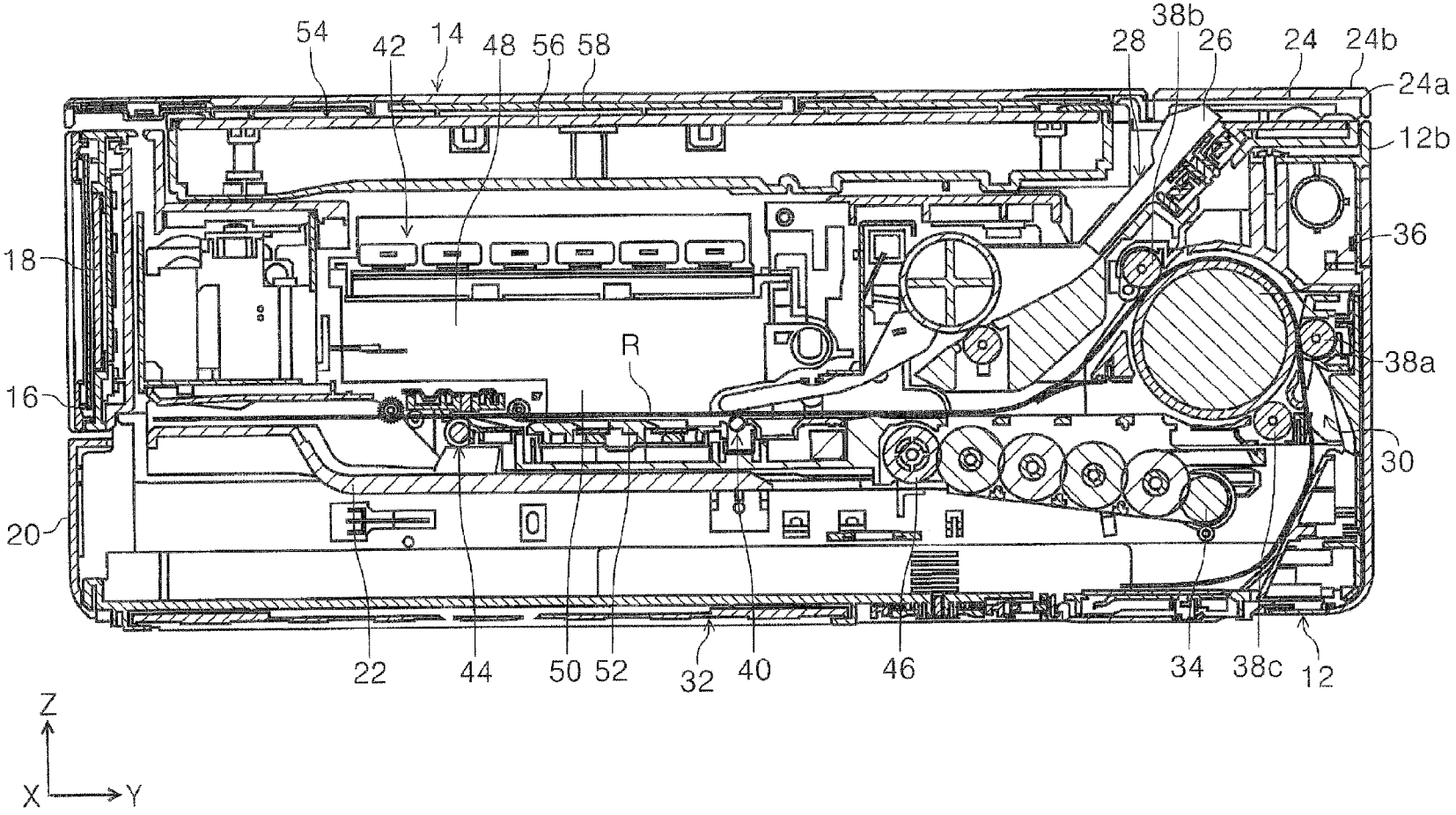
FIG. 4 is a lateral sectional diagram illustrating a medium transport path in the printer according to the embodiment.
Figure 5:
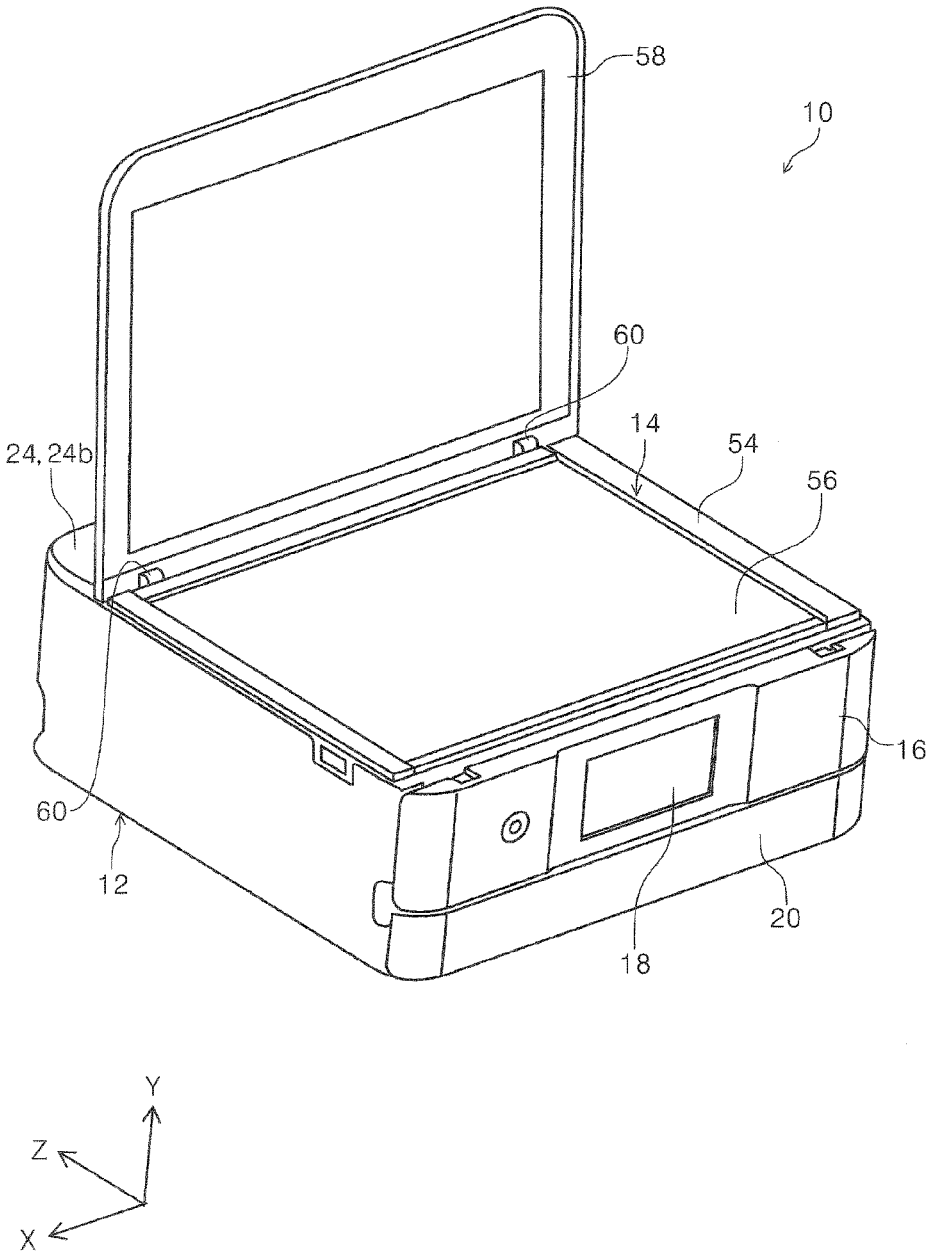
FIG. 5 is a perspective diagram illustrating a state in which a document cover is opened with respect to a reading mechanism unit in the printer.
Figure 6:
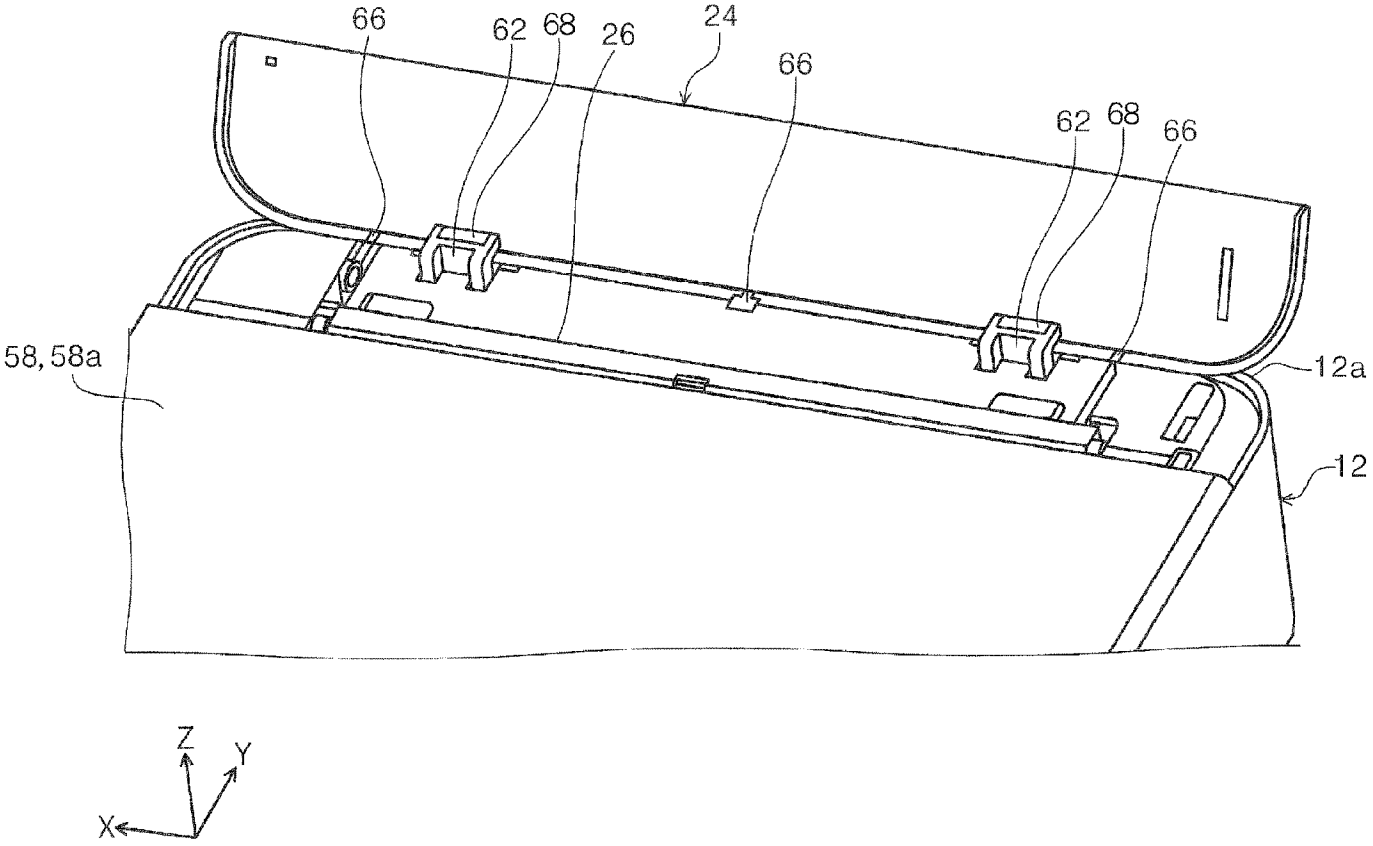
FIG. 6 is a perspective diagram illustrating a state in which the medium supply port cover is opened with respect to the apparatus main body on the rear surface side of the apparatus main body.
Figure 7:
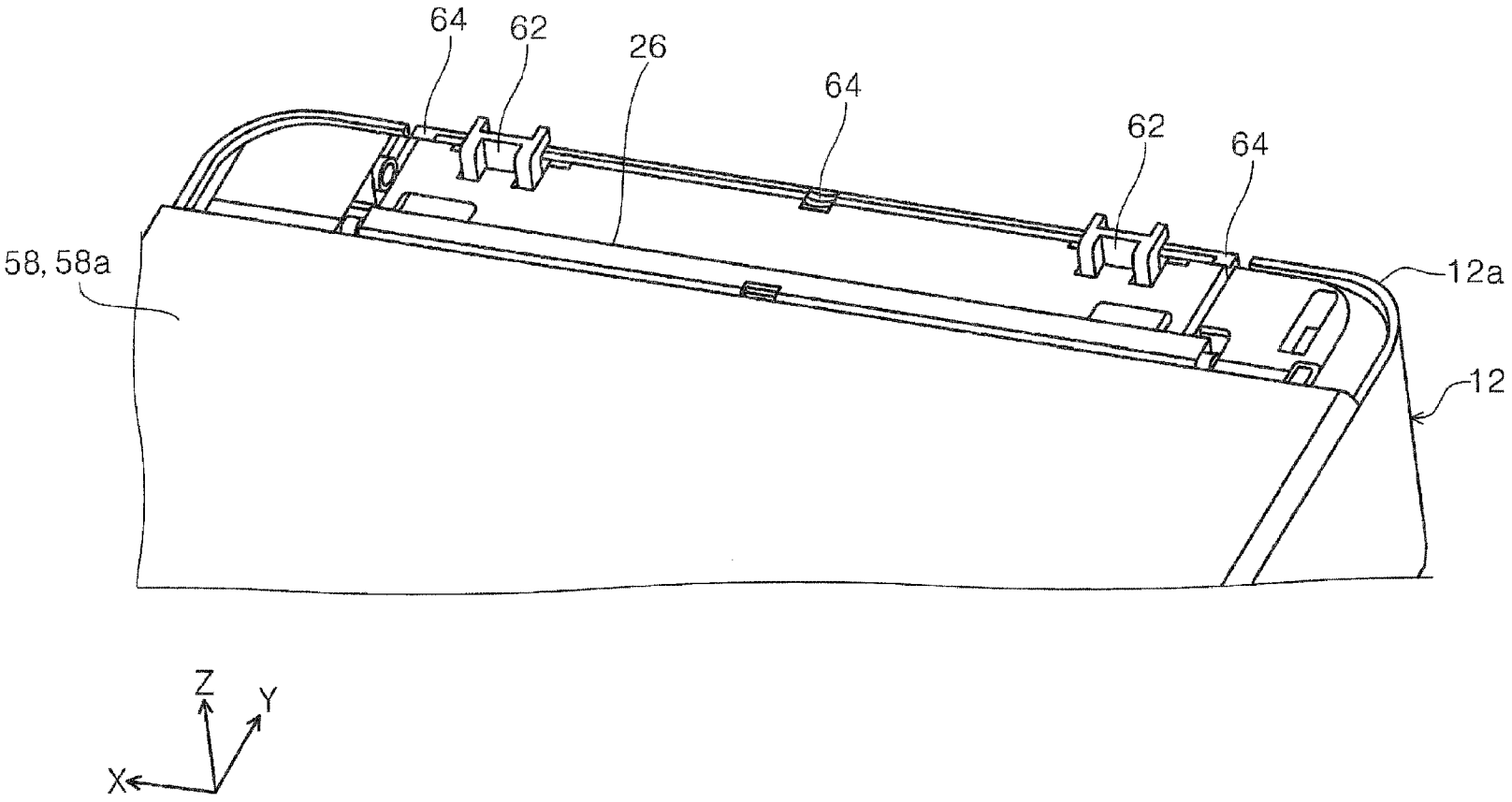
FIG. 7 is a perspective diagram illustrating a state in which the medium supply port cover in FIG. 6 is removed.
Figure 8:
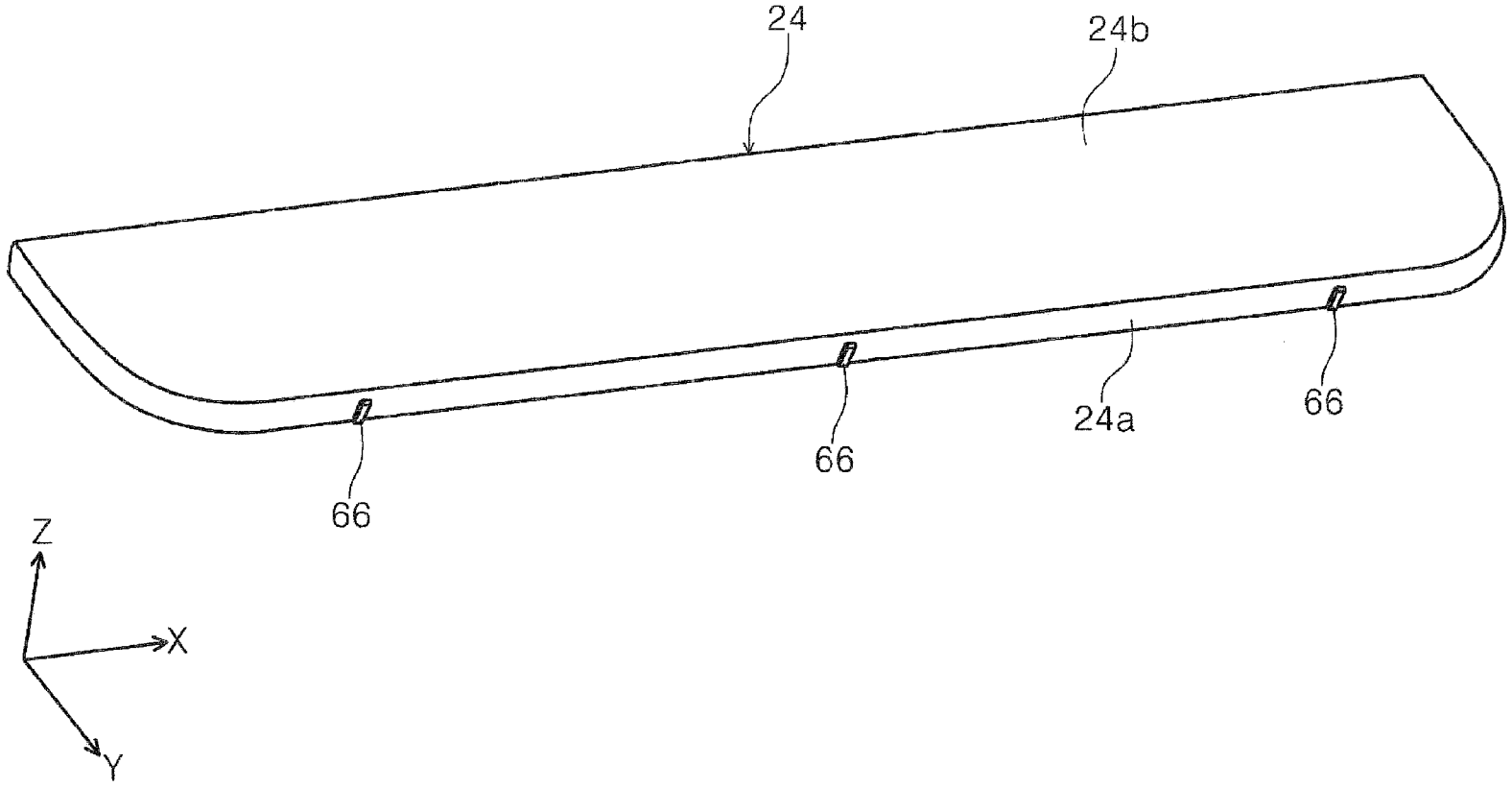
FIG. 8 is a perspective diagram of the medium supply port cover.

FIG. 1 is an external perspective diagram of a printer according to an embodiment, FIG. 2 is an external perspective diagram of the printer according to the embodiment as viewed from the rear surface side, FIG. 3 is a perspective diagram illustrating a state in which a paper output tray is extended to the front of the apparatus in the printer according to the embodiment, FIG. 4 is a lateral sectional diagram illustrating a medium transport path in the printer according to the embodiment, FIG. 5 is a perspective diagram illustrating a state in which a document cover is opened with respect to a reading mechanism unit in the printer, FIG. 6 is a perspective diagram illustrating a state in which the medium supply port cover is opened with respect to the apparatus main body on the rear surface side of the apparatus main body, FIG. 7 is a perspective diagram illustrating a state in which the medium supply port cover in FIG. 6 is removed, and FIG. 8 is a perspective diagram of the medium supply port cover.

Figure 9:
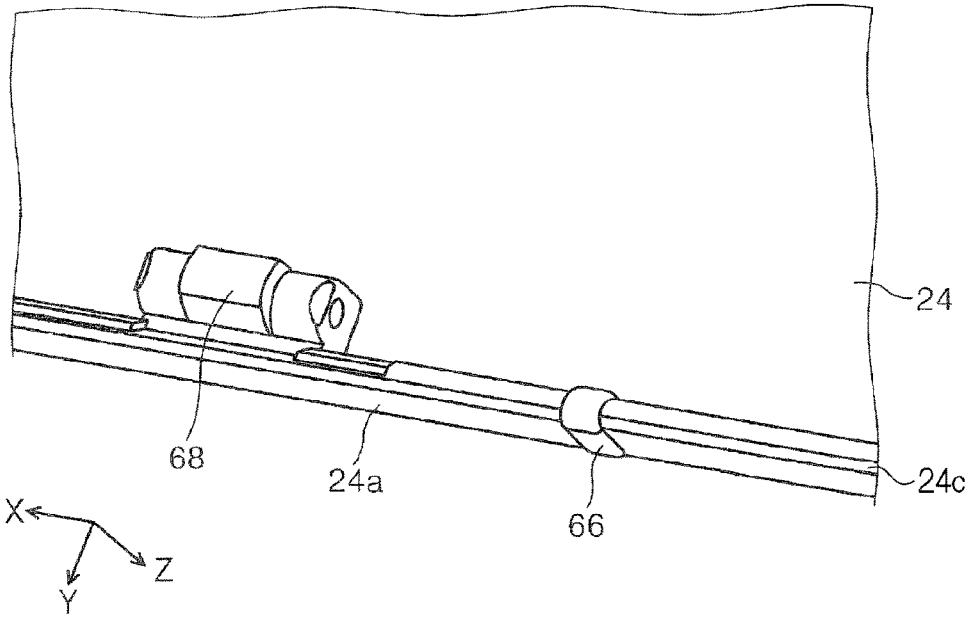
FIG. 9 is a perspective diagram illustrating a sliding surface which is provided on the medium supply port cover.
Figure 10:
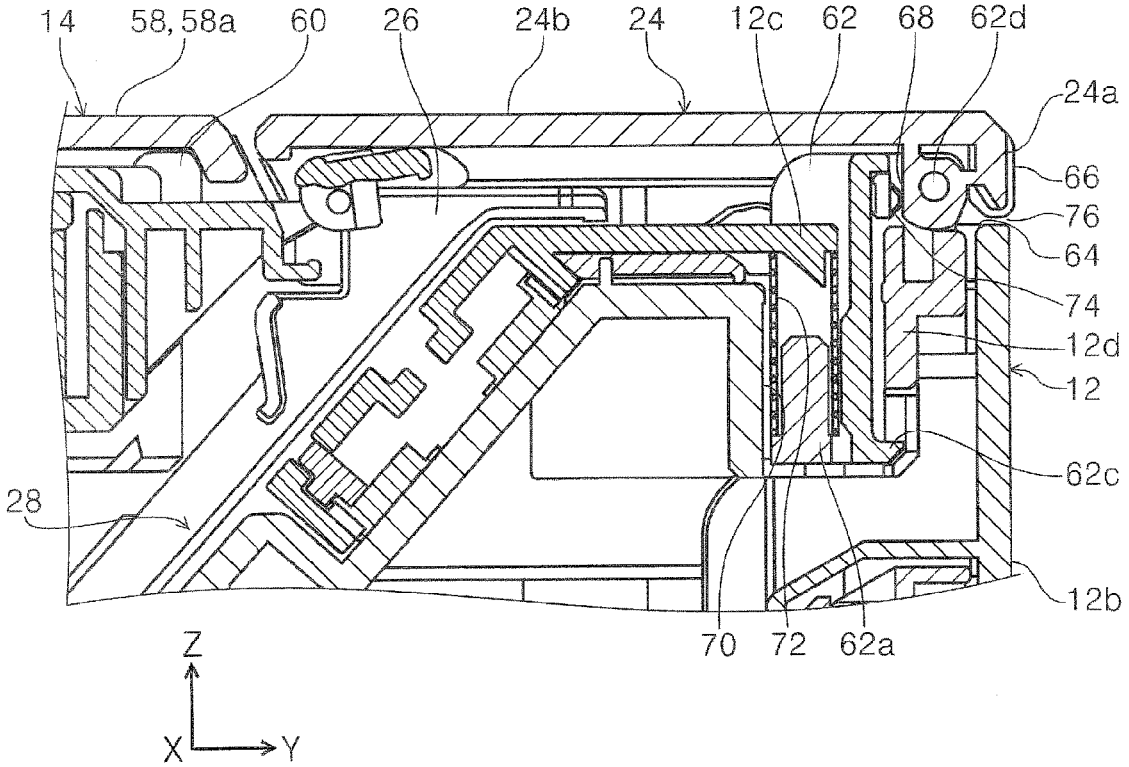
FIG. 10 is a lateral sectional diagram illustrating the medium supply port cover in a state of being closed with respect to the apparatus main body.
Figure 11:
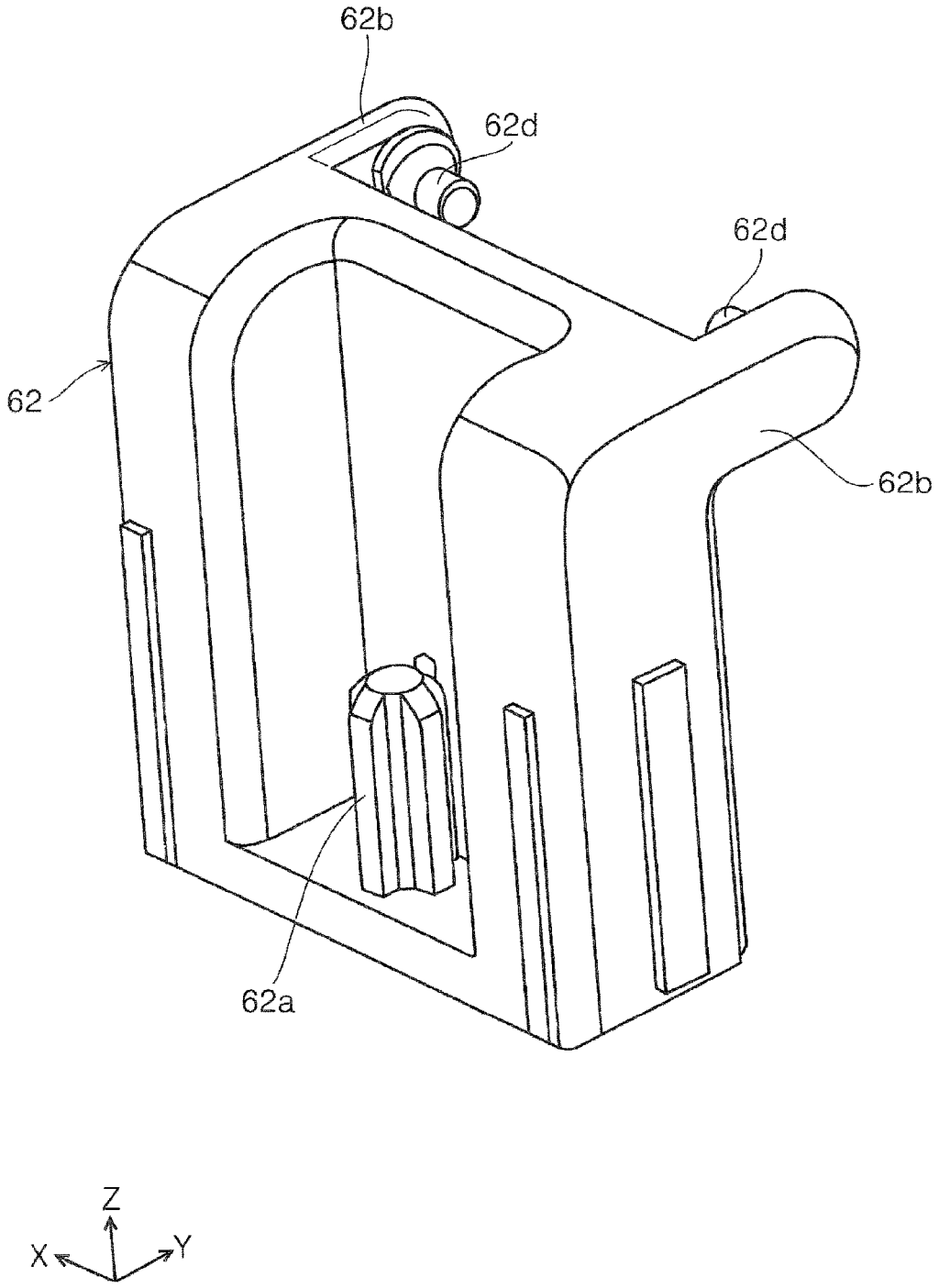
FIG. 11 is a perspective diagram of a hinge member.
Figure 12:
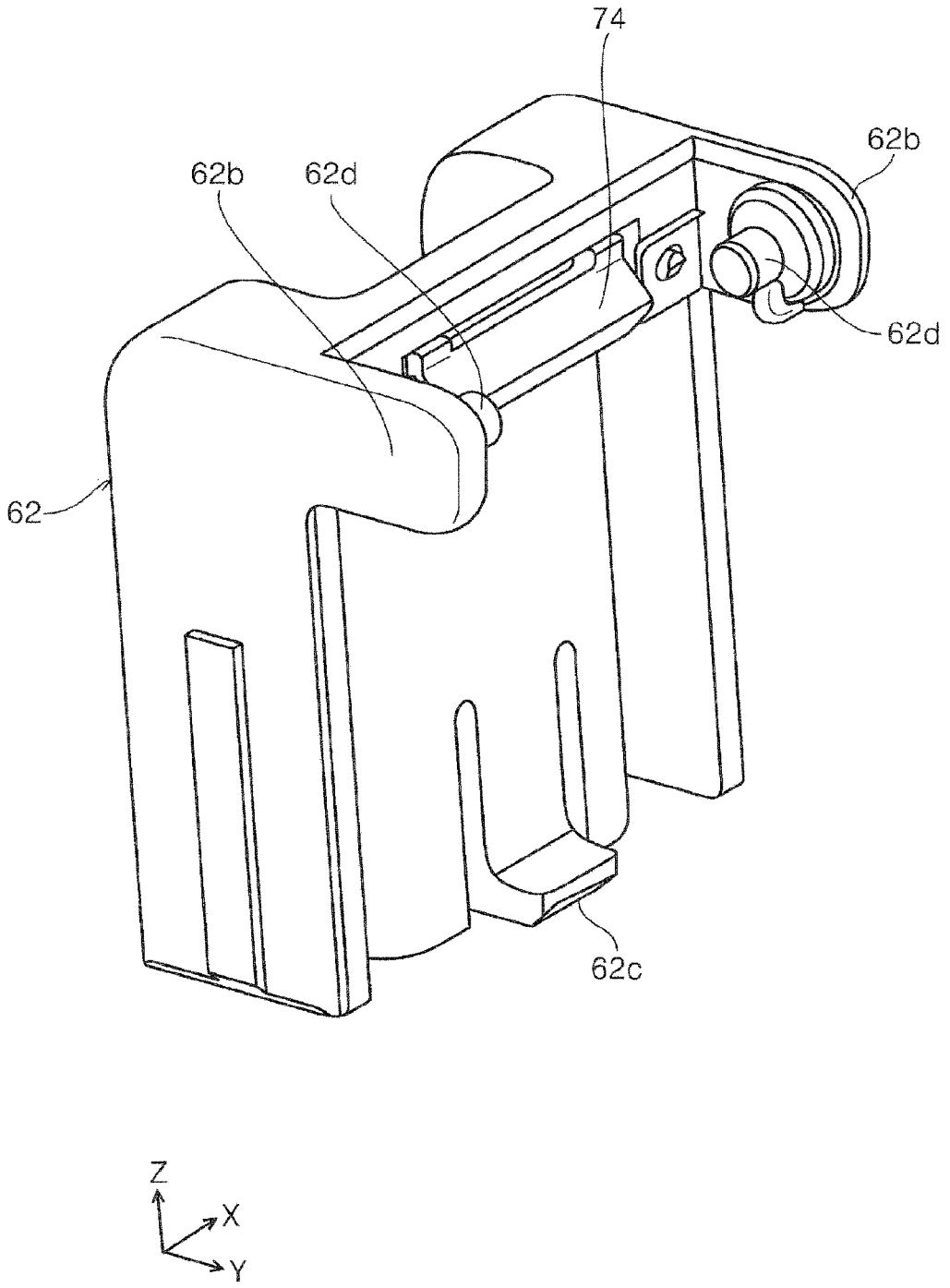
FIG. 12 is a perspective diagram of the hinge member.
Figure 13:
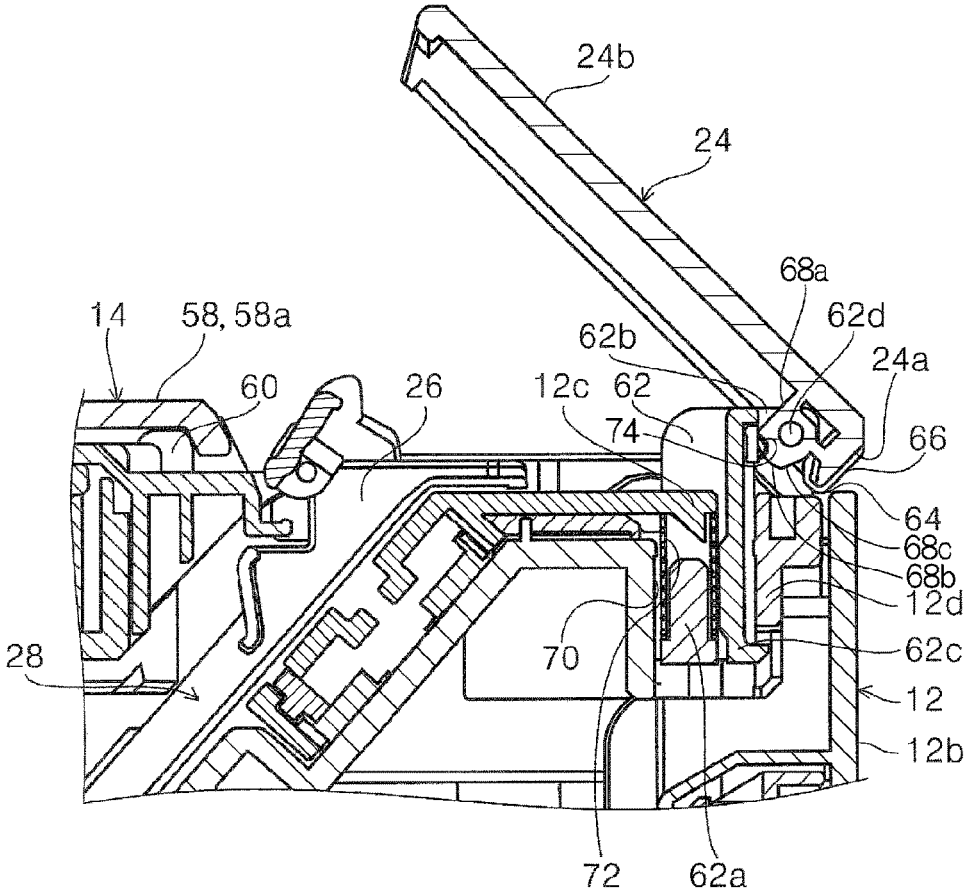
FIG. 13 is a lateral sectional diagram illustrating a state in which the medium supply port cover is tilted with respect to the apparatus main body.
Figure 13:
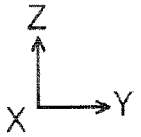
Figure 14:
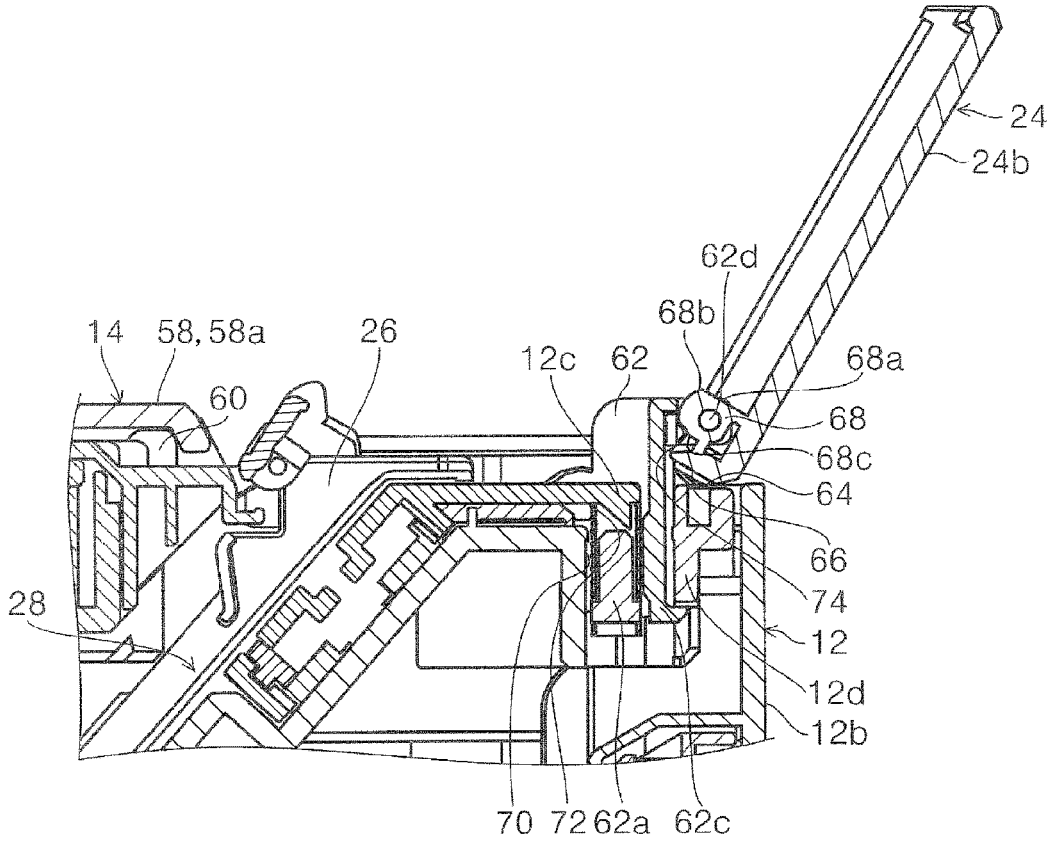
FIG. 14 is a lateral sectional diagram illustrating a state in which the medium supply port cover is tilted with respect to the apparatus main body to incline the medium supply port cover to the apparatus rear surface side.
Figure 14:
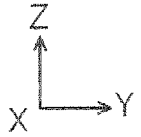
Figure 15:
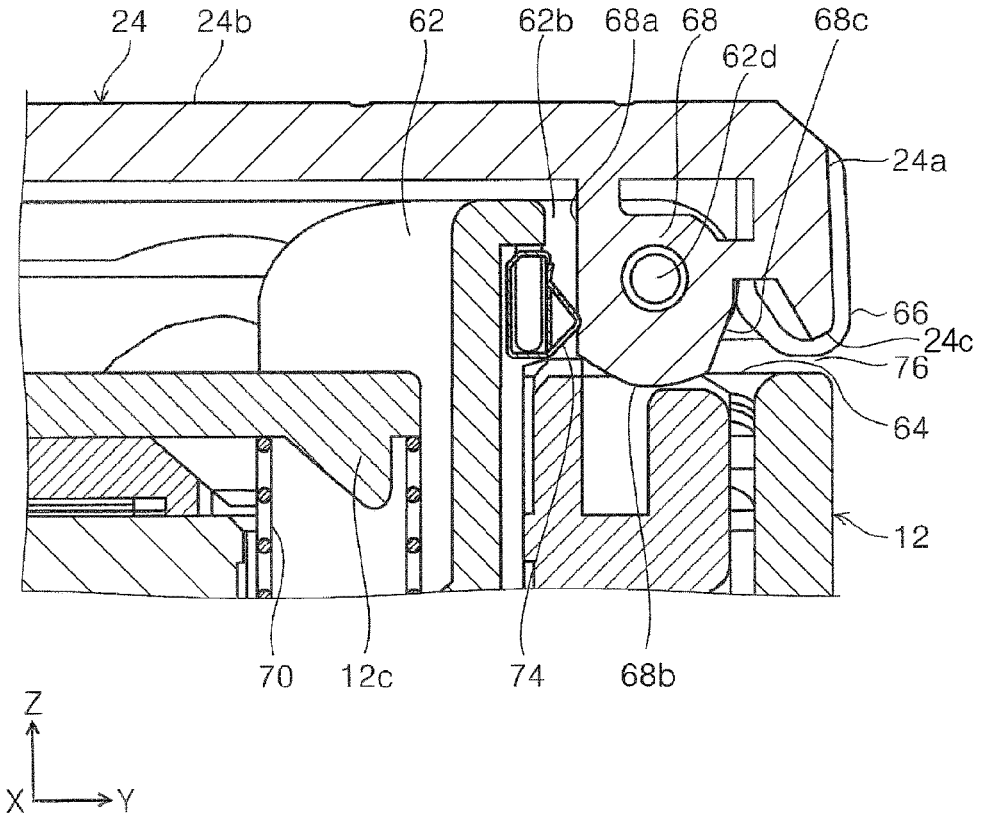
FIG. 15 is a lateral sectional diagram illustrating a state of a spring member which is provided in the hinge member in a state in which the medium supply port cover is closed.
Figure 16:
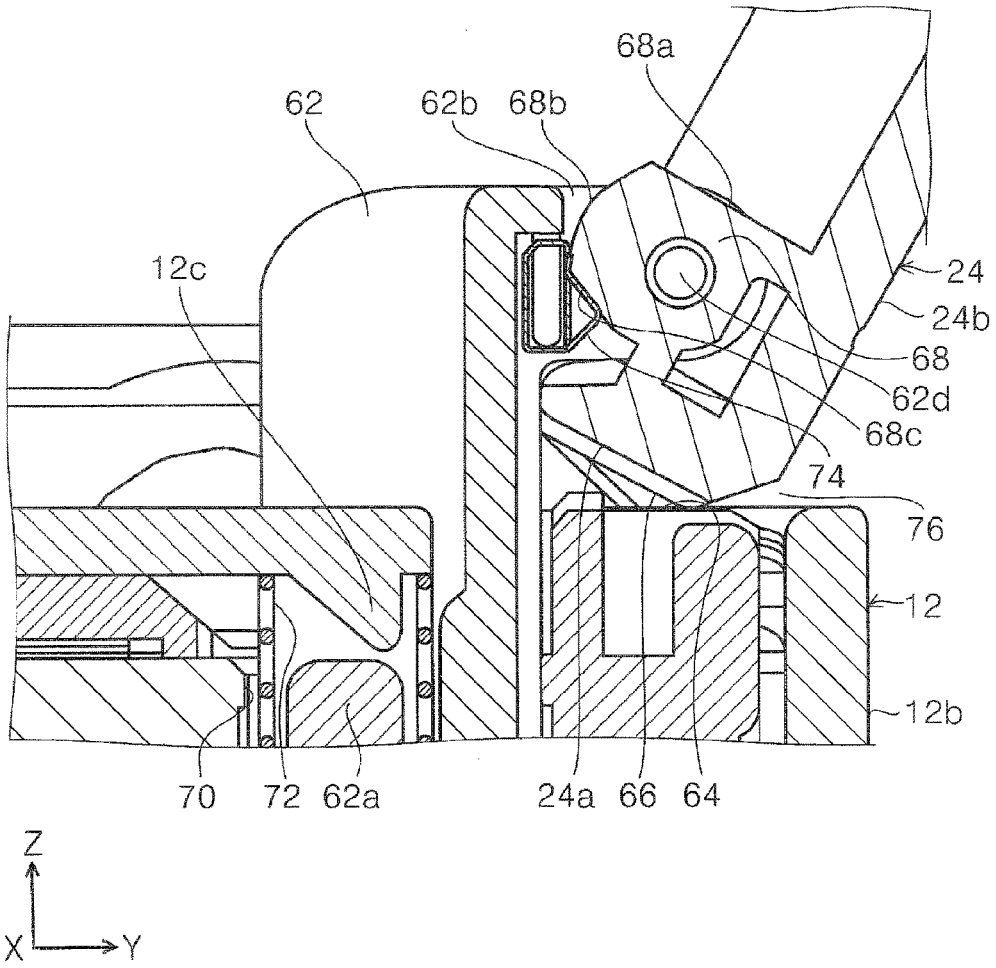
FIG. 16 is a lateral sectional diagram illustrating a state of the spring member which is provided in the hinge member in a state in which the medium supply port cover is opened.

FIG. 9 is a perspective diagram illustrating a sliding surface which is provided on the medium supply port cover, FIG. 10 is a lateral sectional diagram illustrating the medium supply port cover in a state of being closed with respect to the apparatus main body, FIG. 11 is a perspective diagram of a hinge member, FIG. 12 is a perspective diagram of the hinge member, FIG. 13 is a lateral sectional diagram illustrating a state in which the medium supply port cover is tilted with respect to the apparatus main body, FIG. 14 is a lateral sectional diagram illustrating a state in which the medium supply port cover is tilted with respect to the apparatus main body to incline the medium supply port cover to the apparatus rear surface side, FIG. 15 is a lateral sectional diagram illustrating a state of a spring member which is provided in the hinge member in a state in which the medium supply port cover is closed, and FIG. 16 is a lateral sectional diagram illustrating a state of the spring member which is provided in the hinge member in a state in which the medium supply port cover is opened.

In an X-Y-Z coordinate system which is illustrated in the drawings, an X direction indicates a main scanning direction (a movement direction) of a carriage, that is a width direction of the recording apparatus, a Y direction indicates a medium transport direction, that is, a depth direction of the recording apparatus, and a Z direction indicates an apparatus height direction. In the drawings, a +X direction side is the apparatus left side, a −X direction side is the apparatus right side, a −Y direction is an apparatus front surface side, a +Y direction is an apparatus rear surface side, a +Z direction side is the apparatus top side, and a −Z direction side is the apparatus bottom side.

First Example

Outline of Printer

With reference to FIGS. 1 and 2, a printer 10 which serves as the recording apparatus is provided with an apparatus main body 12, a housing 12*a* which configures at least a portion of the outside of the apparatus main body 12, and a reading mechanism unit 14 which is provided on the top portion of the apparatus main body 12. An operation unit 16 is provided on the apparatus front surface side of the apparatus main body 12 to be capable of tilting with respect to the apparatus main body 12. The operation unit 16 is configured to be capable of switching between a posture of being closed with respect to the apparatus main body 12 (refer to FIG. 1), and a posture of being tilted to the apparatus front surface side with respect to the apparatus main body 12 (refer to FIG. 3). A displayer 18 such as a display panel is provided on the operation unit 16.

A front surface cover 20 is disposed on the bottom of the operation unit 16 on the apparatus front surface side of the apparatus main body 12. A paper output tray 22 is provided in the apparatus main body 12. The paper output tray 22 is configured to be capable of switching between a state of being stored inside the apparatus main body 12 (refer to FIG. 1), and a state of being extended to the apparatus front surface side of the apparatus main body 12 (refer to FIG. 3).

A medium supply port cover 24 which serves as the "lid body" is attached to the top portion of the rear surface side of the apparatus main body 12 to be capable of tilting such that the rear surface side in the apparatus depth direction becomes the tilting fulcrum. The medium supply port cover 24 is configured to be capable of switching between a state of being closed with respect to the apparatus main body 12 which is illustrated in FIG. 1 (a closed state), and a state of being opened with respect to the apparatus main body 12 which is illustrated in FIG. 3 (an opened state).

When the medium supply port cover 24 is closed, the medium supply port cover 24 configures a portion of the top surface of the apparatus main body 12, specifically, the top surface of the rear surface side in the apparatus depth direction. A rear surface side end portion 24*a* (refer to FIG. 2) in the apparatus depth direction of the medium supply port cover 24 forms the same surface as a rear surface 12*b* of the apparatus main body 12 in a state in which the medium supply port cover 24 is closed (refer to FIG. 4). In the medium supply port cover 24, for example, an end portion of the apparatus depth direction front surface side is configured as a free end side.

As illustrated in FIG. 3, when the medium supply port cover 24 is opened, a medium supply port 26 into which the recording medium (the medium) is to be set is exposed on the rear surface side of the top portion of the apparatus main body 12. It is possible to insert the recording medium into the medium supply port 26 in the direction of arrow A, and the medium which is inserted is guided down an inclined medium guide path 28 which is illustrated in FIG. 4, and is fed to the downstream side in the transport direction.

Regarding Medium Transport Path

Next, description will be given of a medium transport path 30 of the recording medium in the apparatus main body 12 with reference to FIG. 4. The thick solid line to which reference symbol R is applied in FIG. 4 indicates a guide path of the medium which is transported from a cassette 32 to the paper output tray 22 along the medium transport path 30.

The cassette 32 which stores the recording medium is provided in the bottom portion of the apparatus main body 12. The cassette 32 is formed in a box shape, and the inner portion thereof is capable of storing the recording medium. A pickup roller 34, an inversion roller 36, follower rollers 38*a*, 38*b*, and 38*c*, a transport roller pair 40, a recording unit 42, and an output roller pair 44 are provided in this order along the medium transport path 30 inside the apparatus main body 12. The pickup roller 34 is disposed above the cassette 32 to be capable of tilting, using the tilting shaft 46 as a fulcrum. The recording medium which is fed from the cassette 32 by the pickup roller 34 is nipped by the inversion roller 36 and the follower rollers 38*a* and 38*b*, and is transported to the transport roller pair 40.

The transport roller pair 40 transports the recording medium to the recording unit 42. The recording unit 42 is provided with a carriage 48, a recording head 50 which serves as the "recorder", and a medium guide member 52. The carriage 48 is configured to be capable of reciprocally moving in the apparatus width direction. The recording head 50 is provided on the bottom portion of the carriage 48. The recording head 50 is configured to discharge an ink toward the bottom side in apparatus height direction.

The medium guide member 52 is provided under the recording head 50 in a region which faces the recording head 50. The medium guide member 52 is disposed to face the recording head 50, leaving an interval between the medium guide member 52 and the recording head 50. The medium guide member 52 supports the bottom surface (a surface of the opposite side from the recording surface) of the recording medium which is transported by the transport roller pair 40 to the region which faces the recording head 50. The recording head 50 discharges the ink onto the recording medium which is supported by the medium guide member 52, and executes recording on the recording surface of the recording medium.

The recording medium on which the recording is executed is nipped by the output roller pair 44 which is provided on the downstream side in the transport direction of the recording unit 42, and is output toward the paper output tray 22 (refer to FIG. 3) which protrudes to the apparatus front surface side.

The medium supply port cover 24 is opened, and the recording medium which is inserted into the medium supply port 26 from above the printer 10 is guided to the medium guide path 28, is transported to the recording unit 42, and recording is performed in the recording unit 42. After the recording is performed, the recording medium is output to the paper output tray 22.

In a case in which after recording is executed on a first surface (the recording surface) of the recording medium in the recording unit 42, recording is performed on a second surface (the bottom surface) of the opposite side from the first surface, the transport roller pair 40 is reversed to transport the recording medium to the upstream side in the transport direction. The recording medium which is transported to the upstream side in the transport direction is nipped by the inversion roller 36 and the follower roller 38*c*. The first surface and the second surface of the recording medium are inverted by the inversion roller 36, and after the recording medium is transported again to the recording unit 42 and the recording of the second surface is executed in the recording unit 42, the recording medium is output toward the paper output tray 22.

Regarding Reading Mechanism Unit

Next, description will be given of the reading mechanism unit 14 with reference to FIGS. 4 and 5. The reading mechanism unit 14 is provided on the top portion of the apparatus main body 12. The reading mechanism unit 14 is configured as a scanner. The reading mechanism unit 14 is provided with a main body portion 54 (refer to FIG. 4), a document stand 56 (refer to FIG. 4) which is provided on the top portion of the main body portion 54, and a document cover 58. The document stand 56 is formed of a transparent glass plate, for example, and is configured such that it is possible to place a document on the top surface of the document stand 56.

As illustrated in FIG. 5, the document cover 58 is formed as a plate-shaped member. The dimension of the document cover 58 in the apparatus width direction is set to a dimension corresponding to the horizontal width of the apparatus main body 12, for example. The document cover 58 is joined to a hinge member 60 to be capable of tilting with respect to the hinge member 60. The hinge member 60 is inserted into the main body portion 54 of the reading mechanism unit 14.

The hinge member 60 is connected to the main body portion 54 by snap fitting, for example. In other words, the document cover 58 is connected to be capable of tilting due to the hinge member 60 with respect to the main body portion 54. When an external force greater than or equal to a predetermined amount is applied to the document cover 58, the engagement state between the hinge member 60 and the main body portion 54, that is, the snap fitting is released, and damage to the document cover 58 is suppressed or avoided. Description of the specifics of the attachment mechanism of the hinge member 60 with respect to the main body portion 54 will be omitted.

The document cover 58 opens and closes the document stand 56 by tilting to the rear surface side and the front surface side in the apparatus depth direction. In other words, the document cover 58 has the same opening direction as the medium supply port cover 24. The document cover 58 covers the document stand 56 in the closed state (refer to FIGS. 1 to 3), and exposes the document stand 56 in the opened state (refer to FIG. 5). The document cover 58 configures the top surface of the front surface side of in the apparatus depth direction in the printer 10 in a state in which the document cover 58 is closed, for example. As illustrated in FIG. 1, in the present example, a top surface 24*b* of the medium supply port cover 24 in the closed state and a top surface 58*a* of the document cover 58 in the closed state are configured to form the same surface. Accordingly, it is possible to realize a favorable external appearance in the printer 10.

By opening the document cover 58 to expose the document stand 56, setting the document on the top surface of the document stand 56, and closing the document cover 58, it becomes possible to read the document on the document stand 56. A reader (not illustrated) which is capable of reading the document which is set on the document stand 56 is provided under the document stand 56, that is, inside the main body portion 54.

In the present example, a tilting shaft (not illustrated) is provided in the reading mechanism unit 14 near to the rear surface side of the main body portion 54 in the apparatus depth direction. The reading mechanism unit 14 is joined to the apparatus main body 12 to be capable of tilting via the tilting shaft. The reading mechanism unit 14 is configured to be capable of switching between a posture of being closed with respect to the apparatus main body 12 (refer to FIGS. 1 and 2), and a posture of being tilted and opened with respect to the apparatus main body 12 (not illustrated).

Regarding Medium Supply Port Cover

Next, description will be given of the medium supply port cover 24 with reference to FIGS. 6 to 16. As illustrated in FIG. 6, the medium supply port cover 24 is attached to the rear surface side end portion of the apparatus main body 12 via a hinge member 62 to be capable of tilting with respect to the apparatus main body 12. Here, with reference to FIG. 7, a plurality of sliding surfaces 64 are formed on the top portion of the end portion of the rear surface side of the apparatus main body 12 in the apparatus depth direction, leaving an interval in the apparatus width direction.

With reference to FIGS. 8 and 9, the medium supply port cover 24 is configured as a plate-shaped member which extends in the apparatus width direction. The dimension in the apparatus width direction of the medium supply port cover 24 is set to a dimension corresponding to the horizontal width of the apparatus main body 12, for example. In other words, in a state in which the medium supply port cover 24 is closed, a level difference or the like is unlikely to arise between the medium supply port cover 24 and the apparatus main body 12 in the apparatus width direction, so that the appearance of the apparatus is improved.

As illustrated in FIGS. 8 and 9, a plurality of sliding target surfaces 66 are formed at the rear surface side end portion 24*a* of the medium supply port cover 24 leaving an interval in the apparatus width direction. The sliding target surface 66 extends from the top side toward the bottom side in the apparatus height direction of the rear surface side end portion 24*a*, further passes a bottom portion 24*c* of the rear surface side end portion 24*a*, and extends to the top side in the apparatus height direction on the inside of the rear surface side end portion 24*a* (also refer to FIG. 15).

As illustrated in FIG. 9, a plurality of bearings 68 are provided on the rear surface of the medium supply port cover 24 at an interval in the apparatus width direction. The bearings 68 are provided in positions in the apparatus width direction corresponding to positions of the hinge member 62 which is provided on the apparatus main body 12.

Regarding Hinge Member

Next, with reference to FIGS. 10 to 12, a hinge member attachment portion 70 is provided on the rear surface side end portion of the apparatus main body 12. A biasing unit attachment portion 12*c* and a hook engagement portion 12*d* which will be described later are provided on the hinge member attachment portion 70. The hinge member 62 is attached to the hinge member attachment portion 70 to be capable of sliding in a direction including a vertical direction component, that is, in the apparatus height direction. Description of the hinge member 62 will be performed based on the posture in which the hinge member 62 is attached to the apparatus main body 12.

A biasing unit 72 is provided between the hinge member 62 and the apparatus main body 12. The biasing unit 72 is configured as a compressed coil spring, for example. As illustrated in FIG. 11, a biasing unit attachment portion 62*a* is attached to the front surface side of the hinge member 62 in the apparatus depth direction. The biasing unit attachment portion 62*a* is formed in a pin shape, for example, and is inserted into one end of the biasing unit 72.

The other end of the biasing unit 72 is engaged with the biasing unit attachment portion 12*c* which is provided on the hinge member attachment portion 70. Here, the biasing force of the biasing unit 72 biases the hinge member 62 in a direction including a vertical direction component inside the hinge member attachment portion 70, for example, the biasing unit 72 biases the hinge member 62 to the bottom side in the apparatus height direction.

With reference to FIG. 12, a pair of tilting shaft portions 62*b*, a hook 62*c*, and a spring member 74 are provided on the rear surface side of the hinge member 62 in the apparatus depth direction. The tilting shaft portions 62*b* protrude from an end portion of the top side of the hinge member 62 in the apparatus height direction to the rear surface side in the apparatus depth direction. Tilting shafts 62*d* protrude in directions facing each other on the tips of the pair of tilting shaft portions 62*b*.

The tilting shafts 62*d* are inserted into the bearings 68 of the medium supply port cover 24. The pair of tilting shaft portions 62*b* which face each other have elasticity. When an external force greater than or equal to a predetermined amount acts on the medium supply port cover 24 in a state in which the tilting shafts 62*d* are inserted into the bearings 68, the pair of tilting shaft portions 62*b* warp in directions so as to separate from each other, the tilting shafts 62*d* escape from the bearings 68, and the linking between the medium supply port cover 24 and the hinge member 62 is released. Accordingly, it is possible to suppress or avoid damage to the medium supply port cover 24 or the hinge member 62.

The hook 62*c* is formed on the bottom end portion of the hinge member 62. The hook 62*c* defines the range of the slide movement of the hinge member 62 in the apparatus height direction by coming into contact with or separating from the hook engagement portion 12*d* when the hinge member 62 is slide moved in the apparatus height direction inside the hinge member attachment portion 70.

The spring member 74 is provided on the top end portion of the hinge member 62, and the spring member 74 is disposed between the pair of tilting shaft portions 62*b* in the apparatus width direction. The spring member 74, for example, is configured as a plate spring, more specifically, a so-called double stability spring. The spring member 74 is in contact with the bearings 68 of the medium supply port cover 24. The spring member 74 biases in a direction in which the medium supply port cover 24 closes in a range in which the medium supply port cover 24 opens to a predetermined opening angle from a closed state, and biases in a direction in which the medium supply port cover 24 opens in a range in which the medium supply port cover 24 is further opened from the predetermined opening angle.

Hereinafter, description will be given of the opening and closing operations of the medium supply port cover 24 with reference to FIGS. 10, and 13 to 16. With reference to FIG. 10, in a state in which the medium supply port cover 24 is closed, due to the biasing force of the biasing unit 72 which biases the hinge member 62 to the bottom side in the apparatus height direction, the medium supply port cover 24 is also biased to the apparatus main body 12 side. Accordingly, since the medium supply port cover 24 is pulled to the apparatus main body 12 side, a gap 76 between the rear surface side end portion 24*a* of the medium supply port cover 24 and the housing 12*a* of the apparatus main body 12 in the apparatus height direction is reduced. In other words, in the state in which the medium supply port cover 24 is closed, the gap 76 assumes as filled state (also refer to FIG. 2).

Here, as illustrated in FIG. 10, in the state in which the medium supply port cover 24 is closed, the hinge member 62 is configured to be concealed on the inside of the medium supply port cover 24 and the housing 12*a*. Therefore, it is possible to improve the external appearance of the printer 10 in the state in which the medium supply port cover 24 is closed.

In the state in which the medium supply port cover 24 is closed, the hinge member 62 is biased to the bottom side in the apparatus height direction by the biasing unit 72, and the hook 62*c* is in a state of being separated from the hook engagement portion 12*d* which is provided on the apparatus main body 12.

As illustrated in FIG. 15, a closing position regulating surface 68*a*, a cam surface 68*b*, and an opening position regulating surface 68*c* are formed on the outer circumferential surface of the bearing 68 of the medium supply port cover 24. In the state in which the medium supply port cover 24 is closed, the spring member 74 comes into contact with the closing position regulating surface 68*a* at a position closer to the bottom side than the tilting shaft 62*d* in the apparatus height direction, and biases the closing position regulating surface 68*a*. Therefore, the spring member 74 biases the medium supply port cover 24 in a direction in which the medium supply port cover 24 closes.

Next, as illustrated in FIG. 13, when the medium supply port cover 24 is opened from the closed state (refer to FIG. 10), the sliding target surface 66 which is provided on the rear surface side end portion 24*a* comes into contact with the sliding surfaces 64 of the apparatus main body 12. The medium supply port cover 24 opens while the sliding target surface 66 slides on the sliding surfaces 64. At this time, the spring member 74 slides from the closing position regulating surface 68*a* along the cam surface 68*b*, and changes the contact position with the bearings 68. Since the spring member 74 biases in the radial direction of the bearing 68, it is possible to suppress wobbling of the medium supply port cover 24 with respect to the hinge member 62.

When the sliding target surface 66 comes into contact with the sliding surfaces 64, the contacting portion becomes a fulcrum, and the hinge member 62 is caused to slide to the top side in the apparatus height direction against the biasing force of the biasing unit 72. At this time, the hook 62*c* moves to the top side in the apparatus height direction and approaches the hook engagement portion 12*d*.

As illustrated in FIGS. 14 and 16, when the medium supply port cover 24 is further opened, the spring member 74 comes into contact with the opening position regulating surface 68*c* in the cam surface 68*b*. In this state, the spring member 74 biases the opening position regulating surface 68*c*. The biasing force of the spring member 74 acts in the direction in which the medium supply port cover 24 opens. When the contact position between the spring member 74 and the cam surface 68*b* is switched from the closing position regulating surface 68*a* to the opening position regulating surface 68*c*, or from the opening position regulating surface 68*c* to the closing position regulating surface 68*a*, since the user can feel a clicking sensation, it is possible to improve the ease of use in the opening and closing operations of the medium supply port cover 24.

Since the hook 62*c* in this state engages with the hook engagement portion 12*d*, the sliding movement to the top side in the apparatus height direction of the hinge member 62 is regulated.

Here, the hinge member 62 is biased to the bottom side in the device height direction by the biasing unit 72; however, the sliding target surface 66 is in contact with the sliding surfaces 64, and the displacement of the hinge member 62 to the bottom side in the apparatus height direction is regulated. Therefore, the medium supply port cover 24 maintains a posture of being inclined to the rear surface side in the apparatus depth direction with respect to the apparatus main body 12. In this state, the medium supply port cover 24 may be configured to function as a medium support member which supports the medium which is inserted into the medium supply port 26 in an inclined posture.

In order to switch from the state in which the medium supply port cover 24 is opened to the state in which the medium supply port cover 24 is closed, it is possible to close the medium supply port cover 24 by tilting the medium supply port cover 24 from the rear surface side toward the front surface side in the apparatus depth direction using a force greater than or equal to the biasing force of the spring member 74. At this time, when the opening angle of the medium supply port cover 24 is less than or equal to a predetermined angle, the direction in which the biasing force of the spring member 74 acts is switched from the direction in which the medium supply port cover 24 opens to the direction in which the medium supply port cover 24 closes, and so even if an external force is not applied, the medium supply port cover 24 naturally switches to the closed state.

With reference to FIG. 6 again, the medium supply port cover 24 and the apparatus main body 12 are linked to be capable of tilting using the hinge member 62 and the bearings 68 which are disposed to leave an interval in the apparatus width direction. The hinge members 62 are biased to the bottom side in the apparatus height direction by the biasing unit 72.

Here, the biasing force of the biasing unit 72 is set to a magnitude at which, for example, when lifting up a side portion of the medium supply port cover 24 in the apparatus width direction to open the medium supply port cover 24, the medium supply port cover 24 tilts without the hinge member 62 which is in a distant position from the side portion lifting up, using the hinge member 62 which is in a position far from the side portion as a fulcrum. Accordingly, even if the user lifts up the side portion of the medium supply port cover 24, it is possible to tilt the medium supply port cover 24 using the tilting shaft 62*d* as a fulcrum without the hinge member 62 being lifted up, and it is possible to improve the ease of use.

Since a configuration is adopted in which the hinge member 62 is caused to move by sliding in the apparatus height direction, it is possible to prevent the medium supply port cover 24 from interfering with the apparatus main body 12 during the opening and closing operations of the medium supply port cover 24. As a result, it is no longer necessary to provide an escape shape or the like for preventing the interference in the medium supply port cover 24 or the apparatus main body 12, and it is possible to improve the design characteristics of the printer 10.

Modification Example of First Example

Although the medium supply port cover 24 is configured as a single member, it is possible to configure the medium supply port cover 24 using a plurality of components which are capable of expanding and contracting along the direction in which the medium is inserted into the medium supply port 26 in order to increase the support region of the medium.

To summarize the description given above, the printer 10 is provided with the housing 12*a* which configures at least a portion of the outside of the apparatus main body 12 which is provided with the recording head 50 which performs the recording on the medium, the medium supply port cover 24 which opens and closes at least a portion of the top portion of the apparatus main body 12 and is capable of tilting, and the tilting shaft 62*d* of the medium supply port cover 24, in which the tilting shaft 62*d* is capable of being displaced in the apparatus height direction which is a direction intersecting the axial line direction of the tilting shaft 62*d*, and in which the medium supply port cover 24 is capable of tilting from the closed space which fills the gap 76 between the rear surface side end portion 24*a* and the housing 12*a* of the opposite side with respect to the free end side to the opened state due to the displacement of the tilting shaft 62*d*. According to this configuration, it becomes possible to suitably open and close the medium supply port cover 24 while reducing the size of the gap between the rear surface side end portion 24*a* and the housing 12*a* of the tilting shaft side end portion of the medium supply port cover 24.

The tilting shaft 62*d* is configured by the hinge member 62 which is provided to be capable of sliding in the apparatus height direction which is a direction including a vertical direction component with respect to the apparatus main body 12. According to this configuration, it is possible to realize a configuration which displaces the tilting shaft 62*d* in the direction intersecting the axial line direction with a simple structure and low cost.

The hinge member 62 is biased in the downward direction in the apparatus height direction which is a direction including a vertical downward direction component by the biasing unit 72. According to this configuration, it is possible to maintain a state in which the gap 76 between the medium supply port cover 24 and the housing 12*a* is filled, that is, a state which is preferable from the perspective of the external appearance.

A plurality of pairs of the hinge member 62 and the biasing unit 72 are provided along the apparatus width direction which is the tilting axial line direction of the medium supply port cover 24, and the biasing force of the biasing unit 72 is set to a magnitude at which when lifting up a side portion of the medium supply port cover 24 in the apparatus width direction which is the tilting axial line direction to open the medium supply port cover 24, the medium supply port cover 24 tilts without the hinge member 62 which is in a position close to the side portion lifting up, using the hinge member 62 which is in a distant position from the side portion as a fulcrum. According to this configuration, when the user lifts up the side portion of the medium supply port cover 24 in the apparatus width direction which is the tilting axial line direction to open the medium supply port cover 24, it is possible to suitably open the medium supply port cover 24.

The hinge member 62 is provided on the inside of the housing 12*a*, and in a state in which the medium supply port cover 24 is closed, the hinge member 62 is concealed on the inside of the housing 12*a* and the medium supply port cover 24. According to this configuration, in the state in which the medium supply port cover 24 is closed, it is possible to improve the external appearance of the printer 10.

The hinge member 62 is provided with the spring member 74 which biases the medium supply port cover 24 in a closing direction in a range in which the medium supply port cover 24 opens to a predetermined opening angle from a closed state, and biases the medium supply port cover 24 in an opening direction in a range in which the medium supply port cover 24 is further opened from the predetermined opening angle. According to this configuration, the ease of use is improved during the opening and closing of the medium supply port cover 24.

The reading mechanism unit 14 which reads the document, and the medium supply port 26 in which it is possible to set the medium are included on the top portion of the apparatus main body 12, the medium supply port cover 24 opens and closes the medium supply port 26, the reading mechanism unit 14 is provided with the document cover 58 which opens and closes the document stand 56 on which the document is placed and has the same opening direction as the medium supply port cover 24, the medium supply port cover 24 and the document cover 58 have widths corresponding to the horizontal width of the apparatus main body 12 and the top surface 24*b* of the medium supply port cover 24 and the top surface 58*a* of the document cover 58 form the same surface, and the rear surface side end portion 24*a* which is the end portion of the opposite side from the free end side of the medium supply port cover 24 and the rear surface 12*b* of the apparatus main body 12 form the same surface. According to this configuration, it is possible to obtain a recording apparatus with an excellent external appearance.

In the present embodiment, the medium supply port cover 24 is applied to the ink jet printer which serves as an example of the recording apparatus; however, it is also possible to apply the medium supply port cover 24 to other liquid ejecting apparatuses in general.

Second Embodiment

Description will be given of an outline of the printer according to the second embodiment of the invention.

Figure 17:
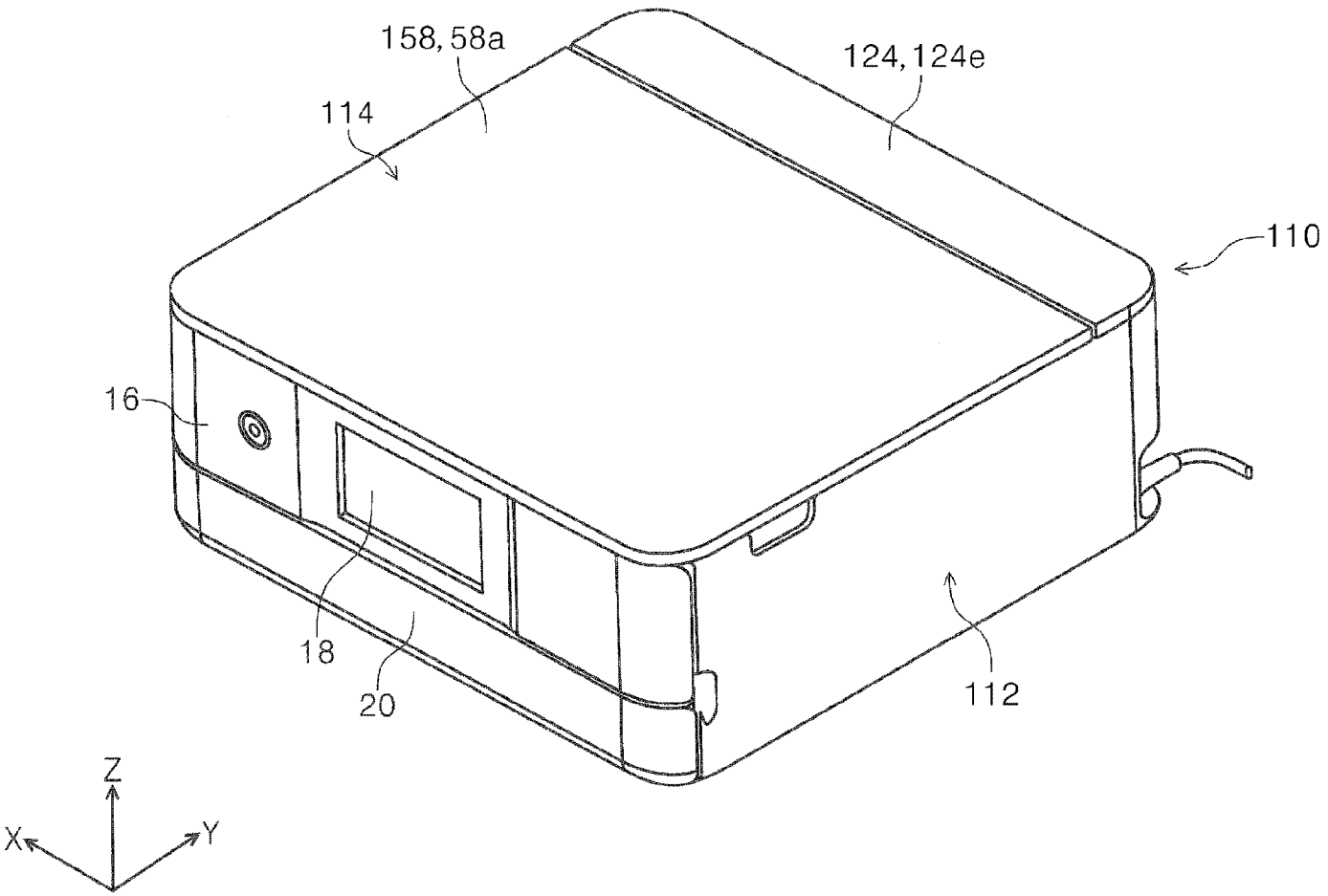
FIG. 17 is an external perspective diagram of a printer according to an embodiment.
Figure 18:
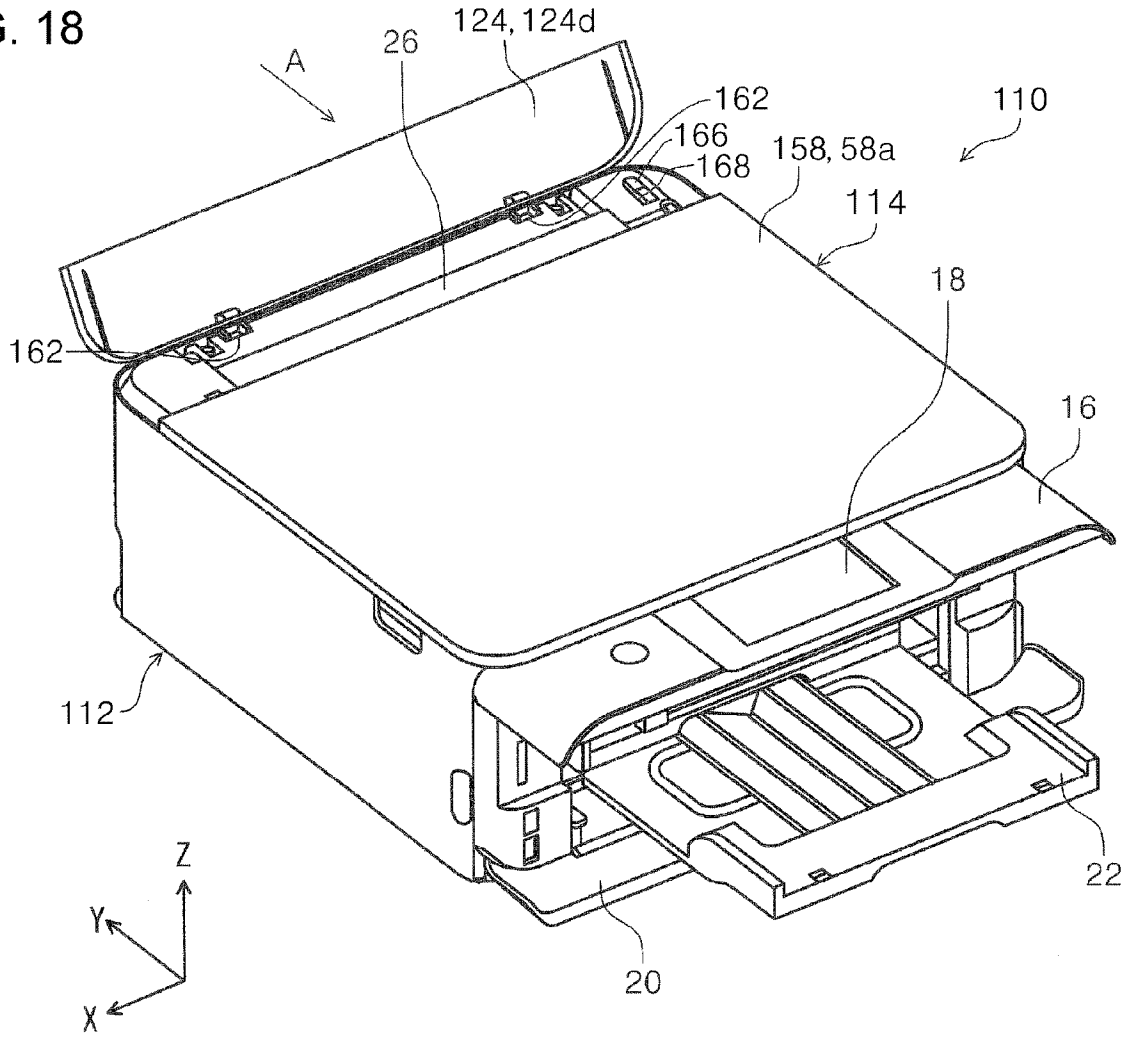
FIG. 18 is a perspective diagram of a state in which a paper output tray in the printer according to the embodiment is extended.
Figure 19:
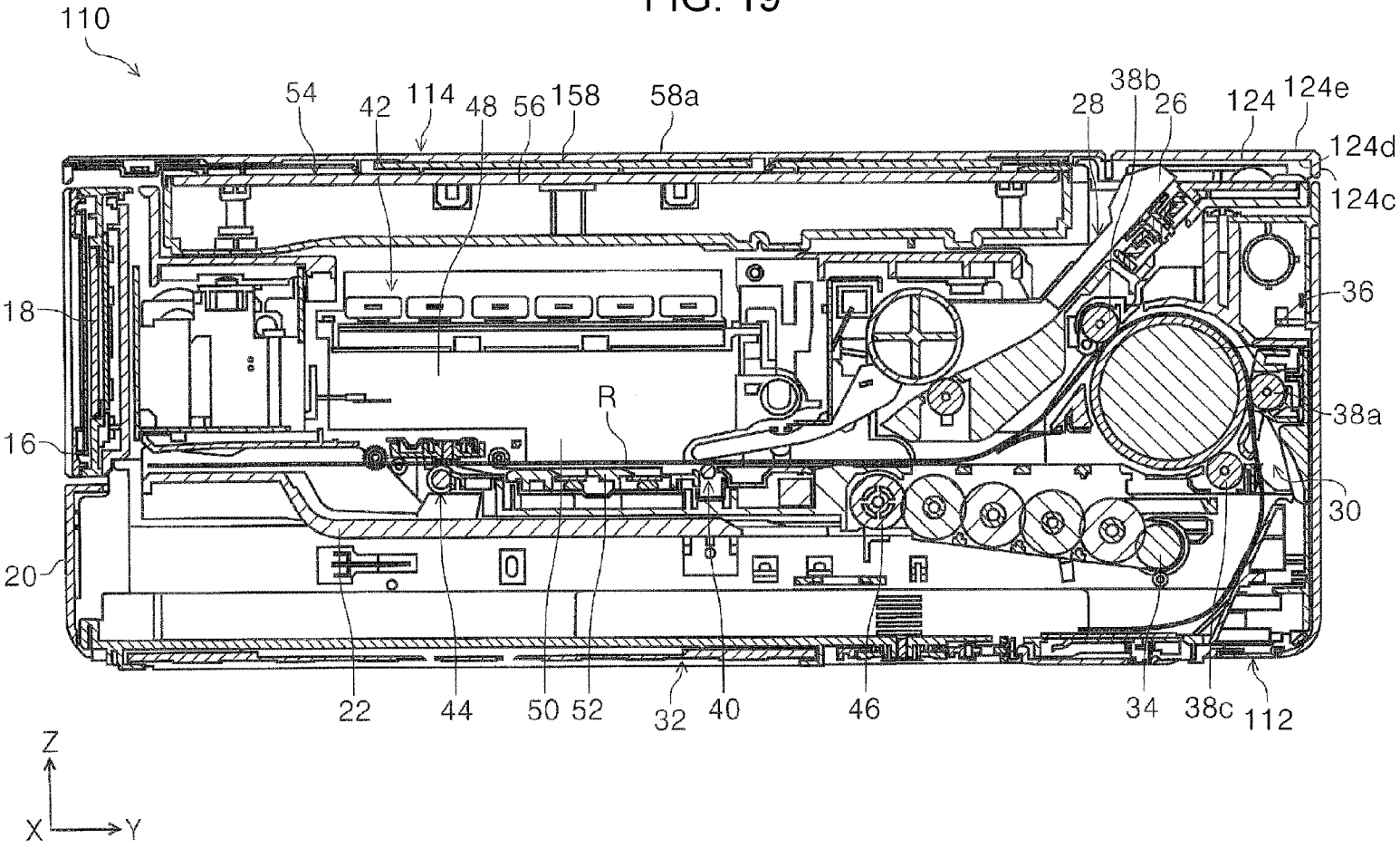
FIG. 19 is a lateral sectional diagram illustrating a medium transport path in the printer according to the embodiment.
Figure 20:
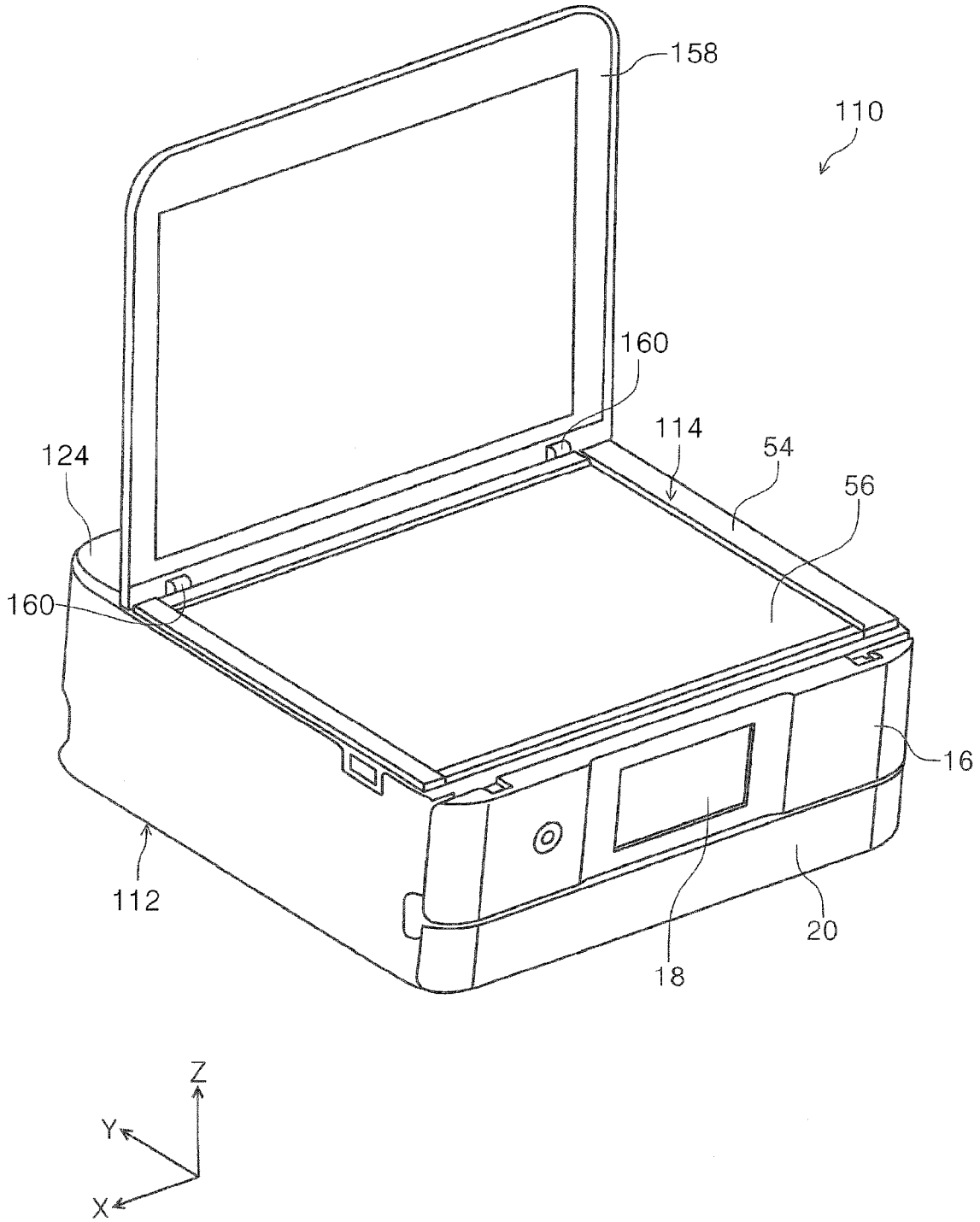
FIG. 20 is a perspective diagram illustrating a state in which a document cover in the printer is opened.
Figure 21:
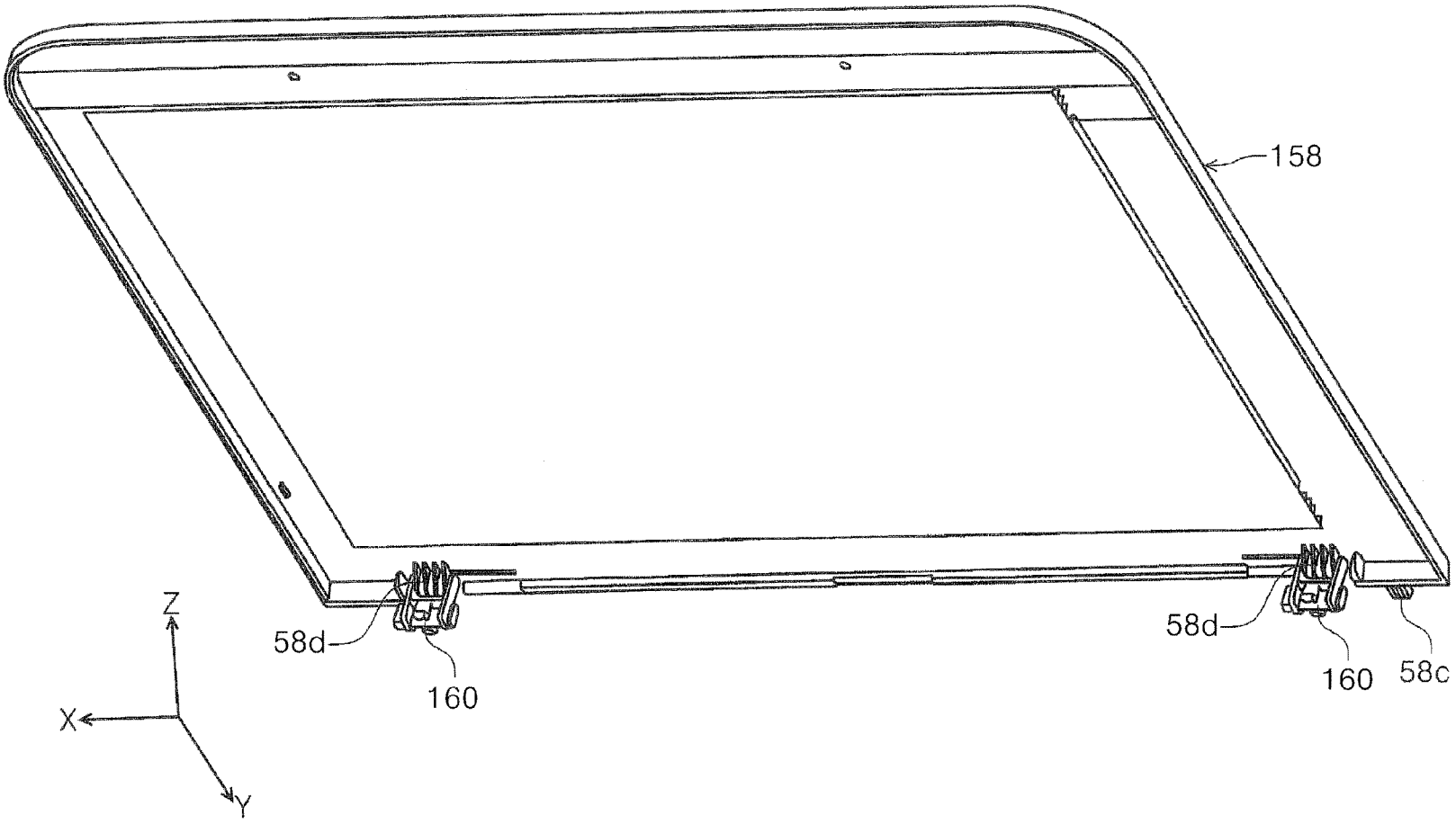
FIG. 21 is a perspective diagram of the document cover.
Figure 22:
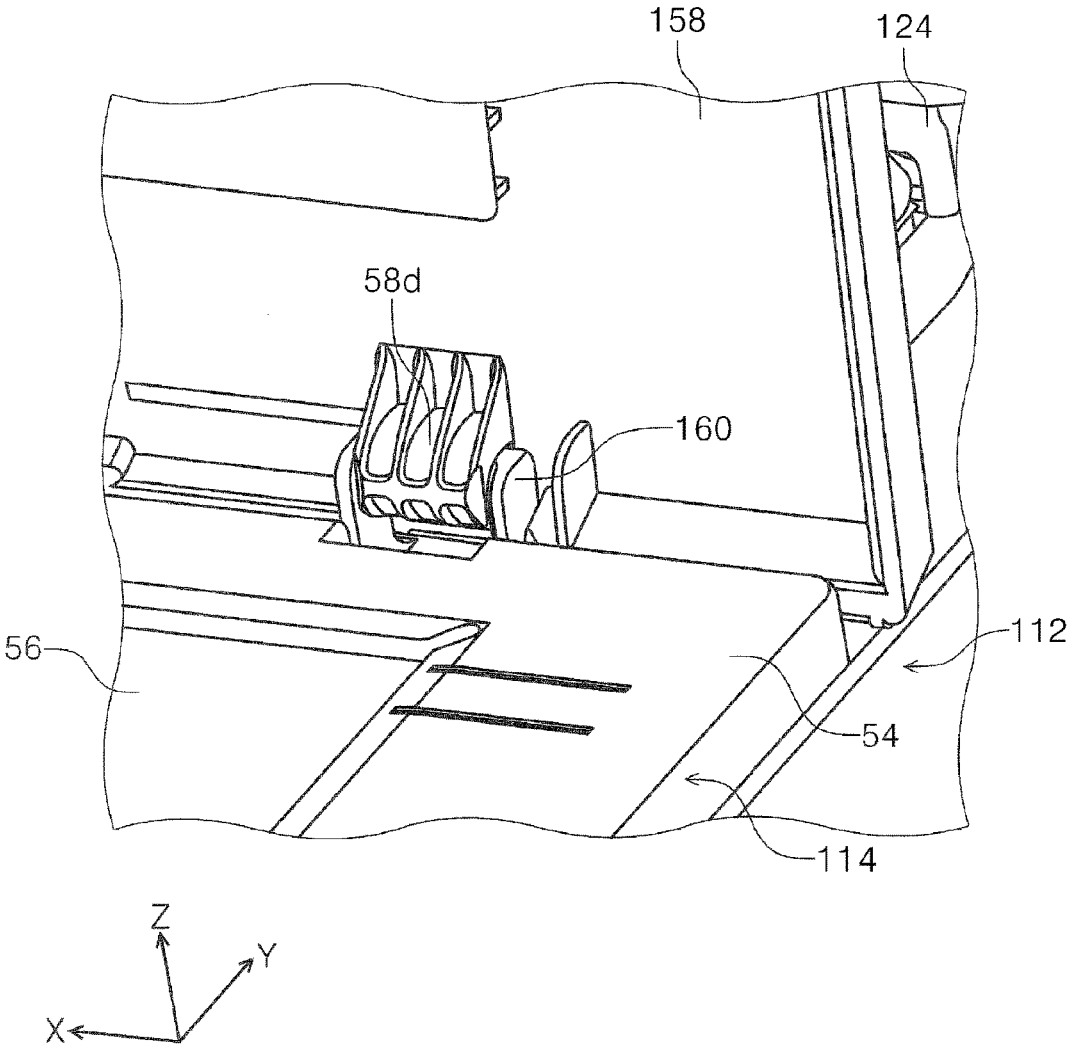
FIG. 22 is a perspective diagram of a hinge member which connects a reading mechanism unit and the document cover.

FIG. 17 is an external perspective diagram of a printer according to an embodiment, FIG. 18 is a perspective diagram of a state in which a paper output tray in the printer according to the embodiment is extended, FIG. 19 is a lateral sectional diagram illustrating a medium transport path in the printer according to the embodiment, FIG. 20 is a perspective diagram illustrating a state in which a document cover in the printer is opened, FIG. 21 is a perspective diagram of the document cover, and FIG. 22 is a perspective diagram of a hinge member which connects a reading mechanism unit and the document cover.

Figure 23:
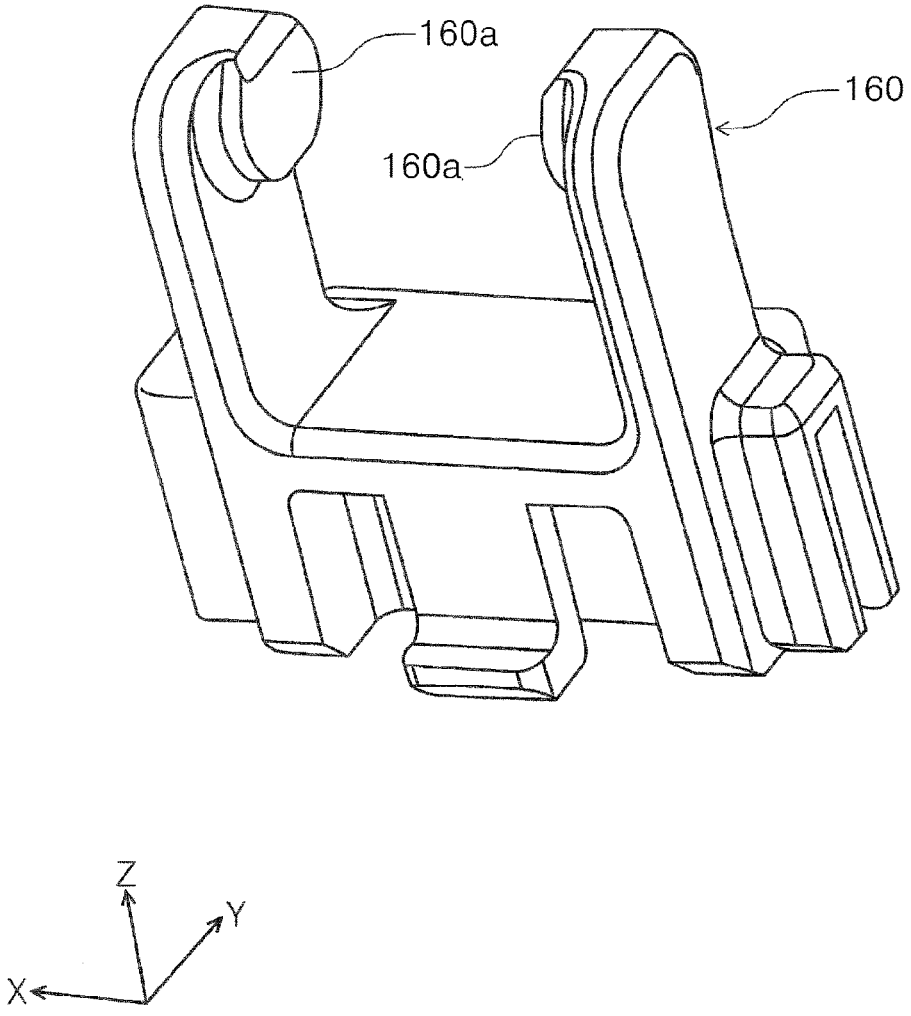
FIG. 23 is a perspective diagram of the hinge member.
Figure 24:
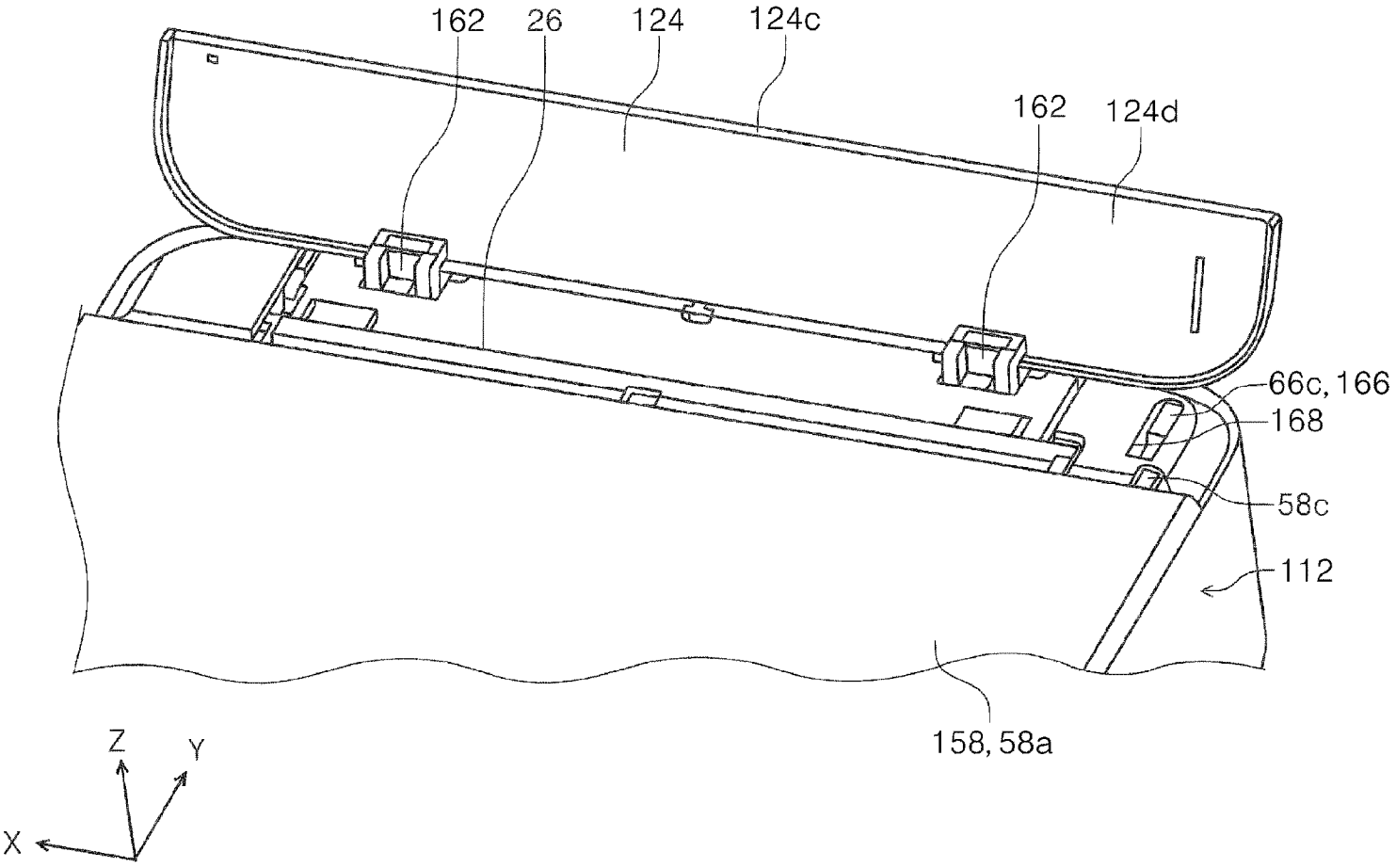
FIG. 24 is a perspective diagram illustrating a state in which a medium supply port cover in the printer is opened.
Figure 25:
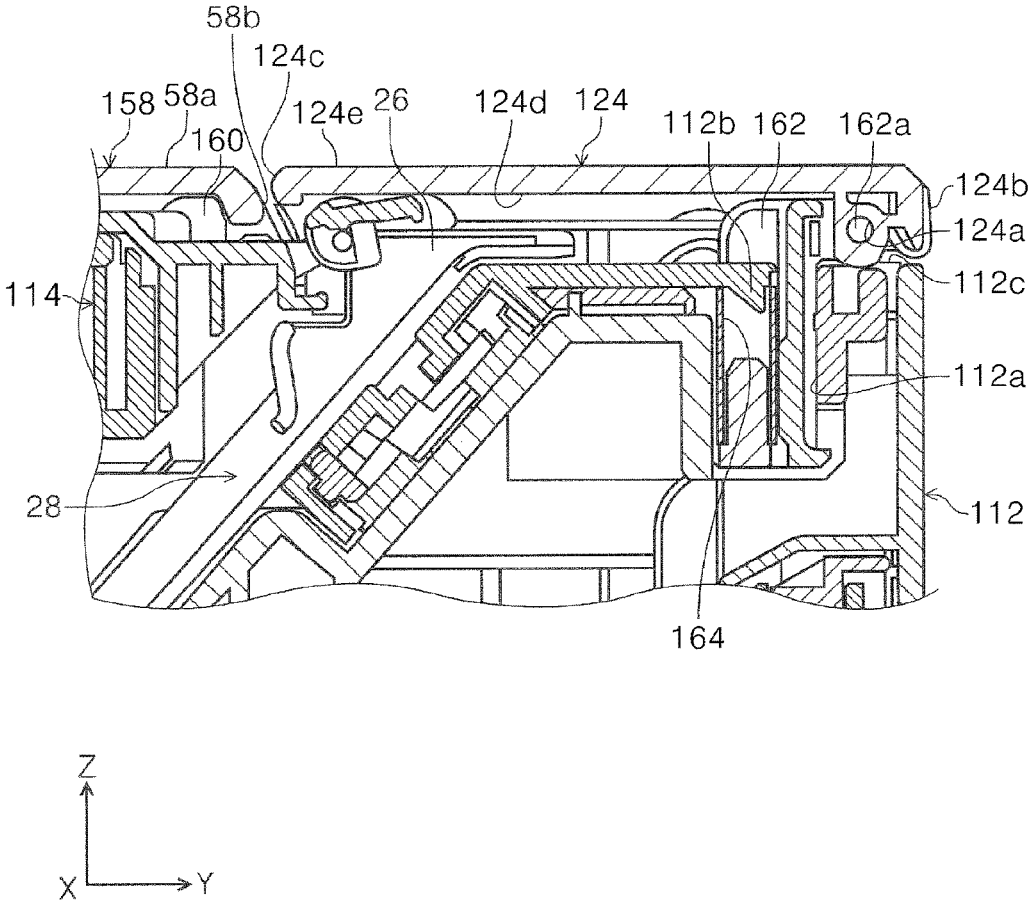
FIG. 25 is a lateral sectional diagram illustrating a state in which the medium supply port in the printer is closed.
Figure 26:
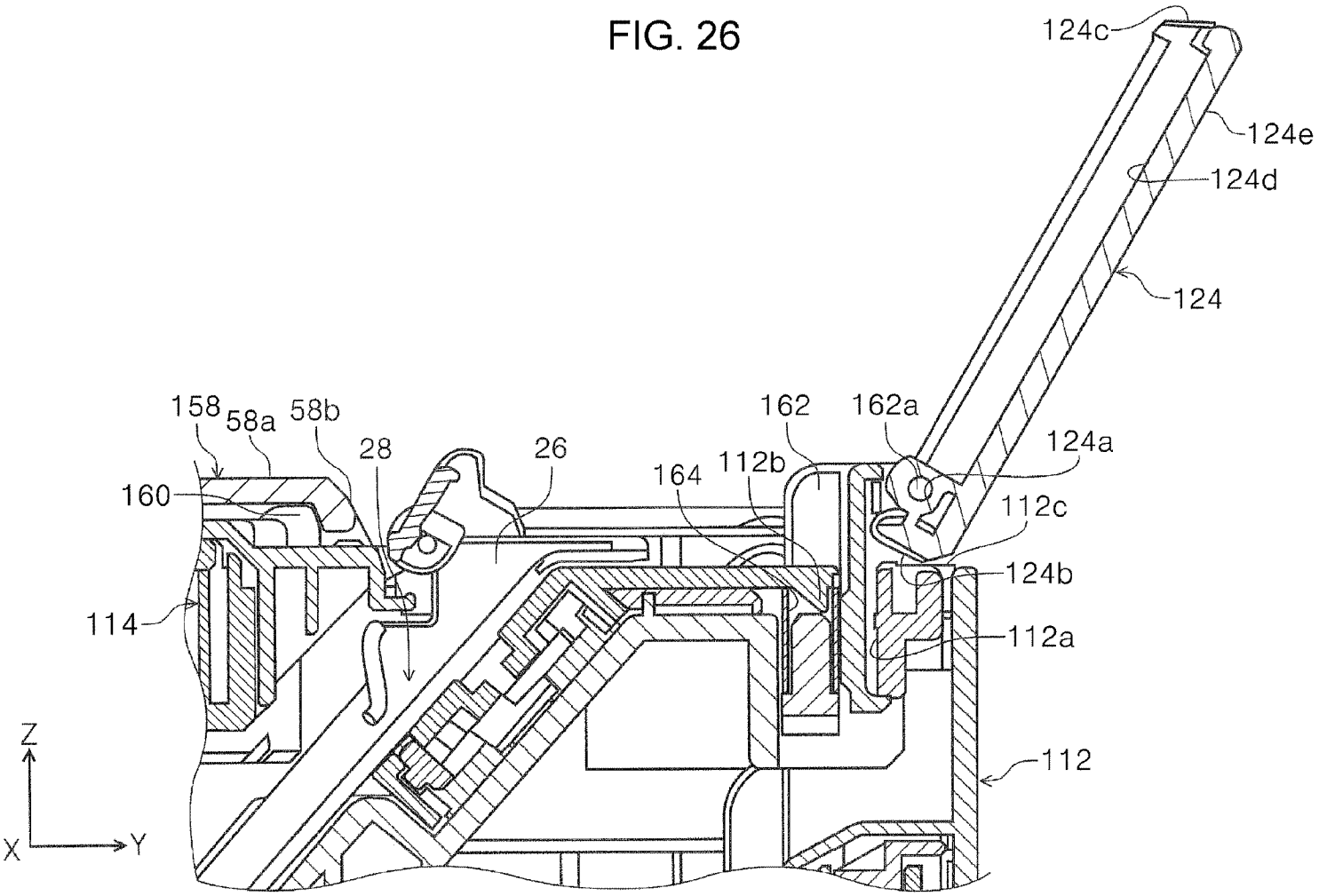
FIG. 26 is a lateral sectional diagram illustrating a state in which the medium supply port in the printer is opened.
Figure 27:
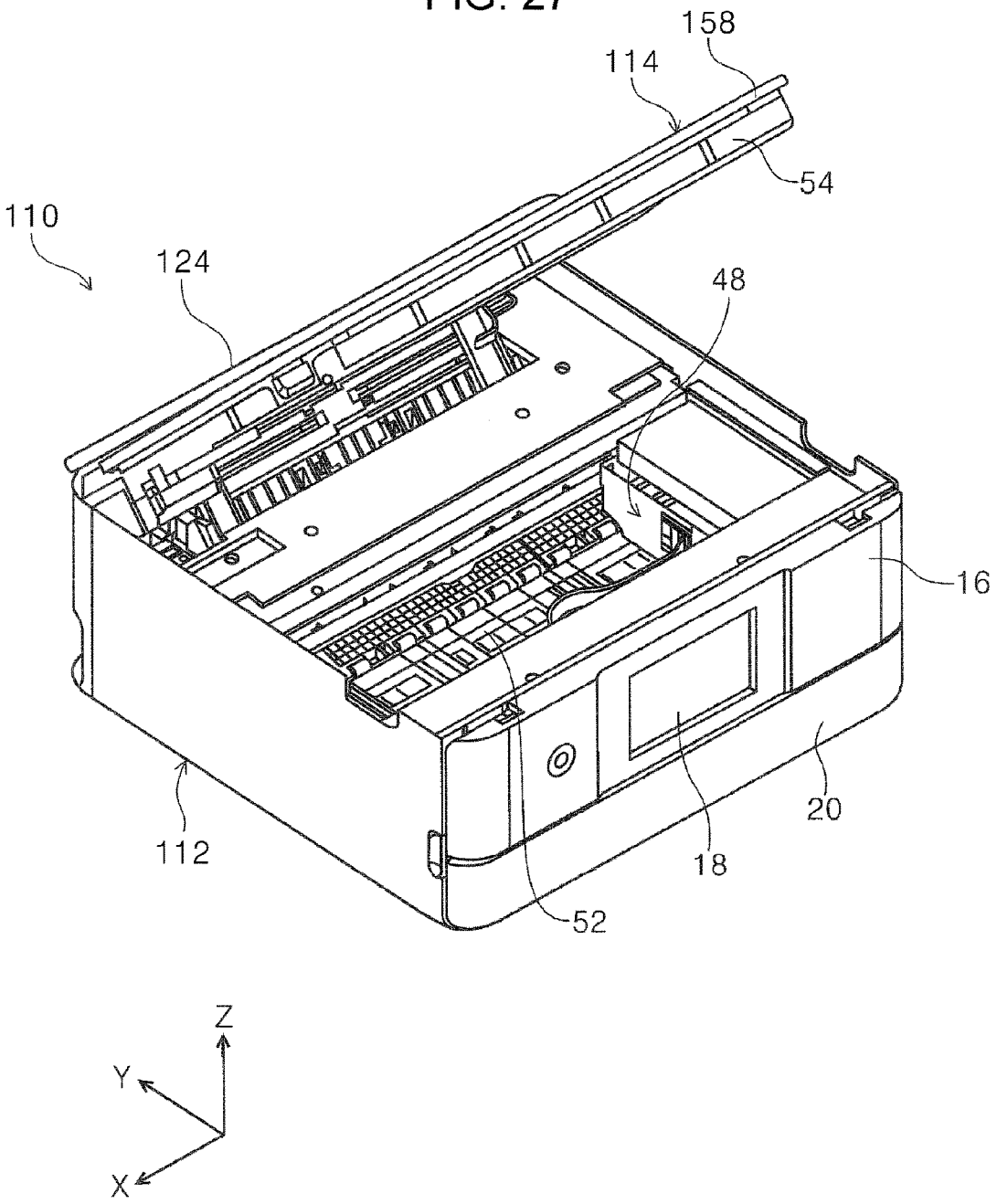
FIG. 27 is an external perspective diagram illustrating a state in which the reading mechanism unit in the printer is opened.
Figure 28:
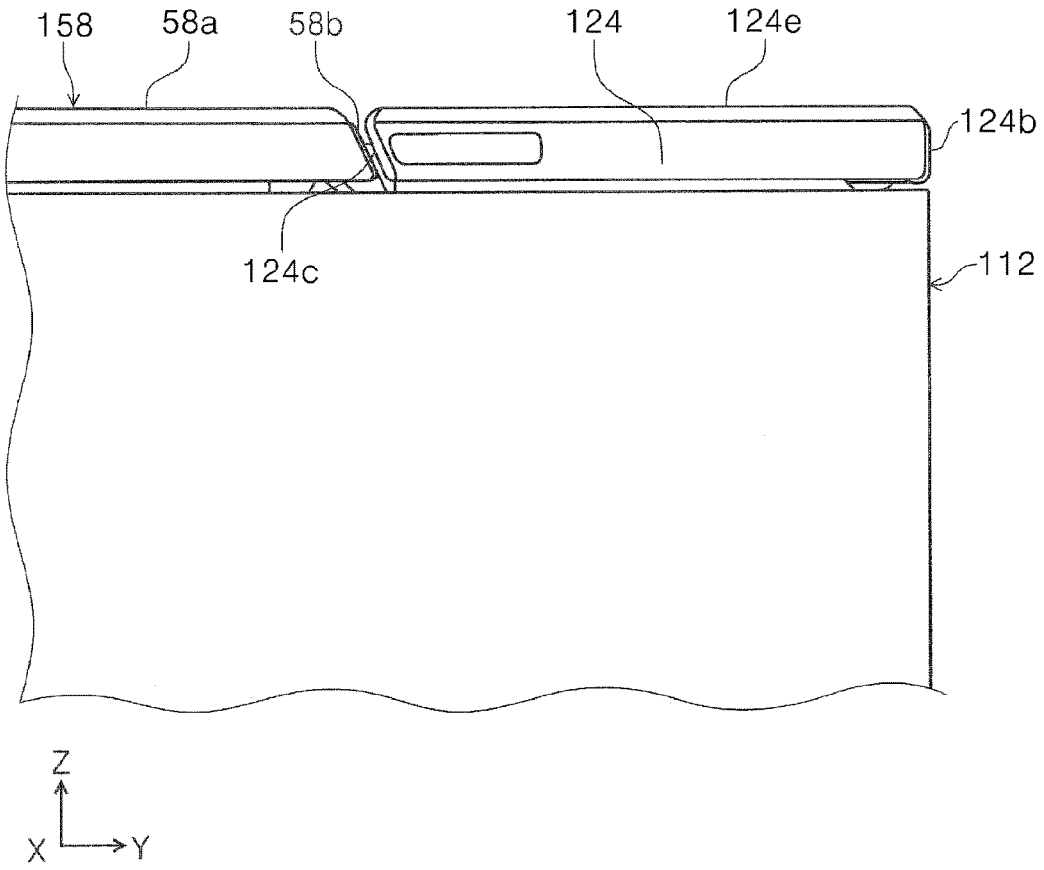
FIG. 28 is a side surface diagram illustrating a relationship between the document cover and the medium supply port cover in a state in which the reading mechanism unit is closed.

FIG. 23 is a perspective diagram of the hinge member, FIG. 24 is a perspective diagram illustrating a state in which a medium supply port cover in the printer is opened, FIG. 25 is a lateral sectional diagram illustrating a state in which the medium supply port in the printer is closed, FIG. 26 is a lateral sectional diagram illustrating a state in which the medium supply port in the printer is opened, FIG. 27 is an external perspective diagram illustrating a state in which the reading mechanism unit in the printer is opened, and FIG. 28 is a side surface diagram illustrating a relationship between the document cover and the medium supply port cover in a state in which the reading mechanism unit is closed.

Figure 29:
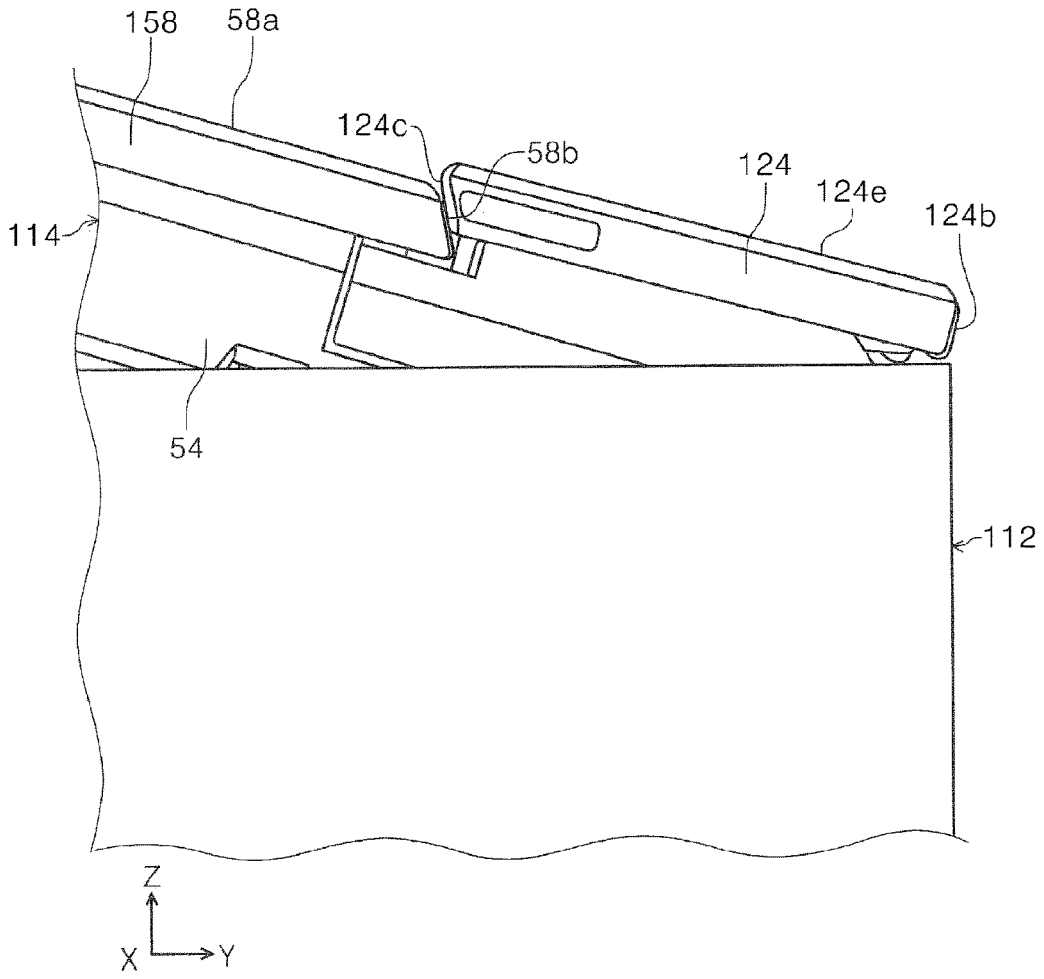
FIG. 29 is a side surface diagram illustrating a relationship between the document cover and the medium supply port cover in a state in which the reading mechanism unit is tilted.
Figure 30:
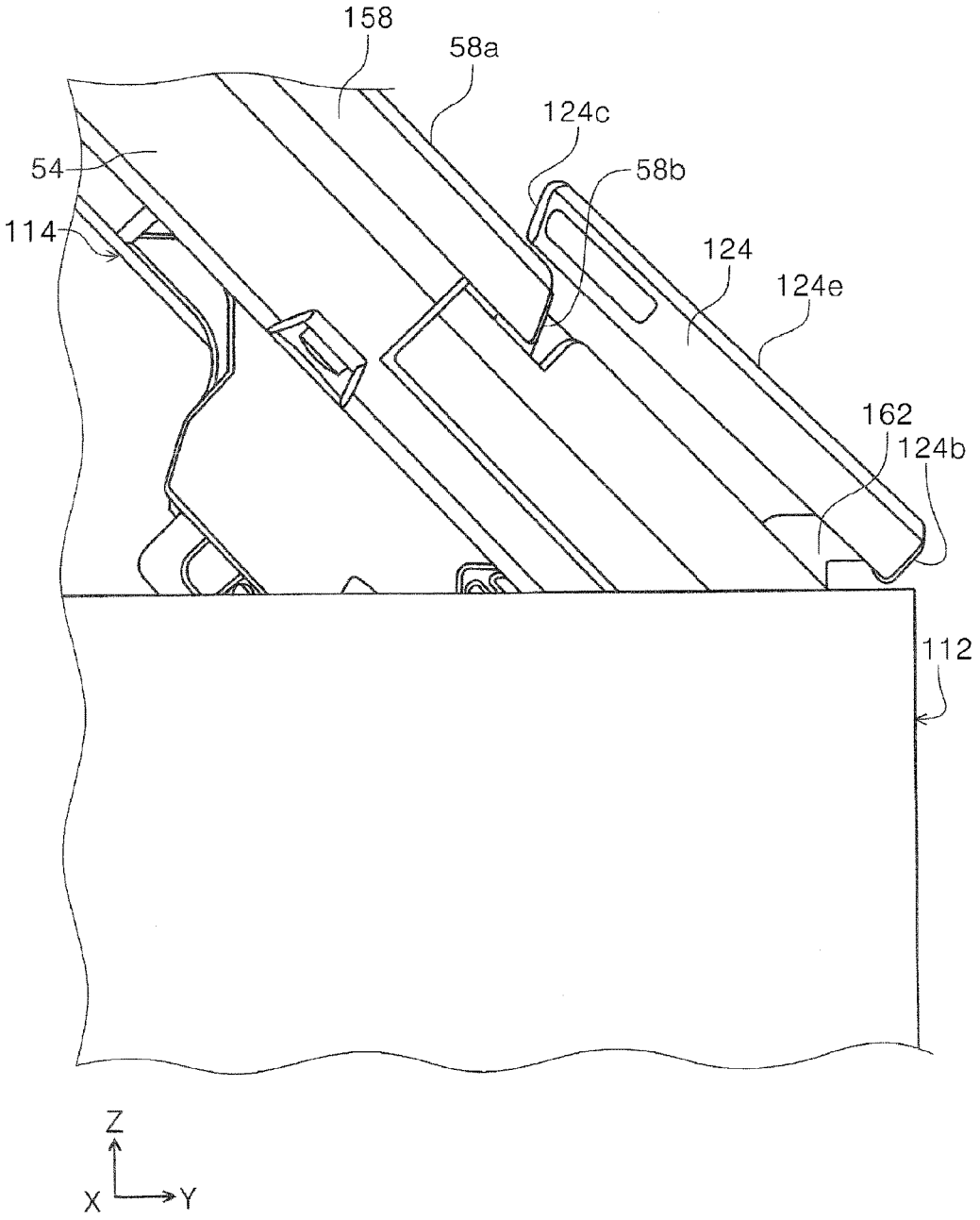
FIG. 30 is a side surface diagram illustrating a relationship between the document cover and the medium supply port cover in a state in which the reading mechanism unit is tilted.
Figure 31:
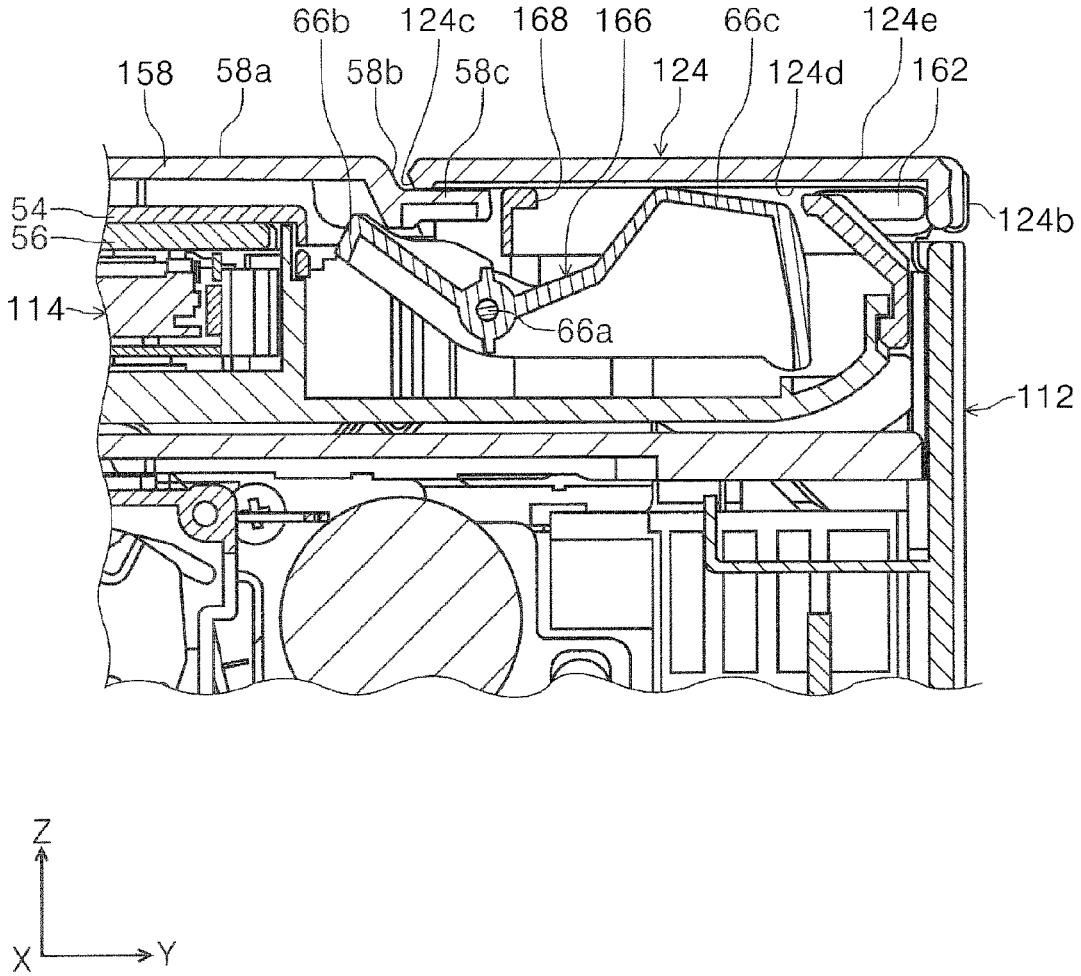
FIG. 31 is a lateral sectional diagram illustrating a state before a rocking member is rocked.
Figure 32:
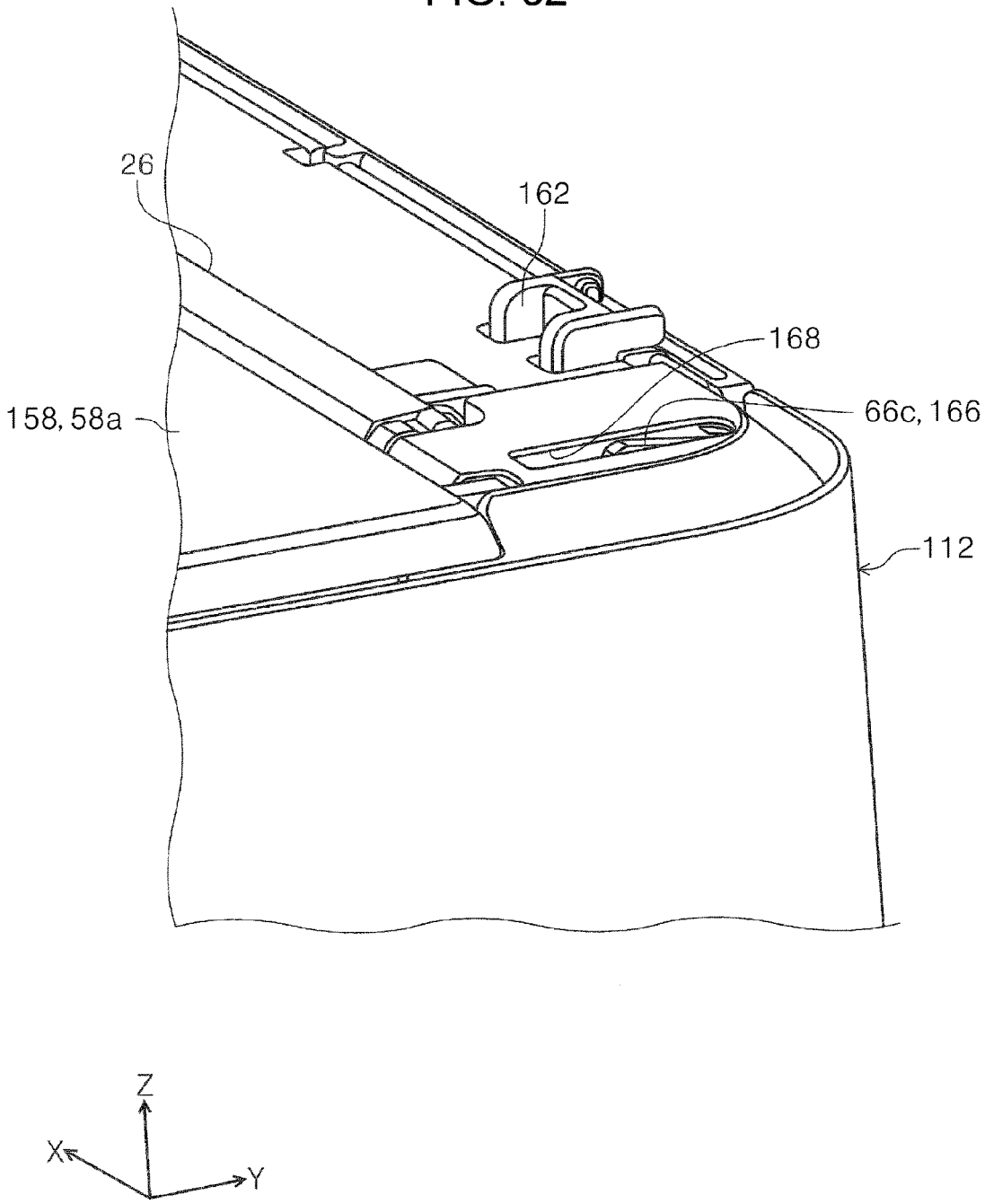
FIG. 32 is a perspective diagram of a top portion of the apparatus main body in a state before the rocking member is rocked.
Figure 33:
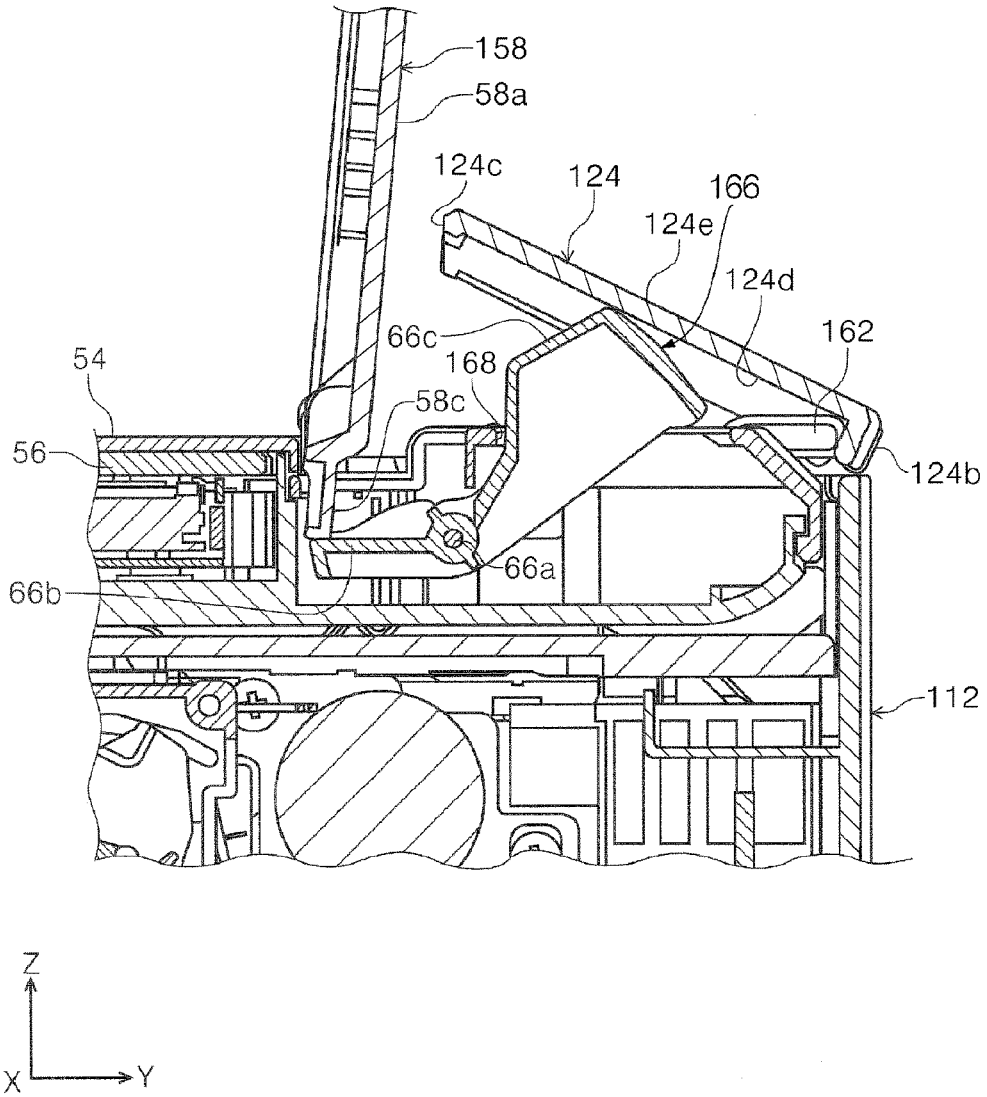
FIG. 33 is a lateral sectional diagram illustrating a state after the rocking member is rocked.
Figure 34:
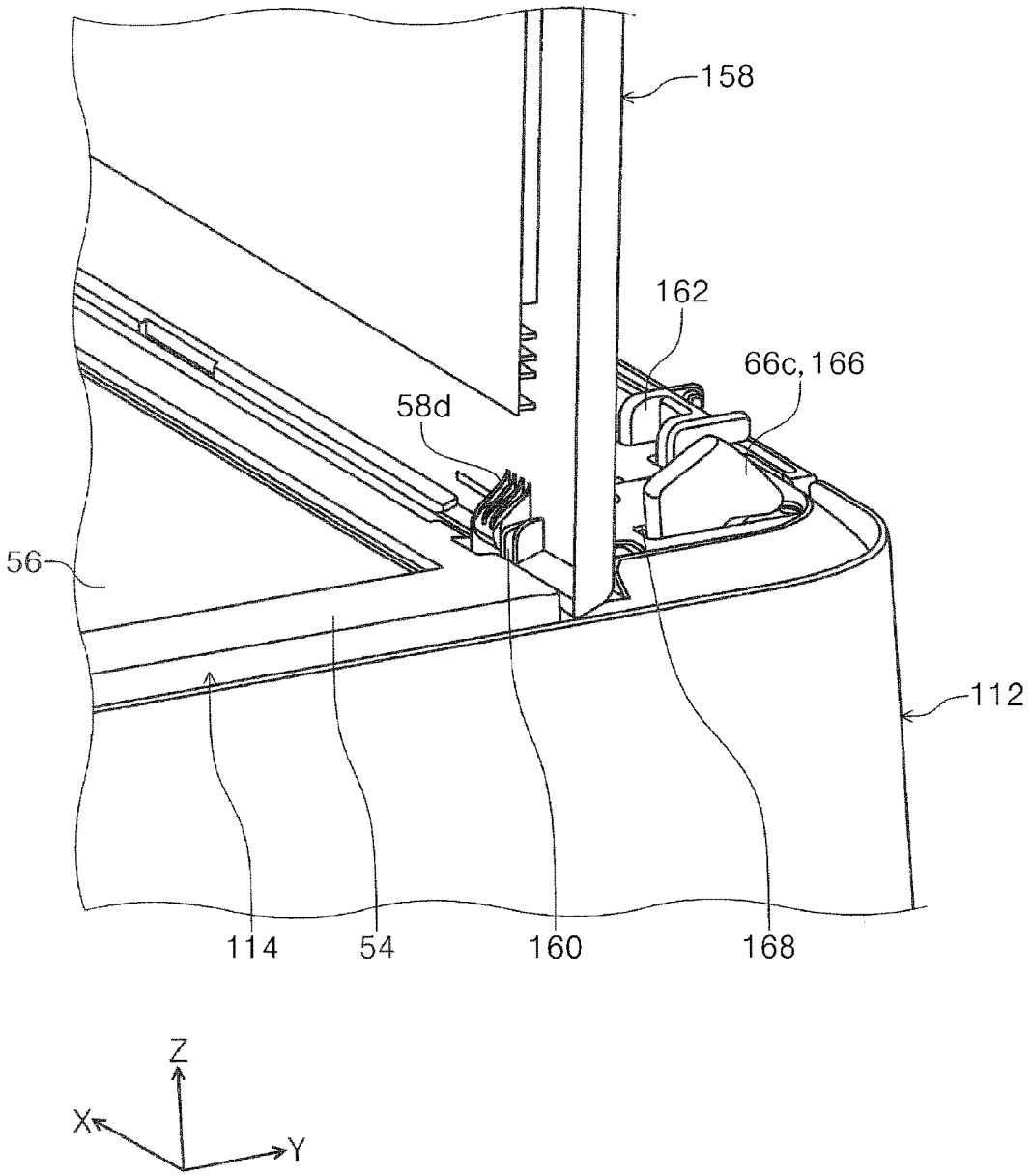
FIG. 34 is a perspective diagram of the top portion of the apparatus main body in a state after the rocking member is rocked.

FIG. 29 is a side surface diagram illustrating a relationship between the document cover and the medium supply port cover in a state in which the reading mechanism unit is tilted, FIG. 30 is a side surface diagram illustrating a relationship between the document cover and the medium supply port cover in a state in which the reading mechanism unit is tilted, FIG. 31 is a lateral sectional diagram illustrating a state before a rocking member is rocked, FIG. 32 is a perspective diagram of a top portion of the apparatus main body in a state before the rocking member is rocked, FIG. 33 is a lateral sectional diagram illustrating a state after the rocking member is rocked, and FIG. 34 is a perspective diagram of the top portion of the apparatus main body in a state after the rocking member is rocked.

Figure 35:
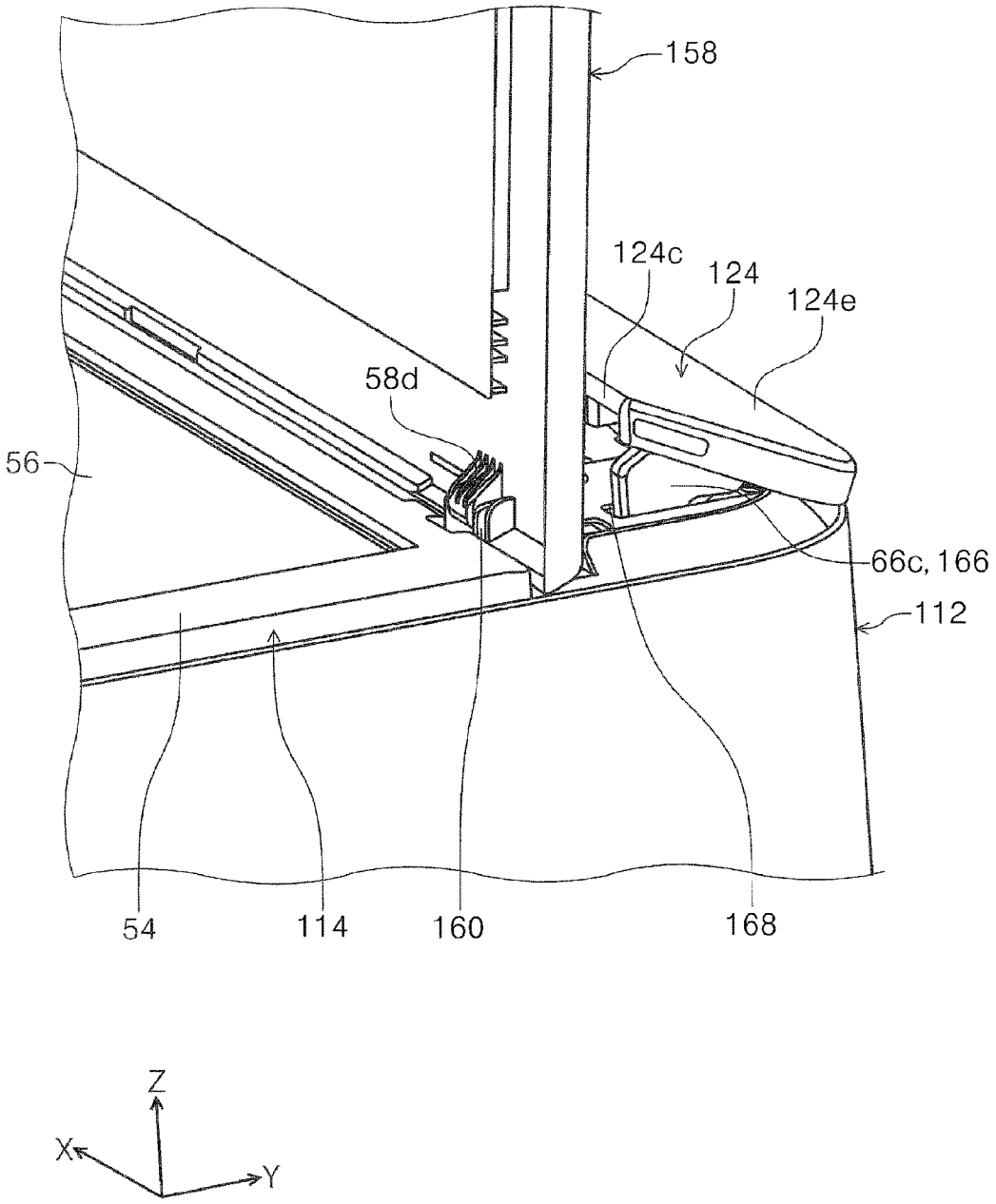
FIG. 35 is a perspective diagram illustrating a state in which the rocking member lifts up the medium supply port cover in a second state.
Figure 36:
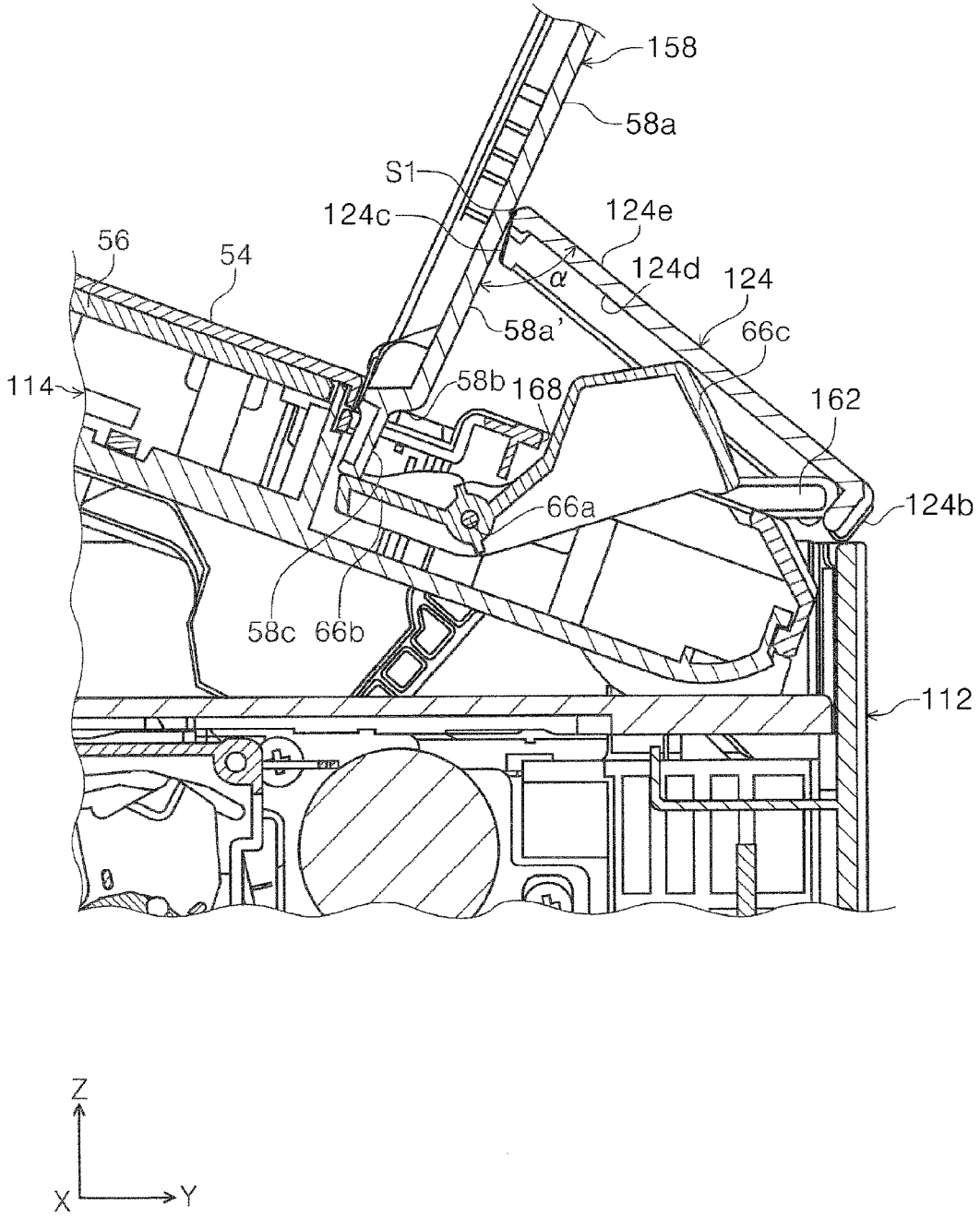
FIG. 36 is a lateral sectional diagram illustrating a state in which the reading mechanism unit is tilted in a state in which the document cover is opened.
Figure 37:
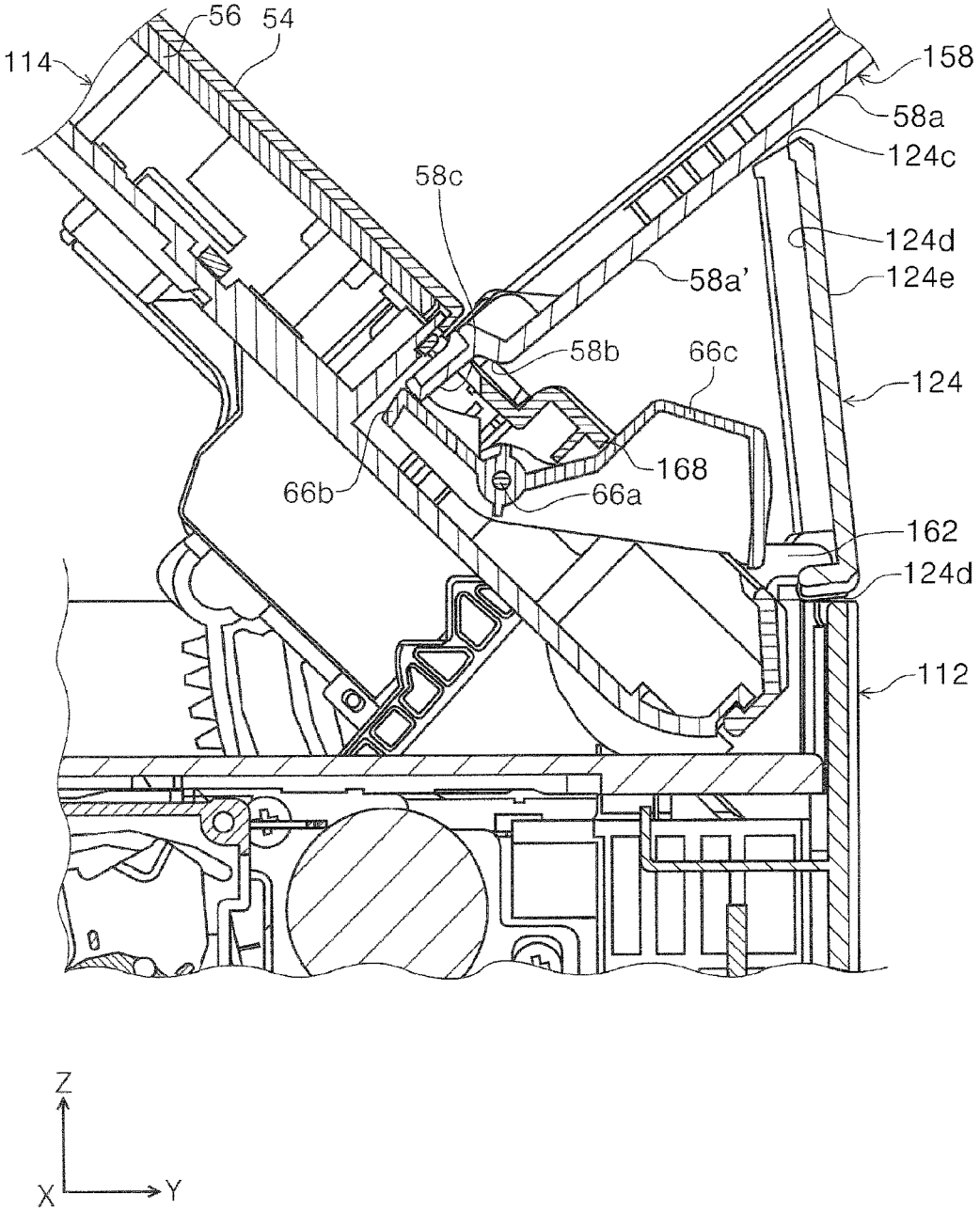
FIG. 37 is a lateral sectional diagram illustrating a state in which the reading mechanism unit is tilted from the state of FIG. 36 further to the apparatus rear surface side.
Figure 38:
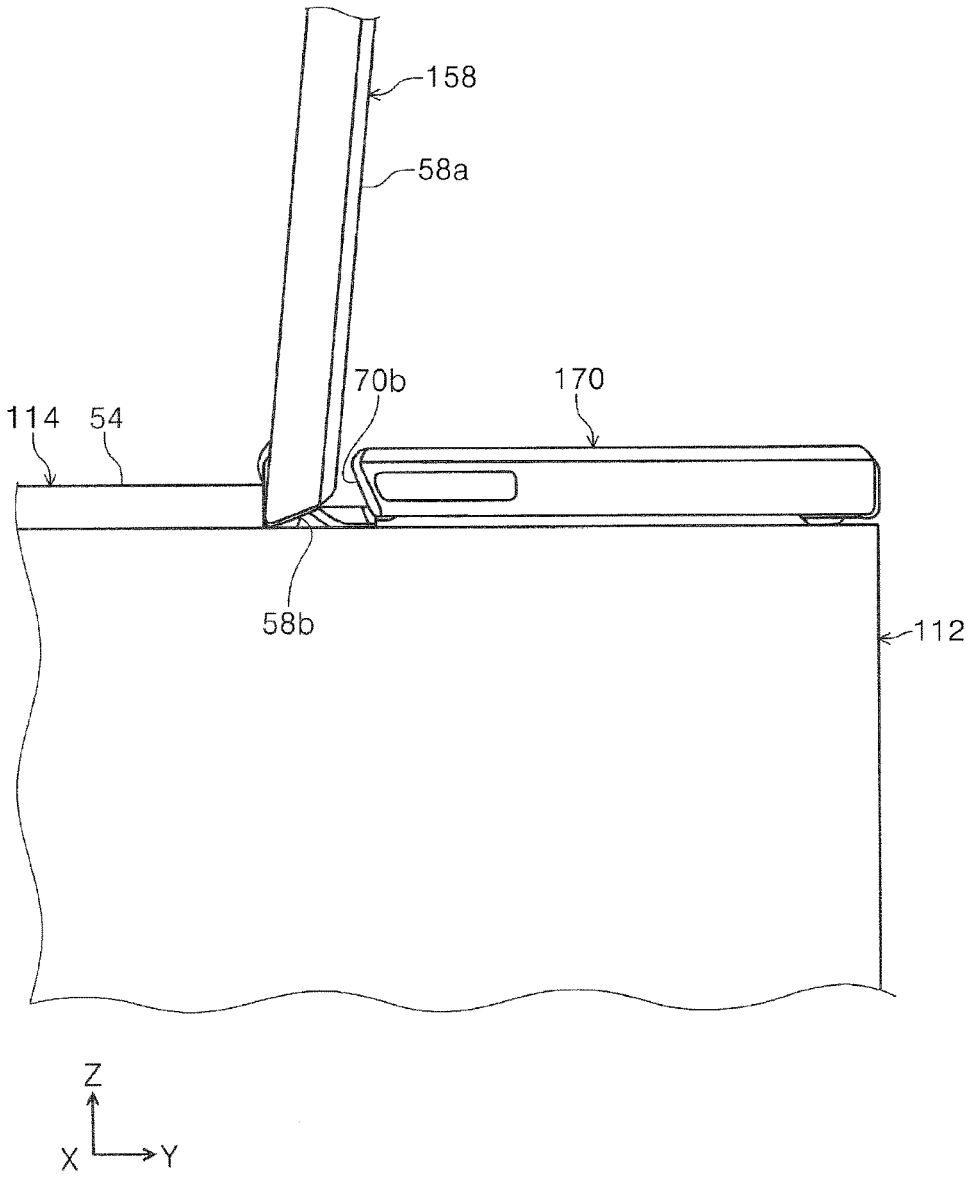
FIG. 38 is a side surface diagram illustrating a relationship between the document cover and the medium supply port cover according to a second example.
Figure 39:
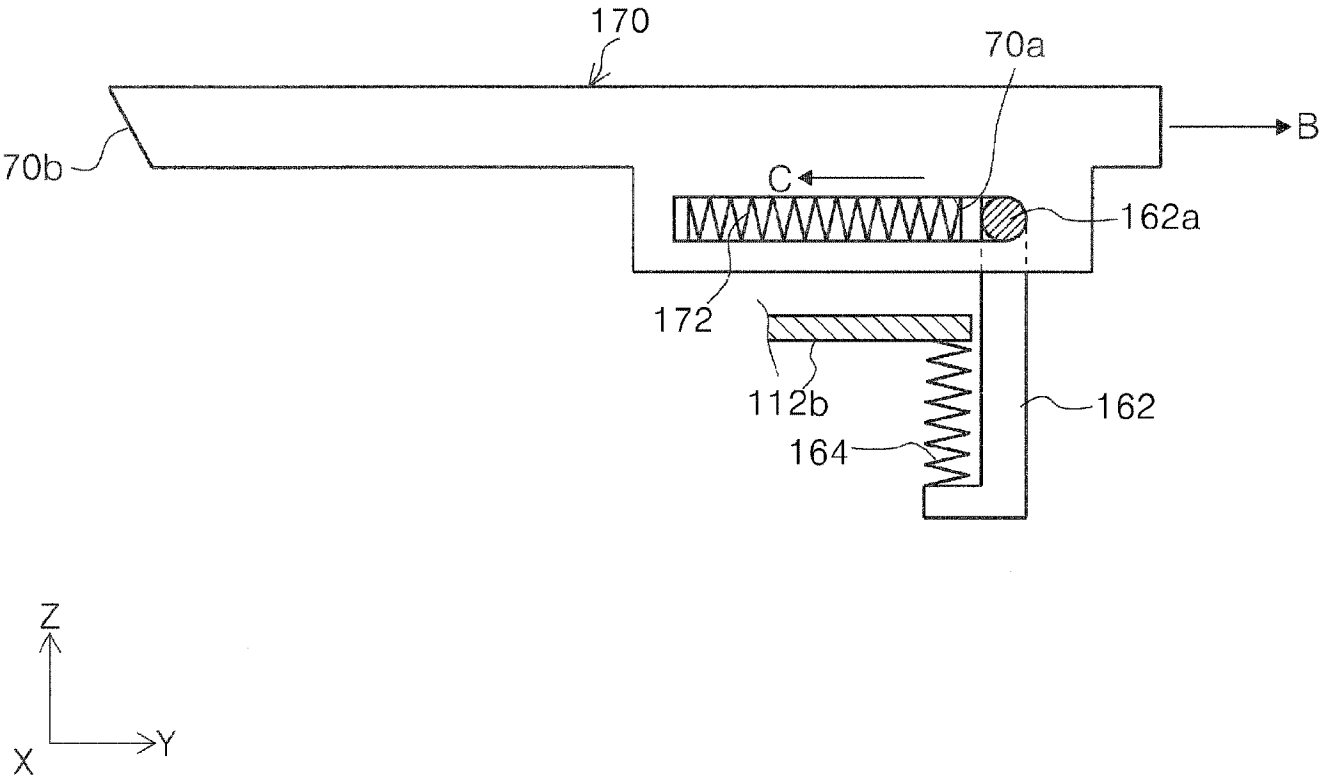
FIG. 39 is a schematic diagram of the configuration of the medium supply port cover in the second example.
Figure 40:
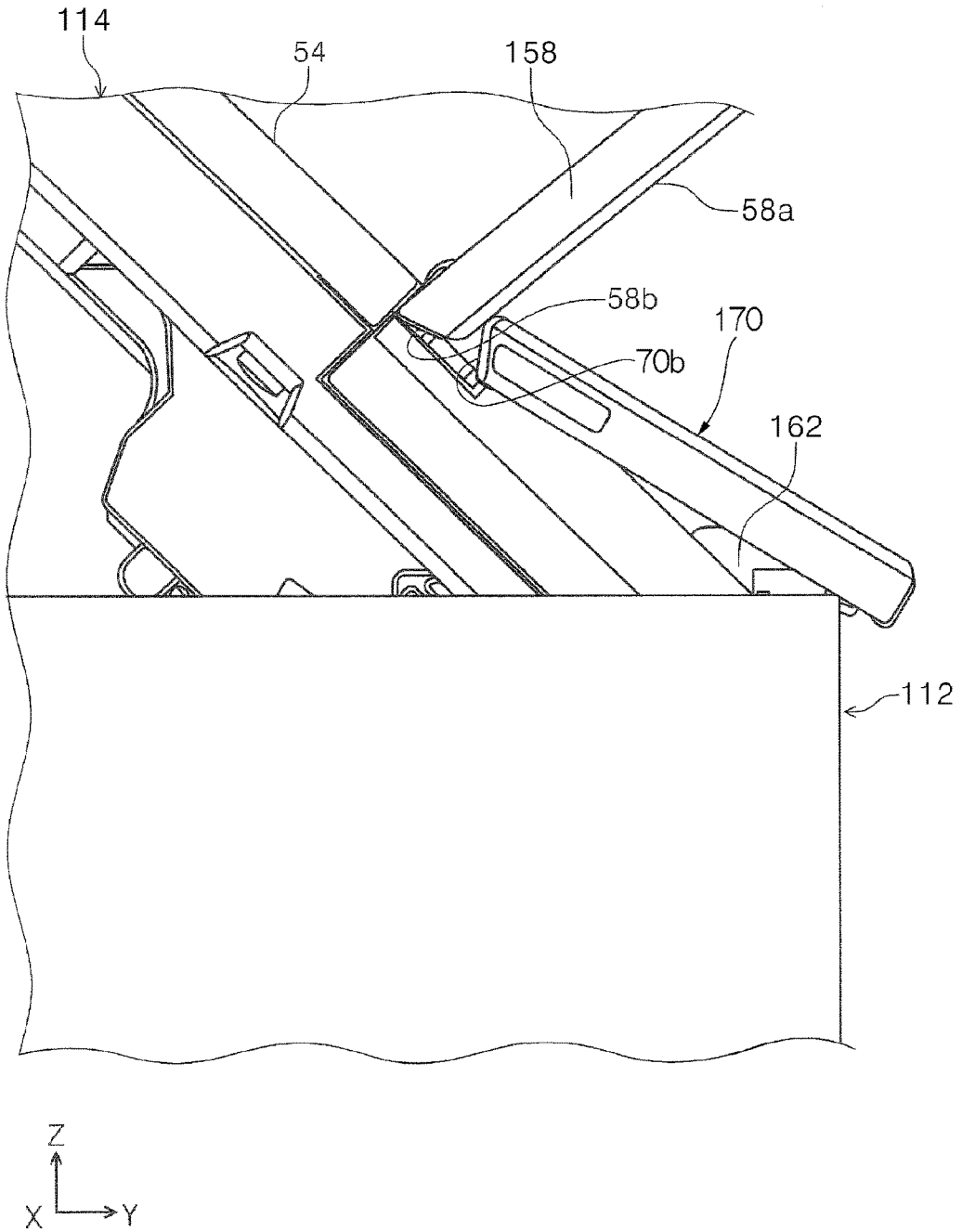
FIG. 40 is a side surface diagram illustrating a relationship between the document cover and the medium supply port cover when the reading mechanism unit is tilted in a state in which the document cover in the second example is opened.

FIG. 35 is a perspective diagram illustrating a state in which the rocking member lifts up the medium supply port cover in a second state, FIG. 36 is a lateral sectional diagram illustrating a state in which the reading mechanism unit is tilted in a state in which the document cover is opened, FIG. 37 is a lateral sectional diagram illustrating a state in which the reading mechanism unit is tilted from the state of FIG. 36 further to the apparatus rear surface side, FIG. 38 is a side surface diagram illustrating a relationship between the document cover and the medium supply port cover according to a second example, FIG. 39 is a schematic diagram of the configuration of the medium supply port cover in the second example, and FIG. 40 is a side surface diagram illustrating a relationship between the document cover and the medium supply port cover when the reading mechanism unit is tilted in a state in which the document cover in the second example is opened.

The X-Y-Z coordinate system which is illustrated in the drawings is the same as in the first embodiment.

First Example

Outline of Printer

With reference to FIG. 17, a printer 110 is provided with an apparatus main body 112, and a reading mechanism unit 114 which is provided on the top portion of the apparatus main body 112. The operation unit 16 is provided on the apparatus front surface side of the apparatus main body 112 to be capable of tilting with respect to the apparatus main body 112. The operation unit 16 is configured to be capable of switching between a posture of being closed with respect to the apparatus main body 112 (refer to FIG. 17), and a posture of being tilted to the apparatus front surface side with respect to the apparatus main body 112 (refer to FIG. 18). The displayer 18 such as a display panel is provided on the operation unit 16.

The front surface cover 20 is disposed on the bottom of the operation unit 16 on the apparatus front surface side of the apparatus main body 112. The paper output tray 22 is provided in the apparatus main body 112. The paper output tray 22 is configured to be capable of switching between a state of being stored inside the apparatus main body 112 (refer to FIG. 17), and a state of being extended to the apparatus front surface side of the apparatus main body 112 (refer to FIG. 18).

A medium supply port cover 124 is attached to the top portion of the rear surface side of the apparatus main body 112 to be capable of tilting. The medium supply port cover 124 is configured to be capable of switching between a state of being closed with respect to the apparatus main body 112 which is illustrated in FIG. 17, and a state of being opened with respect to the apparatus main body 112 which is illustrated in FIG. 18. When the medium supply port cover 124 is closed, the medium supply port cover 124 configures a portion of the top surface of the apparatus main body 112, specifically, the top surface of the rear surface side in the apparatus depth direction.

When the medium supply port cover 124 is opened, the medium supply port 26 into which the recording medium (the medium) is to be set is exposed on the rear surface side of the top portion of the apparatus main body 112. It is possible to insert the recording medium into the medium supply port 26 in the direction of arrow A, and the medium which is inserted is guided down the inclined medium guide path 28 which is illustrated in FIG. 19, and is fed to the downstream side in the transport direction.

Regarding Medium Transport Path

The medium transport path 30 and the guide path of the medium to which the reference symbol R is attached of the present embodiment which are illustrated in FIG. 19 are the same as in the first embodiment. The configuration of the bottom portion and the inner portion of the apparatus main body 112 are the same as those of the apparatus main body 12 of the first embodiment.

Even in the present embodiment, the medium supply port cover 124 is opened, and the recording medium which is inserted into the medium supply port 26 from above the printer 110 is guided to the medium guide path 28, is transported to the recording unit 42, and recording is performed in the recording unit 42. After the recording is performed, the recording medium is output to the paper output tray 22.

Regarding Reading Mechanism Unit

Next, with reference to FIGS. 19 to 23, description will be given of the reading mechanism unit 114. As illustrated in FIGS. 19 and 20, the reading mechanism unit 114 is provided on the top portion of the apparatus main body 112. The reading mechanism unit 114 is configured as a scanner. The reading mechanism unit 114 is provided with the main body portion 54 (also refer to FIG. 27), the document stand 56 (refer to FIG. 20) which is provided on the top portion of the main body portion 54, and a document cover 158. The document stand 56 is formed of a transparent glass plate, for example, and is configured such that it is possible to place a document on the top surface of the document stand 56.

As illustrated in FIGS. 21 and 22, the document cover 158 is formed as a plate-shaped member. Bearings 58*d* are formed on the end portion of the rear surface side of the document cover 158 in the apparatus depth direction. A hinge 160 is illustrated in FIG. 23. The hinge 160 is provided with a pair of tilting shafts 160*a* which face each other. The tilting shafts 160*a* are received by the bearings 58*d* of the document cover 158. In other words, the document cover 158 is capable of tilting with respect to the hinge 160 using the tilting shaft 160*a* as a fulcrum.

As illustrated in FIG. 22, the hinge 160 is inserted downward from above the main body portion 54 of the reading mechanism unit 114. The hinge 160 is connected to the main body portion 54 by snap fitting, for example. In other words, the document cover 158 is connected to be capable of tilting due to the hinge 160 with respect to the main body portion 54.

When an external force greater than or equal to a predetermined amount is applied to the document cover 158, for example, when an attempt is made to open the document cover 158 in a state in which the medium supply port cover 124 is retained so as not to tilt, the engagement state between the hinge 160 and the main body portion 54, that is, the snap fitting is released, the hinge 160 escapes upward, and damage to the document cover 158 is suppressed or avoided. Description of the specifics of the attachment mechanism of the hinge 160 with respect to the main body portion 54 will be omitted.

The document cover 158 opens and closes the document stand 56 by tilting to the rear surface side and the front surface side in the apparatus depth direction. In other words, the document cover 158 has the same opening direction as the medium supply port cover 124. The document cover 158 covers the document stand 56 in the closed state (refer to FIGS. 17 and 18), and exposes the document stand 56 in the opened state (refer to FIG. 20). The document cover 158 configures the top surface of the front surface side of in the apparatus depth direction in the printer 110 in a state in which the document cover 158 is closed, for example. As illustrated in FIG. 17, in the present example, a top surface 124*e* of the medium supply port cover 124 in the closed state and a top surface 58*a* of the document cover 158 in the closed state are configured to form the same surface. Accordingly, it is possible to realize a favorable external appearance in the printer 110.

By opening the document cover 158 to expose the document stand 56, setting the document on the top surface of the document stand 56, and closing the document cover 158, it becomes possible to read the document on the document stand 56. A reader (not illustrated) which is capable of reading the document which is set on the document stand 56 is provided under the document stand 56, that is, inside the main body portion 54.

In the present example, a tilting shaft (not illustrated) is provided in the reading mechanism unit 114 near to the rear surface side of the main body portion 54 in the apparatus depth direction. The reading mechanism unit 114 is joined to the apparatus main body 112 to be capable of tilting via the tilting shaft. The reading mechanism unit 114 is configured to be capable of switching between a posture of being closed with respect to the apparatus main body 112 (refer to FIGS. 17 and 18), and a posture of being tilted and opened with respect to the apparatus main body 112 (refer to FIG. 27).

Regarding Medium Supply Port Cover

Next, description will be given of the medium supply port cover 124 with reference to FIGS. 24 to 26. As illustrated in FIG. 24, the medium supply port cover 124 is attached to the top portion of the rear surface side end portion of the apparatus main body 112 to be capable of tilting with respect to the apparatus main body 112. More specifically, the medium supply port cover 124 and the apparatus main body 112 are linked via a hinge 162. For example, as illustrated in FIGS. 25 and 26, a bearing 124*a* is provided on the medium supply port cover 124, and a tilting shaft 162*a* is provided on the hinge 162. The tilting shaft 162*a* is engaged with the bearing 124*a*.

With reference to FIGS. 25 and 26, the hinge 162 is attached to a hinge attachment portion 112*a* which is provided on the rear surface side end portion of the apparatus main body 112. The hinge 162 is configured to be capable of moving up and down in the apparatus height direction with respect to the hinge attachment portion 112*a*. A biasing unit 164 is provided between the hinge 162 and the apparatus main body 112. The biasing unit 164 is configured as a compressed coil spring, for example. One end of the biasing unit 164 engages with the hinge 162, and the other end engages with a biasing unit attachment portion 112*b* which is provided on the apparatus main body 112. The biasing unit 164 biases the hinge 162 toward the bottom side in the apparatus height direction.

Here, as illustrated in FIG. 25, in a state in which the medium supply port cover 124 is closed, the hinge 162 assumes a state of being pulled into the hinge attachment portion 112*a* which is inside the apparatus main body 112. When the medium supply port cover 124 is opened as illustrated in FIG. 26, the end portion 124*b* of the apparatus depth direction side of the medium supply port cover 124 comes into contact with a top portion 112*c* of the side end portion of the apparatus main body 112 in the apparatus depth direction. When the medium supply port cover 124 is further opened to the rear surface side in the apparatus depth direction, the hinge 162 is lifted up in the apparatus height direction using the contact point between an end portion 124*b* and the top portion 112*c* as a fulcrum.

In this state, the hinge 162 is biased to the bottom side in the apparatus height direction by the biasing force of the biasing unit 164. Accordingly, the end portion 124*b* of the medium supply port cover 124 presses the top portion 112*c* of the apparatus main body 112. As a result, the medium supply port cover 124 maintains a state of being opened with respect to the apparatus main body 112. It is also possible to displace the medium supply port cover 124 to the top side in the apparatus height direction against the biasing force of the biasing unit 164 while maintaining a posture of being closed with respect to the apparatus main body 112.

Regarding Relationship Between Medium Supply Port Cover and Document Stand Cover Next, with reference to FIGS. 27 to 30, description will be given of the relationship between the medium supply port cover 124 and the document cover 158 when the reading mechanism unit 114 is opened in a state in which the medium supply port cover 124 and the document cover 158 are closed. As illustrated in FIG. 27, the reading mechanism unit 114 is configured to be capable of tilting with respect to the apparatus main body 112.

Here, FIG. 28 illustrates a state in which the reading mechanism unit 114 is closed. A first inclined surface 124*c* is formed on the end portion of the front surface side of the medium supply port cover 124 in the apparatus depth direction. The first inclined surface 124*c* is configured to head from the front surface side toward the rear surface side in the apparatus depth direction, and to be inclined from the top side toward the bottom side in the apparatus height direction.

A second inclined surface 58*b* is formed on the rear surface side end portion of the document cover 158 in the apparatus depth direction. The second inclined surface 58*b* is configured to head from the front surface side toward the rear surface side in the apparatus depth direction, and to be inclined from the top side toward the bottom side in the apparatus height direction. The first inclined surface 124*c* and the second inclined surface 58*b* face each other. For example, the first inclined surface 124*c* and the second inclined surface 58*b* are formed in parallel. As illustrated in FIG. 28, in a state in which the reading mechanism unit 114 is closed, the first inclined surface 124*c* and the second inclined surface 58*b* are separated leaving a minute gap therebetween.

As is clear from FIG. 28, when viewing the document cover 158 and the medium supply port cover 124 in plan view (when viewing the printer 110 from the top side), at least a portion of the second inclined surface 58*b* appears to overlap the first inclined surface 124*c* in the apparatus height direction. Therefore, when viewing the printer 110 from above, since the inside of the medium supply port cover 124 and the document cover 158, that is, the top portion of the apparatus main body 112 is not exposed, it is possible to realize a favorable external appearance of the printer 110.

As illustrated in FIG. 29, when the reading mechanism unit 114 is opened in a state in which the medium supply port cover 124 and the document cover 158 are closed, the first inclined surface 124*c* and the second inclined surface 58*b* come into contact with each other. The second inclined surface 58*b* pushes up the first inclined surface 124*c* to the top side in the apparatus height direction in accordance with the tilting of the reading mechanism unit 114.

Here, the medium supply port cover 124 is configured to be capable of being displaced in the apparatus height direction against the biasing force of the biasing unit 164. As illustrated in FIG. 30, when the reading mechanism unit 114 is further tilted to the rear surface side in the apparatus depth direction, the second inclined surface 58*b* pushes up the first inclined surface 124*c* in a direction in which the medium supply port cover 124 opens. When the reading mechanism unit 114 opens by greater than or equal to a predetermined angle with respect to the apparatus main body 112, the first inclined surface 124*c* of the medium supply port cover 124 rides on the top surface 58*a* of the document cover 158.

In other words, when the reading mechanism unit 114 is opened in a state in which the medium supply port cover 124 and the document cover 158 are closed, since the medium supply port cover 124 is configured to escape with respect the document cover 158, it is possible to reduce the concern of damage to the cover of at least one of the document cover 158 and the medium supply port cover 124 due to interference.

Regarding Rocking Member

Next, description will be given of a rocking member 166 with reference to FIGS. 31 to 37. As illustrated in FIG. 31, the rocking member 166 is provided on the rear surface side end portion of the apparatus main body 112. The rocking member 166 is positioned under the medium supply port cover 124 and the document cover 158 on the rear surface side end portion of the apparatus main body 112. The rocking member 166 is provided to be capable of rocking inside the apparatus main body 112 using a rocking shaft 66*a* as a rocking center. The rocking member 166 is provided with an engaged portion 66*b* which is provided on the front surface side in the apparatus depth direction with respect to the rocking shaft 66*a*, and an engagement portion 66*c* which is provided on the rear surface side in the apparatus depth direction with respect to the rocking shaft 66*a*.

As illustrated in FIG. 32, a slit 168 is provided in the top portion of the rear surface side end portion of the apparatus main body 112 in the apparatus depth direction. The slit 168 is formed on the right side end portion in the apparatus width direction on the rear surface side end portion in the apparatus depth direction, for example. The slit 168 is set to a size at which the engagement portion 66*c* of the rocking member 166 is capable of protruding. In FIG. 32, depiction of the medium supply port cover 124 is omitted.

As illustrated in FIGS. 31 and 32, in a state in which the document cover 158 is closed, an engagement portion 58*c* which is provided on the rear surface side end portion of the document cover 158 in the apparatus depth direction that is the base end side and the engaged portion 66*b* of the rocking member 166 are in a state of being separated from the document cover 158. In this state, since the rocking member 166 is in a non-rocked state, the engagement portion 66*c* does not protrude from the slit 168. Therefore, since the engagement portion 66*c* is not in contact with the medium supply port cover 124, the medium supply port cover 124 is in a state of being closed with respect to the apparatus main body 112.

With reference to FIG. 33, when the document cover 158 is opened, the engagement portion 58*c* of the document cover 158 tilts in a clockwise direction in FIG. 33 using the tilting shafts 160*a* of the hinge 160 (not illustrated) as a tilting center. The engagement portion 58*c* comes into contact with the engaged portion 66*b* of the rocking member 166 and presses the engaged portion 66*b*. As a result, the rocking member 166 rocks in a counterclockwise direction in FIG. 33 using the rocking shaft 66*a* as the rocking center. As a result, the engagement portion 66*c* of the rocking member 166 protrudes from the slit 168 to the top side in the apparatus height direction (refer to FIG. 34).

When the engagement portion 66*c* protrudes from the slit 168, the engagement portion 66*c* engages with a bottom surface 124*d* of the medium supply port cover 124, and as illustrated in FIG. 35, pushes up the medium supply port cover 124 in the opening direction.

With reference to FIG. 36, when the reading mechanism unit 114 is further opened, the top surface 58*a* of the document cover 158 and the front surface side end portion of the medium supply port cover 124 in the apparatus depth direction come into contact with each other.

Here, an angle α in FIG. 36 is the angle from a contact position S1 between the document cover 158 and the medium supply port cover 124, formed between a top surface 58*a*' (a top surface of the document cover 158 which is positioned on the bottom side to the bottom side from the contact position S1 in FIG. 36) of a tilting shaft side of the document cover 158 and the top surface 124*e* of the medium supply port cover 124. The angle α is set to an acute angle, for example. Therefore, as illustrated in FIG. 37, when the reading mechanism unit 114 is further opened in a state in which the document cover 158 is opened, since the angle α is set to an acute angle, the document cover 158 pushes the medium supply port cover 124 in an opening direction. In other words, the document cover 158 applies an external force to the medium supply port cover 124 in the opening direction.

The magnitude of the repulsive force which the document cover 158 receives from the medium supply port cover 124 is set, for example, so as not to exceed a magnitude which is necessary in order to close the document cover 158 from the opened state. Accordingly, when the reading mechanism unit 114 is opened in a state in which the document cover 158 is opened, the medium supply port cover 124 suppresses unintentional closing, and it is possible to smoothly open the medium supply port cover 124.

When the reading mechanism unit 114 is opened in a state in which the medium supply port cover 124 and the document cover 158 are in contact with each other, since it is possible to suppress or avoid the medium supply port cover 124 assuming a state of being propped against the document cover 158, it is possible to prevent at least one of the medium supply port cover 124 and the document cover 158 from being damaged.

Modification Example of First Example

By modifying the shapes of the engaged portion 66*b* and the engagement portion 66*c* in the rocking member 166, as appropriate, it is possible to modify the timing of the contact between the document cover 158 and the engaged portion 66*b*, and the timing of the contact between the engagement portion 66*c* and the medium supply port cover 124, as appropriate. Accordingly, it is possible to set the timing at which the medium supply port cover 124 opens in relation to the timing at which the document cover 158 opens, as appropriate.

Second Example

Next, description will be given of the second example with reference to FIGS. 38 to 40. With reference to FIGS. 38 and 39, a medium supply port cover 170 is attached to the rear surface side end portion of the apparatus main body 112. A long hole 70*a* which extends in the apparatus width direction is formed in the medium supply port cover 170. The tilting shaft 162*a* of the hinge 162 is inserted into the long hole 70*a*. A biasing unit 172 which biases the tilting shaft 162*a* to the rear surface side of the apparatus depth direction is provided in the long hole 70*a*. The biasing unit 172 is configured as a compressed coil spring.

Here, when an external force (refer to arrow B in FIG. 39) is applied to the medium supply port cover 170 toward the rear surface side in the apparatus depth direction, the tilting shaft 162*a* moves inside the long hole 70*a* relative to the front surface side in the apparatus depth direction with respect to the medium supply port cover 170 against the biasing force of the biasing unit 172 inside the long hole 70*a*. In other words, the tilting shaft 162*a* moves in the direction of arrow C with respect to the long hole 70*a*. Accordingly, the medium supply port cover 170 slides to the rear surface side in the apparatus depth direction with respect to the tilting shaft 162*a*.

When the external force (the force in the orientation of arrow B) which is applied to the medium supply port cover 170 to the rear surface side in the apparatus depth direction is removed, the medium supply port cover 170 slides to the front surface side in the apparatus depth direction due to the biasing force of the biasing unit 172, and returns to the original state.

The hinge 162 engages with one end of the biasing unit 164 in the same manner as in the first example. The other end of the biasing unit 164 engages with the biasing unit attachment portion 112*b*. The biasing unit 164 biases the hinge 162 to the bottom side in the apparatus height direction. The medium supply port cover 170 is capable of being displaced in the apparatus height direction with respect to the apparatus main body 112 in the same manner as in the first example.

As illustrated in FIG. 40, when the reading mechanism unit 114 is opened in the state in which the document cover 158 is opened, the top surface 58*a* of the document cover 158 and a distal end 70*b* of the front surface side of the medium supply port cover 170 in the apparatus depth direction come into contact with each other. When the reading mechanism unit 114 is further opened to the rear surface side in the apparatus depth direction, the document cover 158 presses the medium supply port cover 170 in the apparatus depth direction.

Accordingly, the medium supply port cover 170 is caused to slide to the rear surface side in the apparatus depth direction against the biasing force of the biasing unit 172 due to the document cover 158. As a result, even if the reading mechanism unit 114 is opened in the state in which the document cover 158 is opened, it is possible to suppress or prevent damage to the medium supply port cover 170.

To summarize the description hereunto, the printer 110 is provided with the medium supply port 26 which is provided on the top portion of the apparatus main body 112 which is provided with the recording head 50 which performs recording on the medium and in which it is possible to set the medium, the reading mechanism unit 114 which is provided on the top portion of the apparatus main body 112 to be capable of opening and closing and which reads the document, the medium supply port cover 124 which opens and closes the medium supply port 26 and is provided on the apparatus main body 112, and the document cover 158 which is a cover which opens and closes the document stand 56 with which the reading mechanism unit 114 is provided, has the same opening direction as the medium supply port cover 124, and is provided on the reading mechanism unit 114, in which the document cover 158 and the medium supply port cover 124 are in a positional relationship in which the distal end of the medium supply port cover 124 comes into contact with the document cover 158 in a process in which the reading mechanism unit 114 is opened from a state in which the reading mechanism unit 114 and the medium supply port cover 124 are closed and the document cover 158 is opened, and the document cover 158 applies an external force to the medium supply port cover 124 in the opening direction.

According to the configuration which is described above, the document cover 158 and the medium supply port cover 124 are in a positional relationship in which the distal end of the medium supply port cover 124 comes into contact with the document cover 158 in a process in which the reading mechanism unit 114 is opened from a state in which the reading mechanism unit 114 and the medium supply port cover 124 are closed and the document cover 158 is opened, and the document cover 158 applies an external force to the medium supply port cover 124 in the opening direction, and so it is possible to suppress or avoid damage to the medium supply port cover 124 when the reading mechanism unit 114 is opened from the state in which the reading mechanism unit 114 and the medium supply port cover 124 are closed and the document cover 158 is opened. As a result, it is no longer necessary to greatly separate the document cover 158 from the medium supply port cover 124, and it is possible to realize a favorable external appearance of the apparatus.

In the process in which the reading mechanism unit 114 is opened from a state in which the reading mechanism unit 114 and the medium supply port cover 124 are closed and the document cover 158 is opened, the repulsive force which the document cover 158 receives from the medium supply port cover 124 does not exceed a magnitude which is necessary for closing the document cover 158. According to this configuration, it is possible to avoid a problem of the document cover 158 being unintentionally closed in the process in which the reading mechanism unit 114 is opened from a state in which the reading mechanism unit 114 and the medium supply port cover 124 are closed and the document cover 158 is opened.

The printer 110 is configured to be provided with the rocking member 166 which is capable of engaging with the document cover 158 and the medium supply port cover 124 and is capable of rocking, and when the document cover 158 is opened from a state in which the reading mechanism unit 114, and the document cover 158 and the medium supply port cover 124 are closed, the rocking member 166 rocks to push up the medium supply port cover 124. According to this configuration, by also opening the medium supply port cover 124 to a certain degree when the document cover 158 is opened, it is possible to render the contact angle of the medium supply port cover 124 with respect to the document cover 158 when the reading mechanism unit 114 is opened less acute. As a result, it is possible to more reliably suppress or avoid damage to the medium supply port cover 124 when the reading mechanism unit 114 is opened from a state in which the reading mechanism unit 114, and the document cover 158 and the medium supply port cover 124 are closed.

In the process in which the reading mechanism unit 114 is opened from a state in which the reading mechanism unit 114 and the medium supply port cover 124 are closed and the document cover 158 is opened, the angle $\alpha$ from the contact position S1 at which the medium supply port cover 124 comes into contact with the document cover 158, formed between the top surface 58*a*' of the document cover 158 of the tilting shaft side of the document cover 158 and the top surface 124*e* of the medium supply port cover 124 is an acute angle. According to this configuration, it is possible to still more smoothly open the medium supply port cover 124, and as a result, it is possible to more reliably suppress or avoid damage to the medium supply port cover 124.

The first inclined surface 124*c* is formed on the distal end of the medium supply port cover 124, the second inclined surface 58*b* which faces the first inclined surface 124*c* is formed on the base end side of the document cover 158, and when the reading mechanism unit 114 is opened from a state in which the reading mechanism unit 114, the document cover 158, and the medium supply port cover 124 are closed, the second inclined surface 58*b* is provided with a configuration to push up the first inclined surface 124*c* in the direction in which the medium supply port cover 124 opens. According to this configuration, it is possible to suppress or avoid damage to the medium supply port cover 124 when the reading mechanism unit 114 is opened from a state in which the reading mechanism unit 114, the document cover 158, and the medium supply port cover 124 are closed.

In plan view of the document cover 158 and the medium supply port cover 124, at least a portion of the second inclined surface 58*b* overlaps the first inclined surface 124*c*. According to this configuration, the inside of the document cover 158 and the medium supply port cover 124, that is, the top portion of the apparatus main body 112 is not exposed in plan view of the document cover 158 and the medium supply port cover 124, and it is possible to realize a favorable external appearance of the apparatus.

The printer 110 is provided with the medium supply port 26 which is provided on the top portion of the apparatus main body 112 which is provided with the recording head 50 which performs recording on the medium and in which it is possible to set the medium, the reading mechanism unit 114 which is provided on the top portion of the apparatus main body 112 to be capable of opening and closing and which reads the document, the medium supply port cover 170 which opens and closes the medium supply port 26 and is provided on the apparatus main body 112, and the document cover 158 which is a cover which opens and closes the document stand 56 with which the reading mechanism unit 114 is provided, has the same opening direction as the medium supply port cover 170, and is provided on the reading mechanism unit 114, in which the medium supply port cover 170 is capable of sliding in the apparatus depth direction which is a direction intersecting the tilting axial line direction, and in which the document cover 158 and the medium supply port cover 170 are in a positional relationship in which the distal end 70*b* of the medium supply port cover 170 comes into contact with the document cover 158 in a process in which the reading mechanism unit 114 is opened from a state in which the reading mechanism unit 114 and the medium supply port cover 170 are closed and the document cover 158 is opened, and the document cover 158 causes the medium supply port cover 170 to slide.

According to the configuration which is described above, the medium supply port cover 170 is capable of sliding in the apparatus depth direction which is a direction intersecting the tilting axial line direction, the document cover 158 and the medium supply port cover 170 are in a positional relationship in which the distal end 70*b* of the medium supply port cover 170 comes into contact with the document cover 158 in a process in which the reading mechanism unit 114 is opened from a state in which the reading mechanism unit 114 and the medium supply port cover 170 are closed and the document cover 158 is opened, and the document cover 158 is configured to cause the medium supply port cover 170 to slide, and so it is possible to suppress or avoid damage to the medium supply port cover 170 when the reading mechanism unit 114 is opened from the state in which the reading mechanism unit 114 and the medium supply port cover 170 are closed and the document cover 158 is opened. As a result, it is no longer necessary to greatly separate the document cover 158 from the medium supply port cover 170, and it is possible to realize a favorable external appearance of the apparatus.

The top surface 124*e* of the medium supply port cover 124 and the top surface 58*a* of the document cover 158 form the same surface. According to this configuration, it is possible to realize a more favorable external appearance of the apparatus.

In the present embodiment, the reading mechanism unit 114, the medium supply port covers 124 and 170, and the document cover 158 are applied to the ink jet printer which serves as an example of the recording apparatus; however, it is also possible to apply the reading mechanism unit 114, the medium supply port covers 124 and 170, and the document cover 158 to other liquid ejecting apparatuses in general.

Here, the liquid ejecting apparatus indicated in the first and second embodiments is not limited to a recording apparatus such as a printer, a copier, or a facsimile in which an ink jet recording head is used and which performs recording on a recording medium by ejecting an ink from the recording head, and the liquid ejecting apparatus includes an apparatus which, instead of the ink, ejects a liquid which corresponds to the use of the ink from a liquid ejecting head which corresponds to the ink jet recording head onto an ejection target medium which corresponds to the recording medium, and causes the liquid to adhere to the ejection target medium.

In addition to the recording head, examples of the liquid ejecting head include a color material ejecting head which is used in the manufacture of color filters of liquid crystal displays or the like, an electrode material (conductive paste) ejecting head which is used in the electrode formation of organic EL displays, field emission displays (FED), or the like, a biological organic matter ejecting head which is used in the manufacture of bio chips, and a sample ejecting head which serves as a precision pipette.

Third Embodiment

Description will be given of an outline of the printer according to the third embodiment of the invention.

Figure 41:
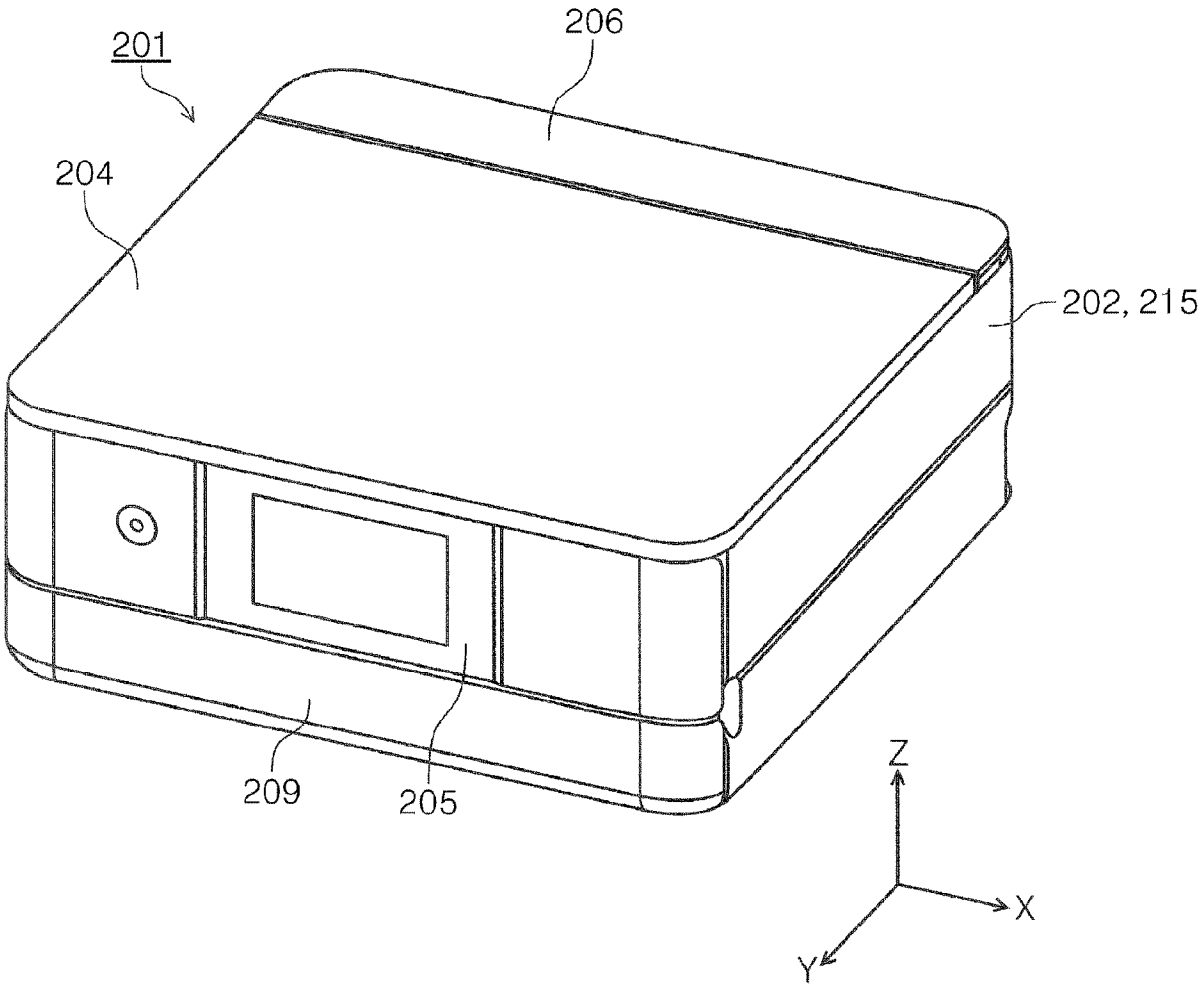
FIG. 41 is an external perspective diagram of a printer according to an embodiment.
Figure 42:
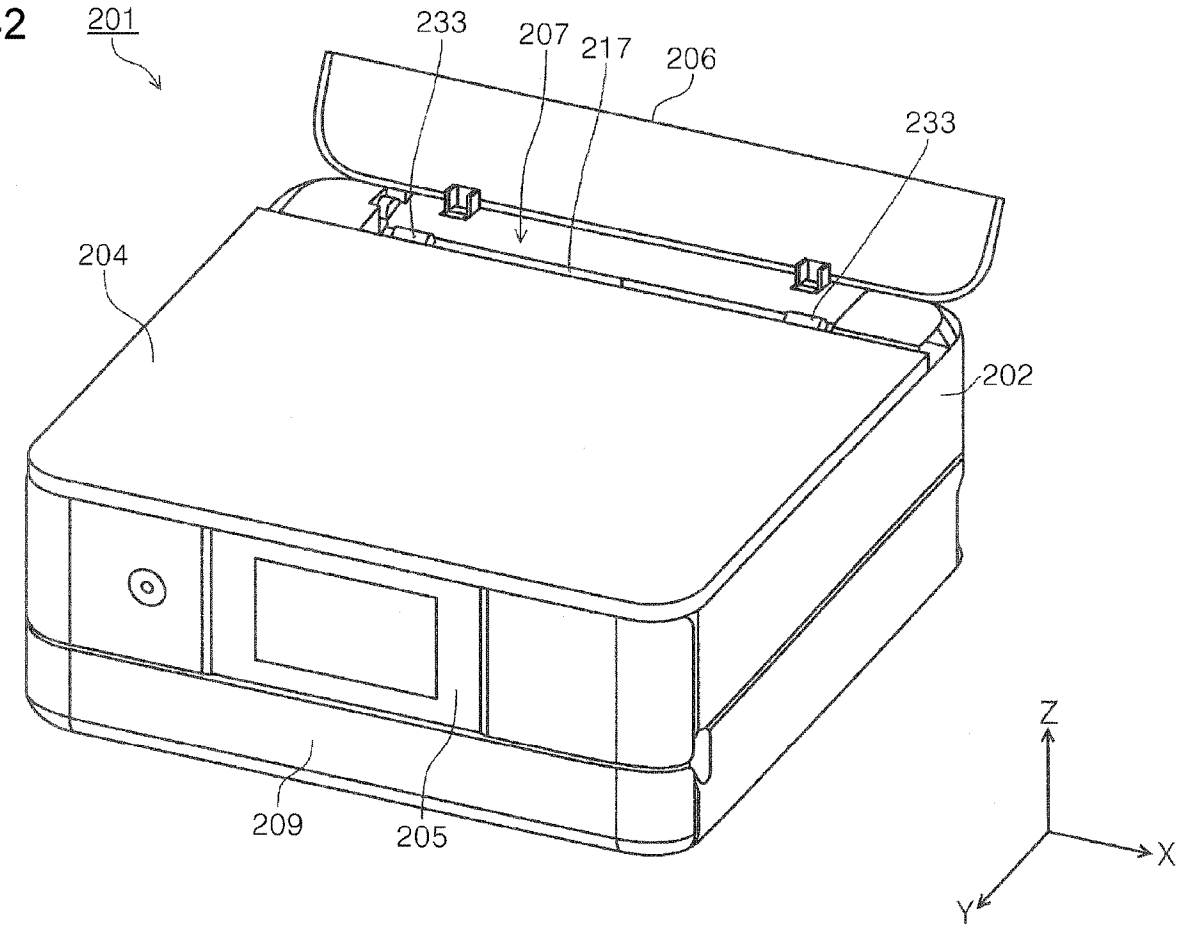
FIG. 42 is a perspective diagram representing a state in which a manual cover in the printer according to the embodiment is opened.
Figure 43:
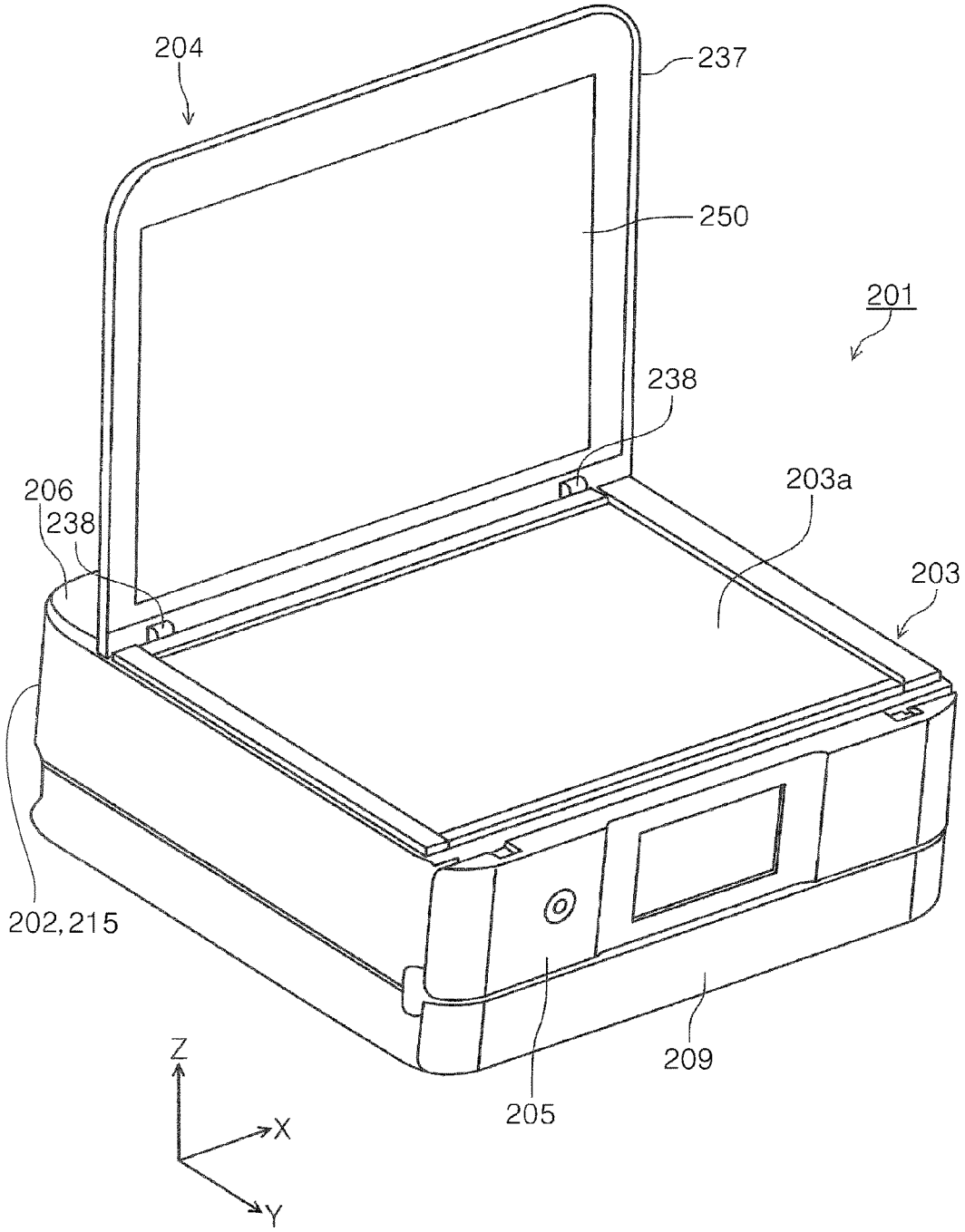
FIG. 43 is a perspective diagram illustrating a state in which a cover of a reading mechanism unit in the printer according to the embodiment is opened.
Figure 44:
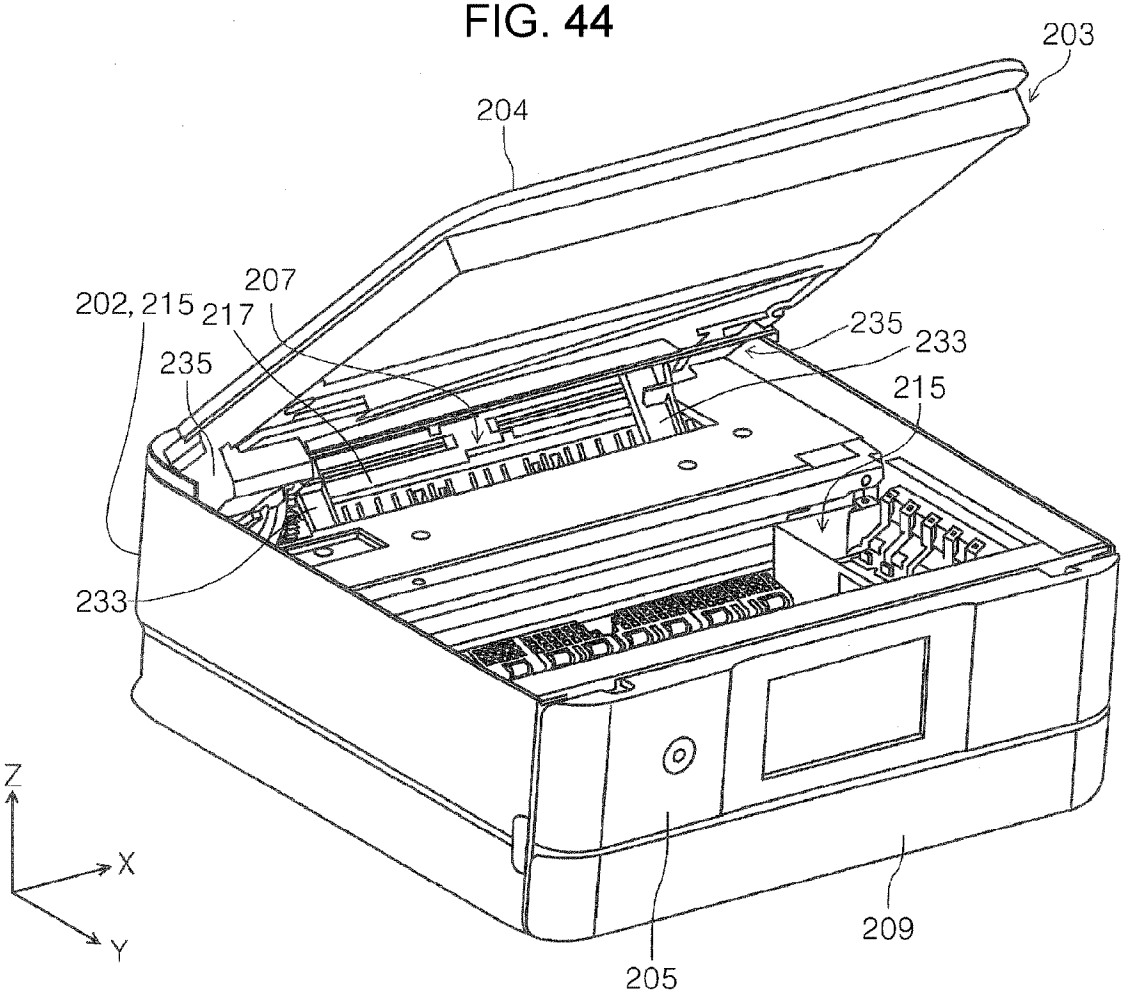
FIG. 44 is a perspective diagram illustrating a state in which the reading mechanism unit is opened with respect to a recording mechanism unit main body in the printer according to the embodiment.
Figure 45:
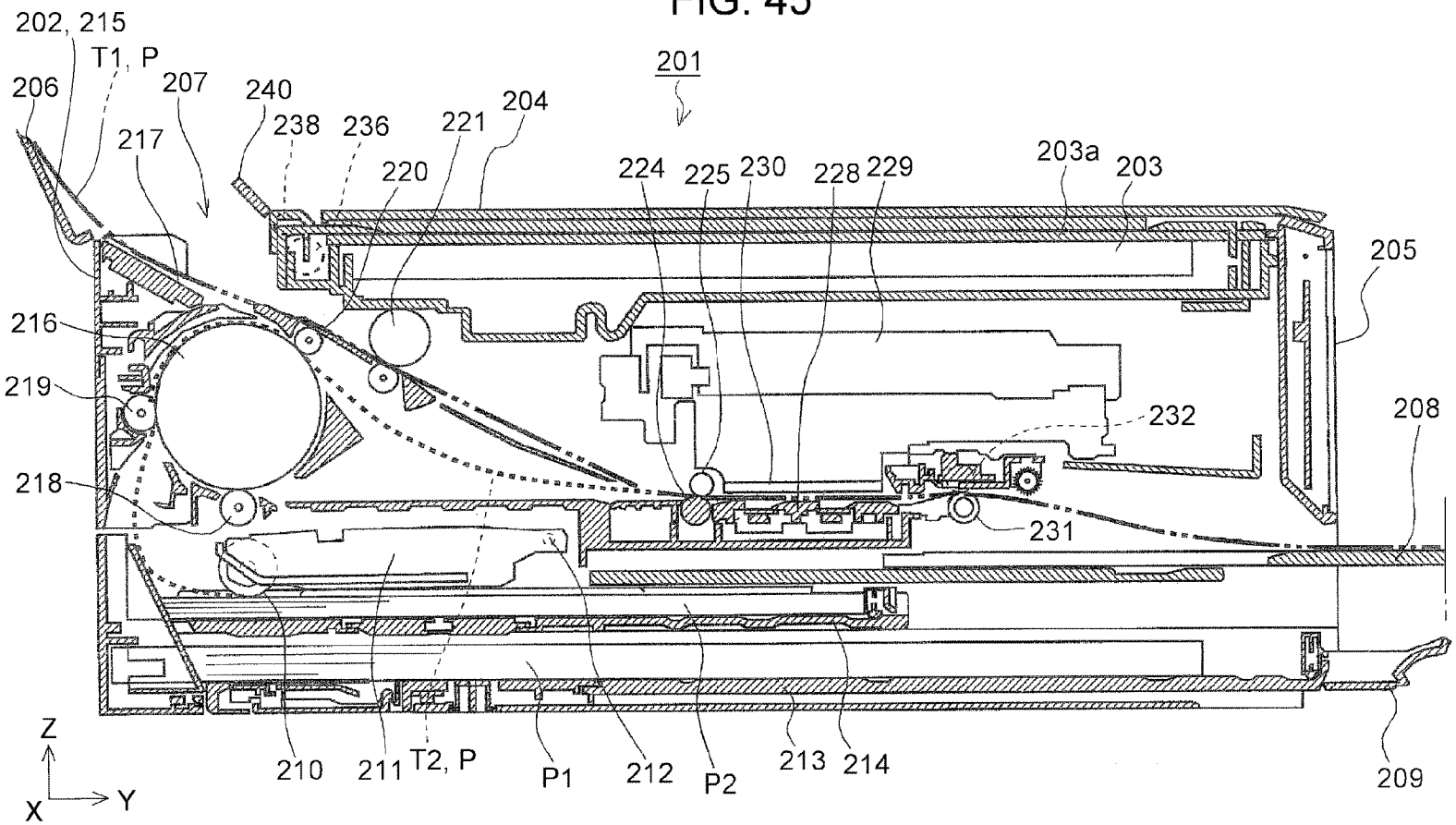
FIG. 45 is a diagram illustrating a paper transport path in the printer according to the embodiment.
Figure 46:
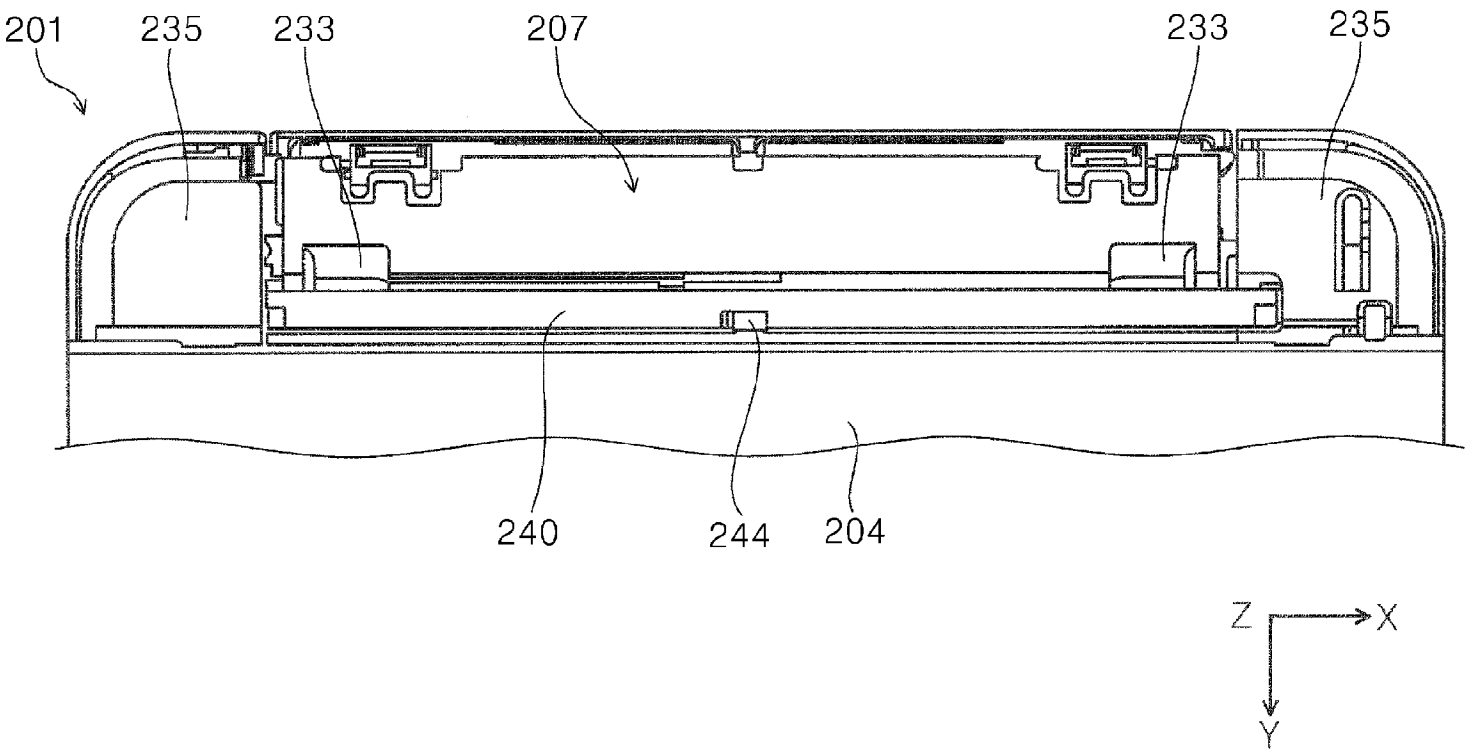
FIG. 46 is a main portion plan diagram of the printer according to the embodiment.
Figure 47A:
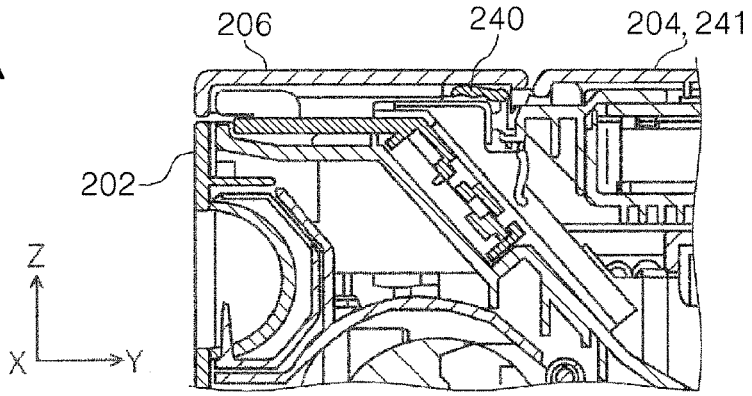
FIG. 47A is a diagram explaining the operation of a regulating member.
Figure 47B:
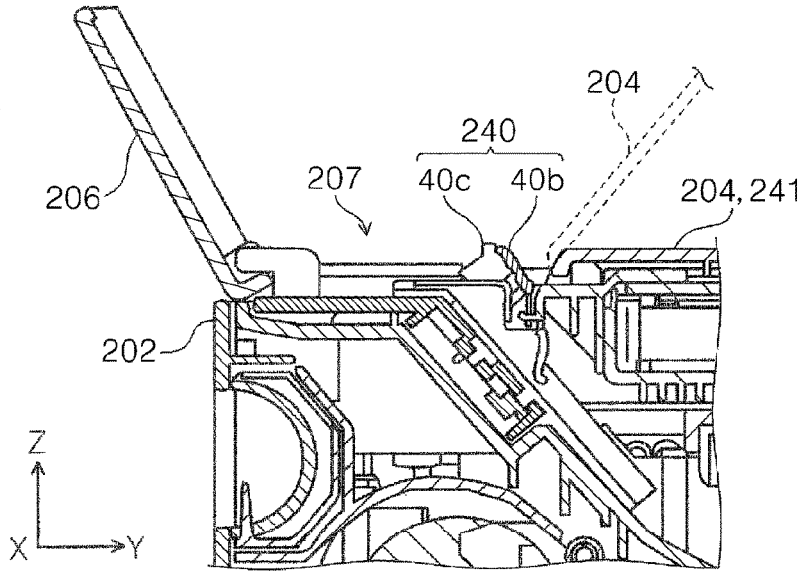
FIG. 47B is a diagram explaining the operation of the regulating member.
Figure 47C:
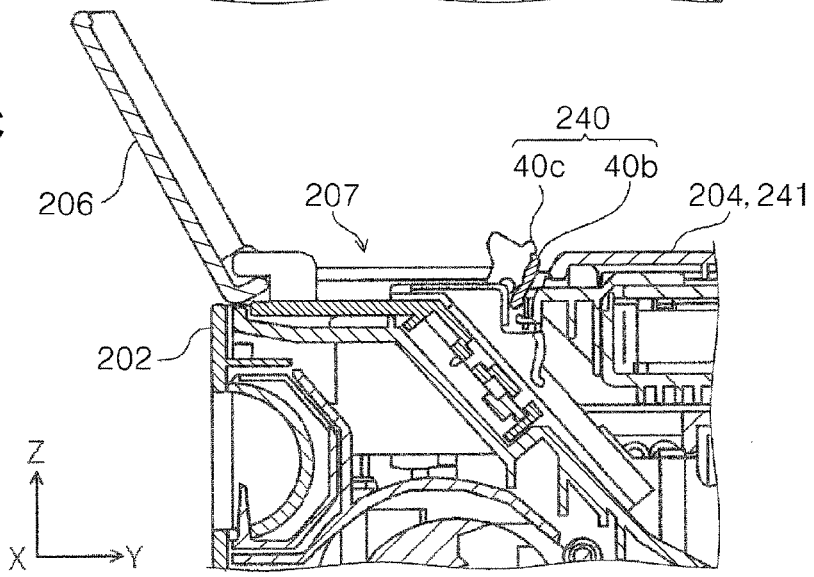
FIG. 47C is a diagram explaining the operation of the regulating member.
Figure 48A:
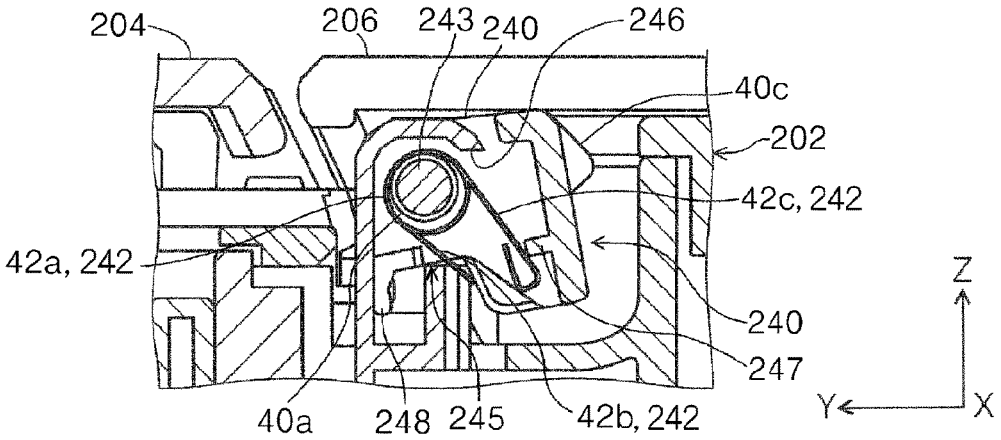
FIG. 48A is a diagram explaining a biasing mechanism which uses a torsion spring.
Figure 48B:
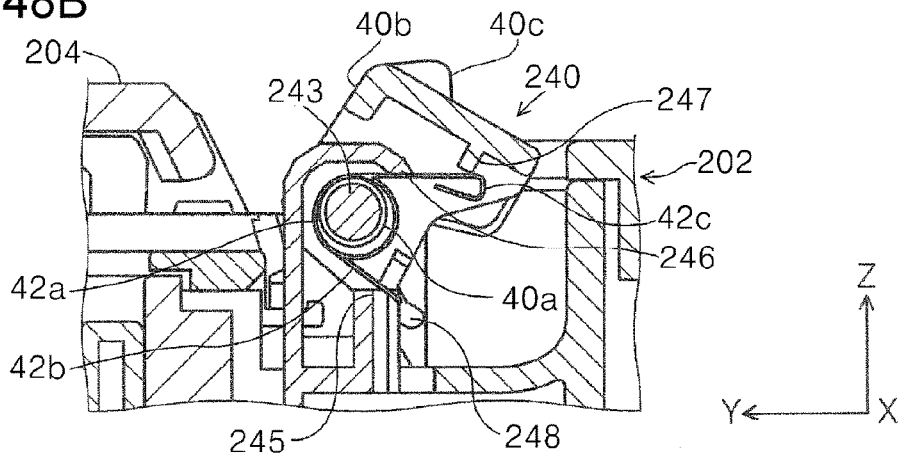
FIG. 48B is a diagram explaining the biasing mechanism which uses the torsion spring.
Figure 48C:
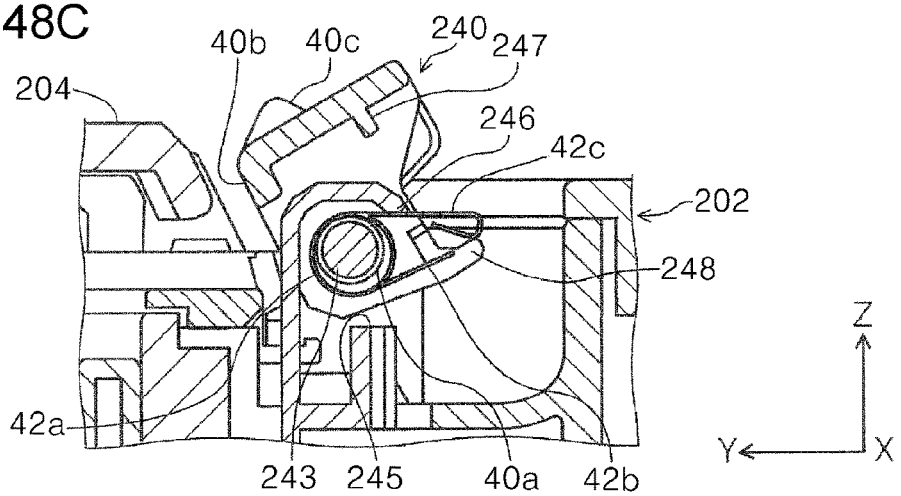
FIG. 48C is a diagram explaining the biasing mechanism which uses the torsion spring.

FIG. 41 is an external perspective diagram of a printer according to an embodiment. FIG. 42 is a perspective diagram representing a state in which a manual cover in the printer according to the embodiment is opened. FIG. 43 is a perspective diagram illustrating a state in which a cover of a reading mechanism unit in the printer according to the embodiment is opened. FIG. 44 is a perspective diagram illustrating a state in which the reading mechanism unit is opened with respect to a recording mechanism unit main body in the printer according to the embodiment. FIG. 45 is a diagram illustrating a paper transport path in the printer according to the embodiment. FIG. 46 is a main portion plan diagram of the printer according to the embodiment. FIGS. 47A, 47B, and 47C are diagrams explaining the operation of a regulating member. FIGS. 48A, 48B, and 48C are diagrams explaining a biasing mechanism which uses a torsion spring.

Figure 49:
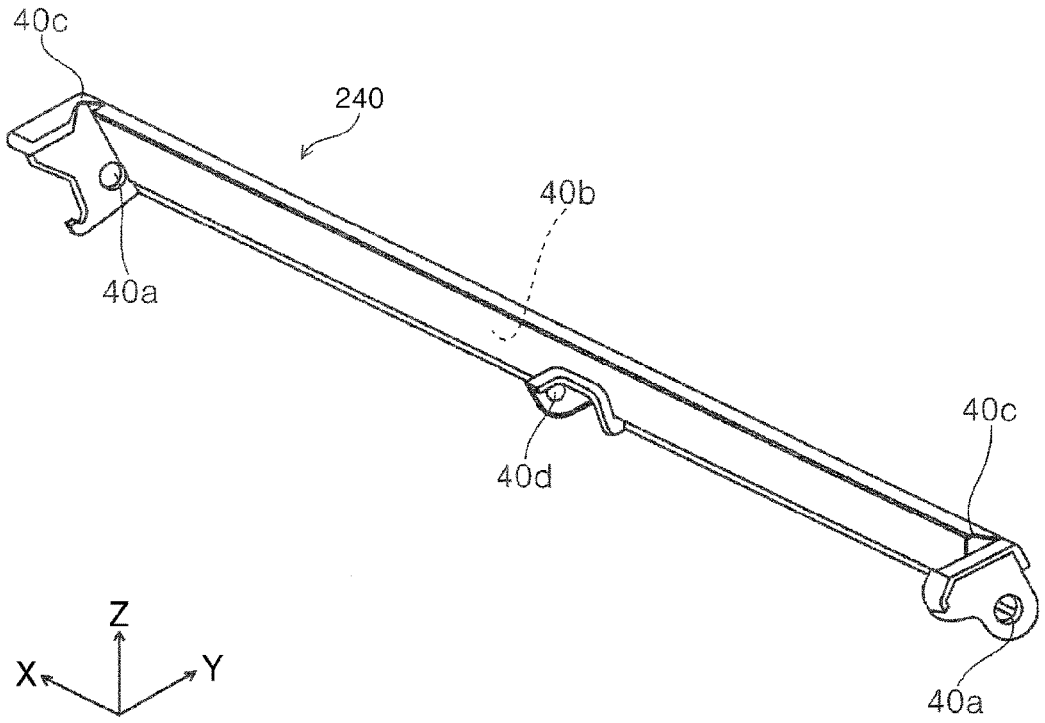
FIG. 49 is an external perspective diagram of a regulating member.
Figure 50:
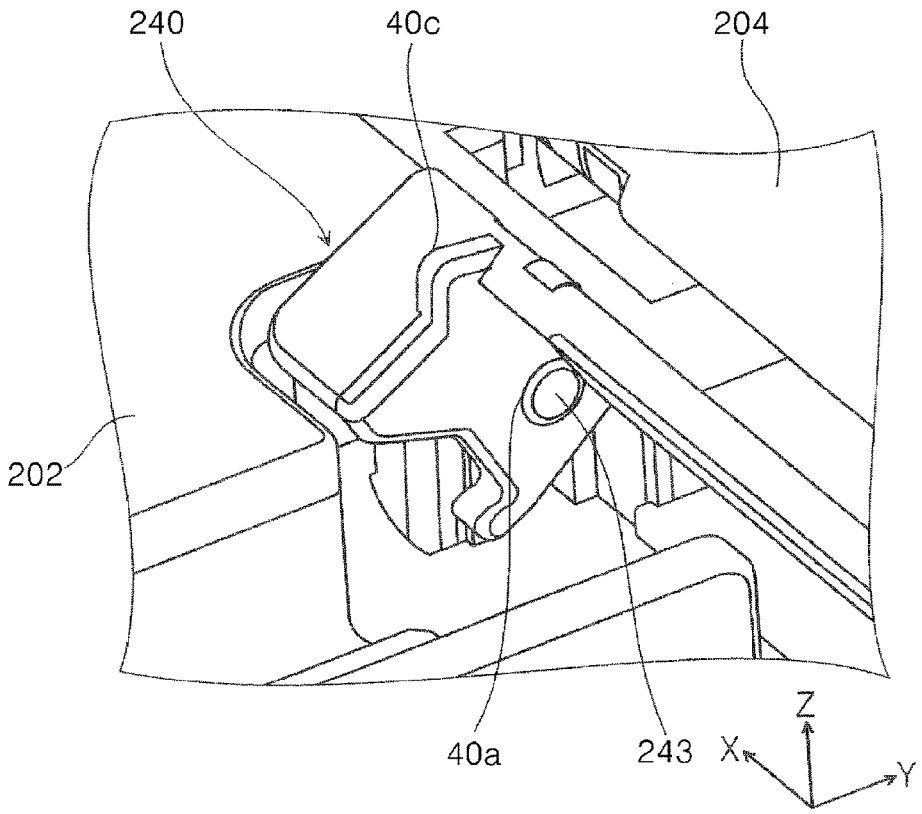
FIG. 50 is a main portion enlarged perspective diagram of the regulating member which is attached to the recording mechanism unit main body.
Figure 51:
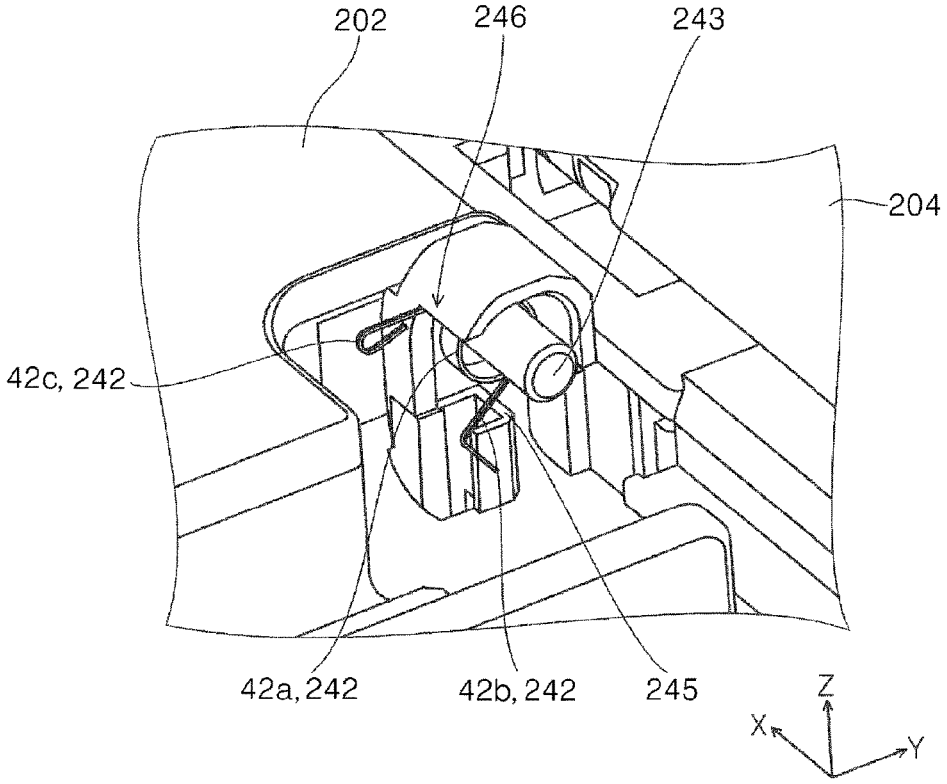
FIG. 51 is a main portion enlarged perspective diagram of a periphery of a tilting shaft to which the regulating member is attached in the recording mechanism unit main body.
Figure 52:
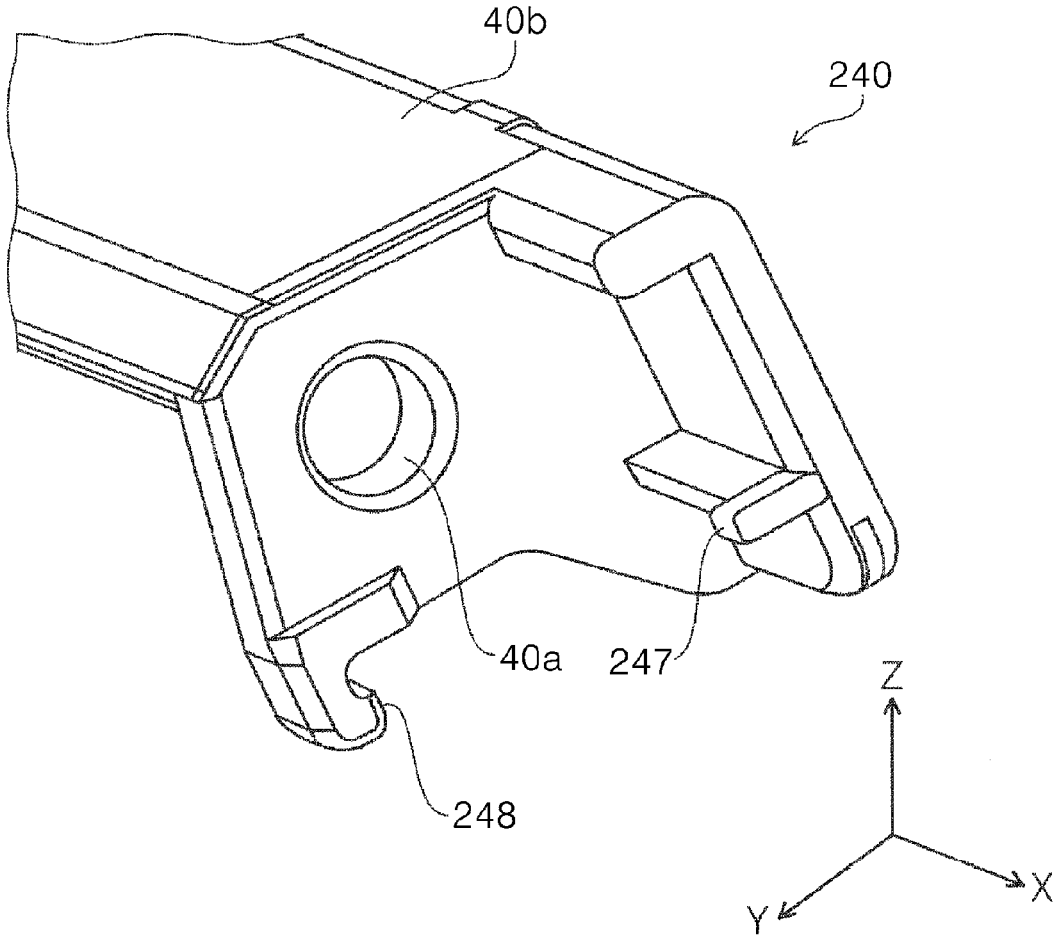
FIG. 52 is a main portion enlarged perspective diagram of the regulating member.
Figure 53:
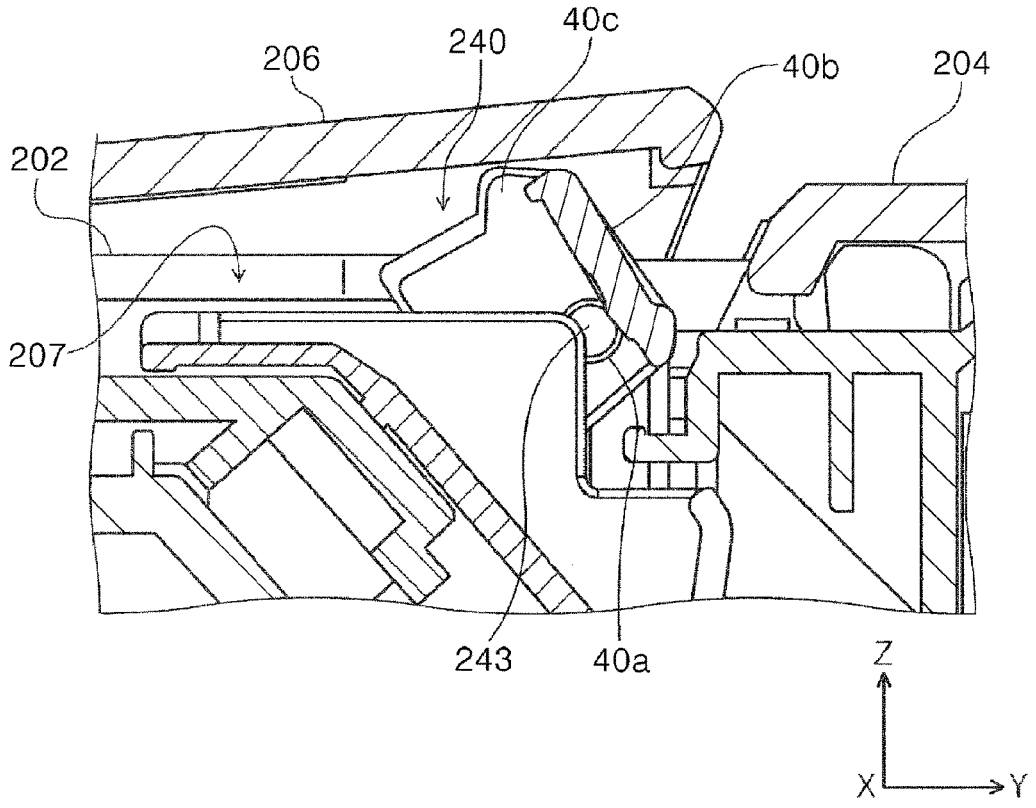
FIG. 53 is a diagram representing a state in which the manual cover to be closed is in contact with an induction portion of a regulating member.
Figure 54A:
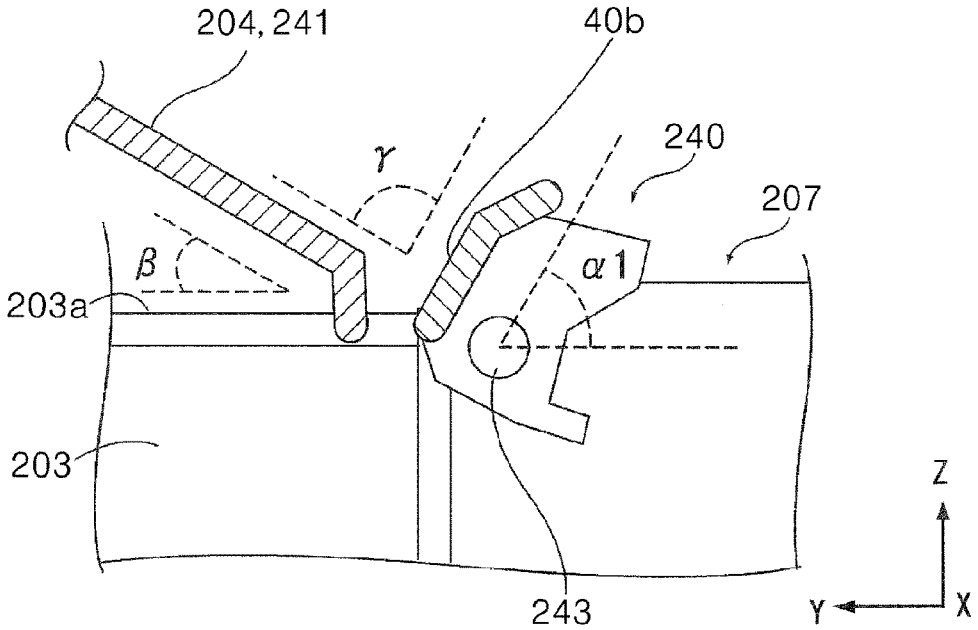
FIG. 54A is a diagram explaining an opening angle of the regulating member.
Figure 54B:
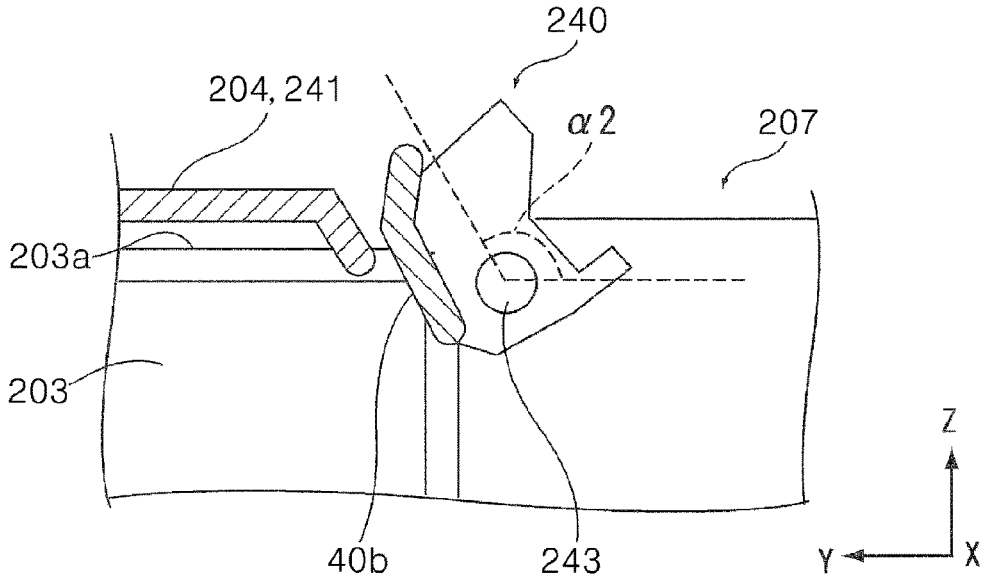
FIG. 54B is a diagram explaining the opening angle of the regulating member.
Figure 55:
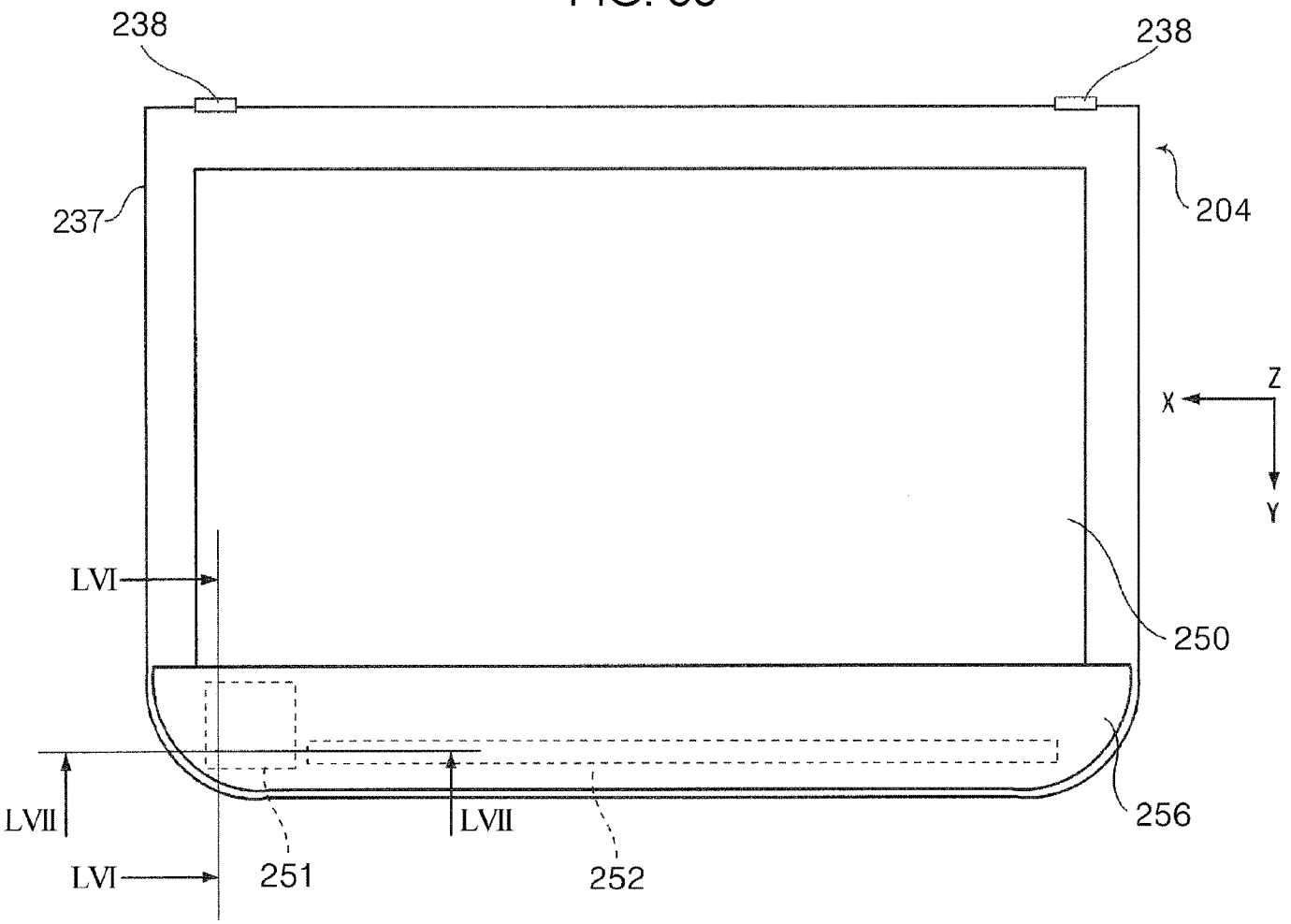
FIG. 55 is a plan diagram of a surface which faces a document stand in a document stand cover.
Figure 56:
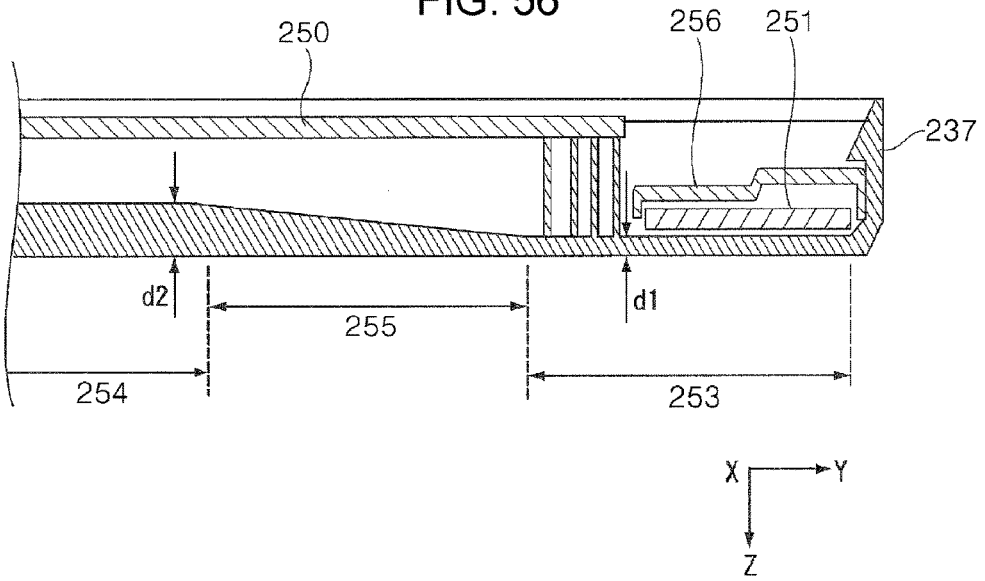
FIG. 56 is a sectional diagram taken along LVI-LVI of FIG. 55.
Figure 57:
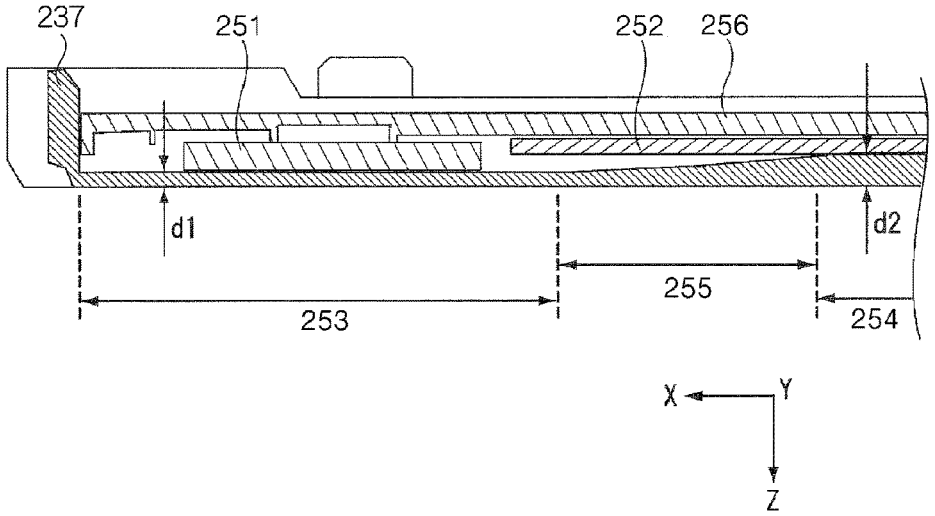
FIG. 57 is a sectional diagram taken along LVII-LVII of FIG. 55.

FIG. 49 is an external perspective diagram of a regulating member. FIG. 50 is a main portion enlarged perspective diagram of the regulating member which is attached to the recording mechanism unit main body. FIG. 51 is a main portion enlarged perspective diagram of a periphery of a tilting shaft to which the regulating member is attached in the recording mechanism unit main body. FIG. 52 is a main portion enlarged perspective diagram of the regulating member. FIG. 53 is a diagram representing a state in which the manual cover to be closed is in contact with an induction portion of a regulating member. FIGS. 54A and 54B are diagrams explaining an opening angle of the regulating member. FIG. 55 is a plan diagram of a surface which faces a document stand in a document stand cover. FIG. 56 is a sectional diagram taken along LVI-LVI of FIG. 55. FIG. 57 is a sectional diagram taken along LVII-LVII of FIG. 55.

In the X-Y-Z coordinate system illustrated in the drawings, the X direction is the scanning direction of the recording head, and the Y direction is the apparatus depth direction. The Z direction is the direction of gravity and indicates the apparatus height direction. The +Y direction side is the apparatus front surface side, and the −Y direction side is the apparatus rear surface side. As viewed from the apparatus front surface side, the right side is the +X direction, and the left side is the −X direction. The +Z direction is the top of the apparatus (the top portion, including the top surface and the like), and the −Z direction side is the bottom of the apparatus (the bottom portion, including the bottom surface and the like).

Hereinafter, the transport direction (the +Y direction side) in which the paper is transported in a printer 201 will be referred to as "downstream", and the opposite direction (the −Y direction side) will be referred to as "upstream".

First Example

Overall Configuration of Printer

Hereinafter, an outline description will be given of the overall configuration of the printer 201.

The printer 201 (FIG. 41) according to the present example is provided with a recording mechanism unit 215 and a reading mechanism unit 203 (FIG. 43). The recording mechanism unit 215 is configured to be provided with a recorder (a recording head 230 to be described later, refer to FIG. 45) which performs ink jet recording on the paper which serves as a recording medium inside a recording mechanism unit main body 202, and the reading mechanism unit 203 is provided on the top portion of the recording mechanism unit main body 202 and reads the document. In other words, the printer 201 is configured as a multi-functional device which is provided with a scanner function in addition to an ink jet recording function.

A medium supply port 207 which is provided with a manual tray 217 (FIGS. 42 and 44) in which it is possible to set paper to be recorded on by the recording mechanism unit 215 is provided on the top portion of the recording mechanism unit main body 202 which serves as a housing which configures the apparatus main body.

A manual cover 206 (a first opening/closing body) which serves as a lid body which opens and closes the medium supply port 207 is provided on the rear top portion of the recording mechanism unit main body 202, and it is possible to perform the paper feeding by manually inserting the paper P which uses the manual tray 217 by opening the manual cover 206 as illustrated in FIGS. 42 and 45. The manual cover 206 supports the paper P which is supplied from the medium supply port 207 and is set in the manual tray 217 in the opened state (FIG. 45). Accordingly, it is possible to perform stable supplying of the paper P from the manual tray 217.

The reading mechanism unit 203 is provided to be capable of tilting with respect to the recording mechanism unit main body 202 of the recording mechanism unit 215, and is capable of assuming a state in which the top portion of the recording mechanism unit 215 is closed (FIG. 41) and a state in which the top portion of the recording mechanism unit 215 is opened (FIG. 44) by tilting.

The reading mechanism unit 203 is connected to be capable of tilting with respect to the recording mechanism unit 215 at connecting portions 235 (FIG. 44) which are provided on both sides in the X direction. A tilting shaft 236 (FIG. 45) is provided on each of the connecting portions 235, the tilting shafts 236 are axially supported by bearings (not illustrated) which are provided on the recording mechanism unit main body 202 side, and the reading mechanism unit 203 is configured to tilt using the X direction as the tilting axial line direction so as to open and close the top portion of the recording mechanism unit 215.

In other words, the reading mechanism unit 203 includes the tilting shafts 236 (refer to FIG. 45) in positions at which a downward inclined surface heading toward the medium supply port 207 is formed in the opened state (FIG. 44).

The reading mechanism unit 203 is provided with a document stand cover 204 (FIGS. 41 and 43) which is a document cover which is capable of opening and closing the top portion, and the document stand cover 204 is configured to open and close a document stand 203*a* as illustrated in FIG. 43.

In the document stand cover 204, tilting shafts 238 (refer to FIGS. 43 and 45) which are provided on a cover main body 237 (FIG. 56) which forms the top surface of the document stand cover 204 are attached to bearing portions (not illustrated) which are provided on the recording mechanism unit main body 202 side and are configured to tilt using the X direction as the tilting axis.

In the same manner as in the reading mechanism unit 203, the document stand cover 204 also includes the tilting shafts 238 (refer to FIG. 45) in positions at which a downward inclined surface heading toward the medium supply port 207 is formed in the opened state (FIG. 43).

When the document stand cover 204 or the reading mechanism unit 203 is opened, a regulating member 240 (refer to FIG. 45) which regulates the slipping and falling of an object into the medium supply port 207 is provided between the manual cover 206 and the document stand cover 204. More detailed description of the configuration of the regulating member 240 will be given later.

On the apparatus front surface of the printer 201 of FIG. 41, reference symbol 205 is an operation panel 205 which is formed by providing a power button, operation buttons which perform various print settings and recording execution, a display unit which performs preview display or the like of print setting content and a print image, and the like.

The reference symbol 209 is a front surface cover which is provided on a bottom side tray 213 (FIG. 45) and is capable of opening and closing. As illustrated in FIG. 45, a configuration is adopted in which the bottom side tray 213, a top side tray 214, and a paper output receiving tray 208 become visible by opening the front surface cover 209.

The paper output receiving tray 208 is provided to be capable of assuming a state of being stored in the recording mechanism unit main body 202 by a motor which is not illustrated, (FIG. 41), and a state of protruding to the front side of the recording mechanism unit main body 202 (FIG. 45), and by assuming the state of protruding to the front side of the recording mechanism unit main body 202, is capable of receiving the paper which is subjected to recording and is output.

The bottom side tray 213 and the top side tray 214 which is provided above the bottom side tray 213 which are illustrated in FIG. 45 are capable of storing a plurality of sheets of paper, and each is independently attached to the recording mechanism unit main body 202 in a detachable manner. Even in a state in which one side is in the non-mounted state, as long as the other side is mounted, it is possible to feed the paper out from the mounted tray.

Description will be given later of the paper transport path in the recording mechanism unit 215 of the printer 201.

Regarding Regulating Member

Next, detailed description will be given of the regulating member 240 which regulates the slipping and falling of an object into the medium supply port 207 which is described earlier.

The regulating member 240 is configured to be capable of assuming a storage state (FIGS. 47A and 48A) and a regulating state (FIGS. 47B and 48B). In the storage state, the regulating member 240 is positioned on the inside of the manual cover 206 and is closed in a state in which the manual cover 206 (the first opening/closing body) is closed, and in the regulating state, the regulating member 240 opens together with an opening operation of the manual cover 206 and forms a surface (a regulating surface 40*b*) which intersects the top surface of a second opening/closing body 241 to regulate the slipping and falling of an object from the top surface of the second opening/closing body 241 into the medium supply port 207. The regulating member 240 is biased from the storage state to the regulating state by a torsion spring 242 (refer to FIGS. 48A, 48B, and 48C) which serves as the biasing member.

In the present example, it can be said that the document stand cover 204 is the second opening/closing body 241 when the document stand cover 204 is opened with respect to the document stand 203*a* (refer to FIG. 43). It can be said that the reading mechanism unit 203 is the second opening/closing body 241 when the reading mechanism unit 203 is opened in a state in which the document stand cover 204 is closed (refer to FIG. 44).

In the present example, the regulating member 240 is configured to be capable of switching between the storage state and the regulating state by tilting using a tilting shaft 243 as an axis.

More specifically, the tilting shaft 243 which is provided on the recording mechanism unit main body 202 is inserted (FIGS. 50 and 51) into a shaft hole 40*a* which is provided in both end portions of the regulating member 240 (FIG. 49) in the longitudinal direction (the X direction), and the regulating member 240 is attached to the recording mechanism unit main body 202 to be capable of tilting.

The regulating member 240 is also provided with a shaft hole 40*d* in the center portion in the longitudinal direction (the X direction), and a tilting shaft 244 (FIG. 46) which is provided in the recording mechanism unit main body 202 is axially supported by the shaft hole 40*d*.

The torsion spring 242 which biases the regulating member 240 engages with the recording mechanism unit main body 202 (the housing) and the regulating member 240 to exert a biasing force. By using the torsion spring 242, it is possible to bias the regulating member 240, which is simple in structure and tilts, from the storage state to the regulating state. The biasing mechanism which uses the torsion spring 242 will be described in detail later.

Next, the regulating member 240 is provided (FIGS. 47C and 48C) so as to be capable of tilting further in the opening direction by receiving an external force such as pushing by hand, for example, from the regulating state (FIGS. 47B and 48B).

In the printer 201, an edge guide 233 (FIGS. 42 and 46) which guides both end portions of the paper P, which is set in the manual tray 217, in the width direction (the X direction) is provided on the inside of the medium supply port 207. The edge guide 233 is configured to be capable of moving in the X direction through being operated by hand by the user according to the width size of the paper P which is set in the manual tray 217.

Due to the regulating member 240 being provided to be capable of tilting further in the opening direction from the regulating state by receiving an external force, when a hand is inserted into the inside of the medium supply port 207, for example, it is possible to secure a wide operation space in a case in which the edge guide 233 which is provided on the inside of the medium supply port 207 is operated, or the like.

Regarding Biasing Mechanism

Next, description will be given of the biasing mechanism of the regulating member 240 which uses the torsion spring 242.

The torsion spring 242 is configured to bias the regulating member 240 in the closing direction in a state in which the regulating member 240 is further opened from the regulating state by switching the part which engages in the recording mechanism unit main body 202 and the regulating member 240 using the regulating state of the regulating member 240 as the boundary for switching.

In other words, the regulating member 240 is configured to be automatically opened from the storage state to the regulating state when the manual cover 206 is opened by the one torsion spring 242, and when the hand is released to remove the external force from the state in which the regulating member 240 is further opened from the regulating state upon receiving an external force such as pushing by hand, the regulating member 240 returns to the regulating state without the intervention of user operation.

Hereinafter, more detailed description will be given of the configuration.

As illustrated in FIGS. 48A to 48C, the torsion spring 242 is provided with a coil portion 42*a*, and a one side arm portion 42*b* and another side arm portion 42*c* which extend from the coil portion 42*a*, and the coil portion 42*a* is inserted into the tilting shaft 243 which is provided in the recording mechanism unit main body 202.

Furthermore, the recording mechanism unit main body 202 (refer to FIGS. 48A to 48C and 51) is provided with a first contacting portion 245 which comes into contact with the one side arm portion 42*b* of the torsion spring 242 and receives the biasing force of the torsion spring 242 when the regulating member 240 is between the storage state (FIG. 48A) and the regulating state (FIG. 48B), and a second contacting portion 246 which comes into contact with the other side arm portion 42*c* of the torsion spring 242 and receives the biasing force of the torsion spring 242 in a state (FIG. 48C) in which the regulating member 240 is further opened from the regulating state.

Furthermore, the end portion in the longitudinal direction of the regulating member 240 (refer to FIGS. 48A to 48C and 52) is provided with a first acting portion 247 which comes into contact with the other side arm portion 42*c* of the torsion spring 242 and receives the biasing force of the torsion spring 242 when the regulating member 240 is between the storage state (FIG. 48A) and the regulating state (FIG. 48B), and a second acting portion 248 which comes into contact with the one side arm portion 42*b* of the torsion spring 242 and receives the biasing force of the torsion spring 242 in a state (FIG. 48C) in which the regulating member 240 is further opened from the regulating state.

The torsion spring 242 is configured to be capable of switching the biasing direction of the regulating member 240 using the regulating state (FIG. 48B) of the regulating member 240 as a boundary by switching between a state (FIG. 48A) in which the torsion spring 242 engages with the first contacting portion 245 and the first acting portion 247, and an engagement state (FIG. 48C) in which the torsion spring 242 engages with the second contacting portion 246 and the second acting portion 248.

In other words, in the state (FIG. 48A) in which the torsion spring 242 engages with the first contacting portion 245 and the first acting portion 247, the regulating member 240 is biased by the torsion spring 242 from the storage state in the direction of opening to the regulating state.

In the engagement state (FIG. 48C) in which the second contacting portion 246 and the second acting portion 248 are engaged with each other, the regulating member 240 is biased from the state in which the regulating member 240 is further opened from the regulating state by the torsion spring 242 in a direction returning to the regulating state.

According to this configuration, it is possible to switch the direction in which the regulating member 240 is biased using one biasing member (the torsion spring 242) to reduce the cost of the apparatus.

Naturally, it is also possible to separately provide a biasing member which biases the regulating member 240 from the storage state to the regulating state, and a biasing member which biases the regulating member 240 from a state of being opened from the regulating state in the closing direction.

The torsion spring 242 may be provided on at least the end portion of one side in the longitudinal direction; however, it is possible to provide the torsion spring 242 on the end portions of both sides. It is also possible to provide the torsion spring 242 on the tilting shaft 244 (FIG. 46) of the center portion in the longitudinal direction.

By providing the regulating member 240 which is configured in this manner, the following actions and effects may be obtained.

In other words, since the regulating member 240 is biased by the torsion spring 242 (the biasing member) from the storage state to the regulating state, it is possible to transition the regulating member 240 from the storage state to the regulating state together with the opening and closing of the manual cover 206 which opens and closes the medium supply port 207.

Therefore, in the state in which the manual cover 206 and the medium supply port 207 are opened, regardless of the opening/closing state of the second opening/closing body 241 (the document stand cover 204 or the reading mechanism unit 203), the regulating member 240 always assumes the regulating state, that is, the state in which the falling of foreign matter into the medium supply port 207 is regulated, and it is possible to more reliably suppress or avoid the falling of foreign matter into the medium supply port 207.

As illustrated in FIGS. 46 and 47B the regulating member 240 in the regulating state overlaps a portion of the downstream side of the medium supply port 207 in the paper transport direction (the Y direction), and it is possible to suppress a reduction in productivity when supplying the paper to the medium supply port 207 by reducing the size of the regulating member 240. Since it is possible to open and close the regulating member 240, it is possible to effectively suppress falling of objects into the medium supply port 207. In FIG. 46, depiction of the manual cover 206 is omitted.

In addition, by performing the switching between the storage state and the regulating state by tilting the regulating member 240, it is possible to provide the regulating member 240 using a simple configuration.

In addition to a configuration in which switching between the storage state and the regulating state is performed by tilting the regulating member 240, the regulating member 240 may be configured to switch between the storage state and the regulating state by, for example, advancing and withdrawing.

Next, description will be given of the opening angle of the regulating member 240 using FIGS. 54A and 54B.

In the regulating state (FIG. 54A), it is desirable that an opening angle $\alpha 1$ of the regulating member 240 with respect to the top surface (the X-Y surface) of the apparatus be approximately 60°.

When the second opening/closing body 241 is opened with an object still placed on the top of the second opening/closing body 241 (the document stand cover 204 in FIG. 54A), the object slides and falls or begins to roll to the side of the medium supply port 207. The object (for example, a paper clip, a pen, or the like) on the second opening/closing body 241 begins to slide and fall at around the point at which an angle $\beta$ of the second opening/closing body 241 with respect to the top surface (the X-Y surface) of the apparatus reaches approximately 30°, although this varies depending on the size, shape, material, and the like of the object.

When the opening angle $\alpha 1$ of the regulating member 240 in the regulating state is approximately 60°, an angle $\gamma$ which is formed between the second opening/closing body 241 in which the angle $\beta$ reaches the angle (approximately 30°) at which sliding begins, and the regulating surface 40*b* of the regulating member 240 reaches approximately 90°. Due to the regulating member 240 being provided, it is possible to effectively suppress the slipping and falling of the object which is placed on the second opening/closing body 241 into the medium supply port 207 when the second opening/closing body 241 is opened.

In the state (FIG. 54B) in which the regulating member 240 is further opened from the regulating state, it is desirable that an opening angle $\alpha 2$ of the regulating member 240 with respect to the top surface (the X-Y surface) of the apparatus be opened greater than 90°, and it is desirable that the opening angle $\alpha 2$ open to approximately 120°.

Accordingly, it is possible to easily perform an operation (an operation of the edge guide 233 or the like) which is performed by inserting a hand into the medium supply port 207 while avoiding interference with the second opening/closing body 241 which is in the closed state.

In the present example, the regulating member 240 is provided with an induction portion 40*c* (FIGS. 50 and 53) with which the manual cover 206 comes into contact and which leads the regulating member 240 to the storage state when the manual cover 206 changes from the opened state to the closed state. As illustrated in FIG. 53, the induction portion 40*c* is provided on the free end side of both sides of the regulating member 240 in the width direction (the X direction).

Due to the regulating member 240 being provided with the induction portion 40*c*, the regulating member 240 is guided in the closing direction by the change of the manual cover 206 from the opened state to the closed state, and it is possible to smoothly adopt the storage state.

In the present example, a configuration is adopted in which the torsion spring 242 is used as the biasing member; however, it is also possible to use a compression spring, a tension spring, or the like.

In the present example, either one of the document stand cover 204 and the reading mechanism unit 203 opens and closes at least a portion other than the medium supply port 207 in the top portion of the recording mechanism unit main body 202 (the housing) as the second opening/closing body 241; however, for example, in a printer which does not include the reading mechanism unit 203, the opening/closing cover which opens and closes the top surface of the recording mechanism unit main body 202 may be provided as the second opening/closing body. It is also possible to use the reading mechanism unit 203 which opens and closes in the top portion of the recording mechanism unit main body 202 (the housing) as the second opening/closing body without providing the document stand cover 204.

Regarding Other Configurations of Document Stand Cover

Description will be given of other configurations of the document stand cover 204 with reference to FIGS. 55 to 57.

As illustrated in FIG. 55 (also refer to FIG. 43), the document stand cover 204 is provided with the cover main body 237 and a document retaining mat 250 which is attached to the bottom surface (the surface facing the document stand 203*a*) of the cover main body 237.

When the document stand cover 204 is closed, the document which is placed on the document stand 203*a* is pressed by the document retaining mat 250, and the reading-target surface of the document is in close contact with the document stand 203*a*.

The document stand cover 204 is provided with a near field wireless communication substrate 251 (hereinafter there are cases in which this is referred to as an NFC substrate 251) on the free end side (the +Y side) of the cover main body 237.

For example, the NFC substrate 251 is capable of performing near field wireless communication between the printer 201 and a portable terminal of the user, and is capable of executing information transmission to the portable terminal, setting of the printer 201 from the portable terminal, transfer of image data, recording in the recording mechanism unit 215, executing the scanning in the reading mechanism unit 203, and the like.

A metal plate 252 which spans a portion other than the position in which the NFC substrate 251 is provided in the apparatus width direction (the X direction) is provided on the free end side (the +Y side) of the cover main body 237. By providing the metal plate 252, the rigidity of the document stand cover 204 is improved.

The NFC substrate 251 and the metal plate 252 are covered by a cover member 256, and are positioned between the cover main body 237 and the cover member 256.

Here, in the cover main body 237, the position at which the NFC substrate 251 is provided is formed thinly. More specifically, as illustrated in FIGS. 56 and 57, the cover main body 237 forms the same surface as the top surface side (the +Z side surface) which serves as the document stand cover 204, and is configured such that the reverse surface thereof is formed thinly to surround the document stand cover 204. By disposing the NFC substrate 251 in a thinly formed thin portion 253, it is possible to suppress an increase in the thickness of the document stand cover 204 due to the disposal of the NFC substrate 251.

In the present example, the thin portion 253 having a thickness d1 is provided with a slope region 255 which is inclined from the thickness d1 to a thickness d2 between a portion (hereinafter referred to as a thick portion 254) with the original thickness d2 of the cover main body 237.

Here, in a case in which the cover main body 237 is molded using injection molding of resin, when the recess which is formed thinly is a recessed portion shape which has a rectangular cross sectional shape is formed, for example, that is, when the thin portion 253 which has the thickness d1 and the thick portion 254 which has the thickness d2 are formed to be adjacent to each other via a certain boundary line, a difference in the molding shrinkage between the thin portion 253 and the thick portion 254 arises easily due to the thickness deviation, so-called sink marks (depressions or holes) may be formed on the cover main body 237.

When the slope region 255 is present between the thin portion 253 and the thick portion 254, since the thickness continuously changes from the thickness d1 to the thickness d2, and there is no clear boundary of the thickness deviation, a concern of the occurrence of differences in the molding shrinkage between the thin portion 253 and the thick portion 254 is suppressed, and so it is possible to reduce the concern of the occurrence of the "sink marks".

Regarding Paper Transport Path in Recording Mechanism Unit

Hereinafter, description will be given of the paper transport path in the recording mechanism unit 215 of the printer 201 with reference to FIG. 45. First, description will be given of the feeding of the paper from the manual tray 217, and subsequently, description will be given of the feeding of the paper from the bottom side tray 213 which is provided on the bottom portion of the apparatus or the top side tray 214.

In FIG. 45, a feed path T1 of the paper P from the manual tray 217 is indicated using a double-dot-dash line. A feed path T2 of the paper P from the bottom side tray 213 or the top side tray 214 to the upstream side of a transport drive roller 224 is indicated using a dotted line.

The uppermost sheet of paper which is set in the manual tray 217 is picked up by a second feed roller 221 and sent to the downstream side.

At the end of the second feed roller 221, a transport drive roller 224 which is rotationally driven by a motor (not illustrated) and a transport follower roller 225 which is in contact with the transport drive roller 224 and is driven to rotate are provided, the paper P is sent under the recording head 230 by these rollers.

Next, the recording head 230 which discharges the ink which serves as the liquid is provided on the bottom portion of a carriage 229, and the carriage 229 is driven by a motor (not illustrated) so as to reciprocally move in the sub-scanning direction (the X direction).

A medium support member 228 which supports the paper P which is transported thereto is provided in a position opposing the recording head 230, and an interval (PG) is defined between the paper P and the recording head 230 by the medium support member 228.

An output drive roller 231 which is rotationally driven by a motor (not illustrated) and an output follower roller 232 which is in contact with the output drive roller 231 and is driven to rotate are provided on the downstream side of the medium support member 228. The paper P which is subjected to recording by the recording head 230 is output toward the paper output receiving tray 208 which is described above by the rollers 231 and 232.

The printer 201 is provided with the bottom side tray 213 and the top side tray 214 at the bottom of the apparatus, and it is possible to feed the paper one sheet at a time from the bottom side tray 213 or the top side tray 214.

The top side tray 214 is provided to be capable of sliding (being displaced) between a feed-capable position (FIG. 45), and a withdrawn position (not illustrated) at which the top side tray 214 is moved to the apparatus front surface side (the right direction in FIG. 45: the pull-out direction side of the top side tray 214), and is configured to receive the motive force of a motor (not illustrated) to be displaced between the feed-capable position and the withdrawn position.

In FIG. 45, the paper which is stored in the bottom side tray 213 is indicated using the reference symbol P1, and the paper which is stored in the top side tray 214 is indicated using the reference symbol P2 (hereinafter, these will be referred to as the "paper P" in a case in which it is not specifically necessary to distinguish the two).

A first feed roller (also referred to as a pickup roller) 210 which is rotationally driven by a motor (not illustrated) is provided on a roller support member 211 (also referred to as a pickup arm or a rocking member) which rocks centered on a tilting shaft 212, and when the top side tray 214 is in a terminal end position at which the top side tray 214 slides to the rearmost side of the apparatus (in FIG. 45, the left direction: the mounting direction side of the top side tray 214, which is also the paper feed out direction side), that is, at the feed-capable position of the top side tray 214, the first feed roller 210 feeds out the topmost sheet of the paper P2 from the top side tray 214 by coming into contact with the topmost sheet of the paper P2 which is stored in the top side tray 214 and rotating.

Meanwhile, in a state in which the top side tray 214 slides to the apparatus front surface side (the +Y side), that is, when the top side tray 214 is in the previously-described withdrawn position, the roller support member 211 rocks centered on the tilting shaft 212, the first feed roller 210 is capable of coming into contact with the topmost sheet of the paper P1 which is stored in the bottom side tray 213, and the topmost sheet of the paper P1 is fed out from the bottom side tray 213 due to the first feed roller 210 rotating.

As described above, even in a case in which one of the bottom side tray 213 and the top side tray 214 is not mounted, it is possible to feed the paper from the other side.

An intermediate roller 216 which is rotationally driven by a motor (not illustrated) is provided on the downstream side of the first feed roller 210, and the paper P is inverted through being curved by the intermediate roller 216 and heads toward the front side of the apparatus. The reference symbols 219 and 220 are follower rollers which are capable of being rotationally driven, and at least the paper P is nipped by the follower roller 219 and the intermediate roller 216, or is nipped by the follower roller 220 and the intermediate roller 216, and is fed to the downstream side.

The paper P which is fed along the feed path T2 which is indicated using a dotted line meets with the feed path T1 (the double-dot-dash line) in front of the transport drive roller 224 and the transport follower roller 225, and from thereon, on the downstream side, in the same manner as the paper P which is fed from the manual tray 217, is transported by the transport drive roller 224 and the transport follower roller 225, is subjected to printing by the recording head 230, and is output by the output drive roller 231 and the output follower roller 232 toward the paper output receiving tray 208.

In a case in which both sides of the paper P are to be subjected to recording, by switching back the paper P after recording the obverse surface using the recording head 230, the paper P is caused to enter the feed path from the bottom side of the intermediate roller 216, and thus, it is possible to subject the reverse surface of the paper P to recording. The reference symbol 218 is a follower roller 218 which is capable of being rotationally driven by the rotation of the intermediate roller 216.

The invention is not limited to the embodiments and examples which are described above, may be modified in various ways within the aspects described in claims, and the modifications should be construed as being included in the invention.

The entire disclosure of Japanese Patent Application No. 2016-125682, filed Jun. 24, 2016, 2016-121854, filed June 20 and 2016-125658, filed June 24 are expressly incorporated by reference herein.

What is claimed is:

1. A recording apparatus comprising:

a housing which configures at least a portion of an outside of an apparatus main body which is provided with a recorder which performs recording on a medium;

a lid body which opens and closes at least a portion of a top portion of the apparatus main body and is capable of tilting; and a tilting shaft of the lid body, wherein the tilting shaft is capable of being displaced in a direction intersecting an axial line direction of the tilting shaft, and wherein the lid body is capable of tilting from a closed state in which a gap between the housing and an end portion of an opposite side from a free end side is filled to an opened state by the displacement of the tilting shaft.

2. The recording apparatus according to claim 1, wherein the tilting shaft is configured using a hinge member which is provided to be capable of sliding in a direction including a vertical direction component with respect to the apparatus main body.

3. The recording apparatus according to claim 2, wherein the hinge member is biased in a direction including a vertical downward direction component by a biasing unit.

4. The recording apparatus according to claim 3, wherein a plurality of pairs of the hinge member and the biasing unit are provided along a tilting axial line direction of the lid body, and wherein a biasing force of the biasing unit is set to a magnitude at which the lid body is tilted without the hinge member which is in a position close to a side portion lifting up using the hinge member which is in a distant position from the side portion as a fulcrum when lifting up the side portion of the lid body in the tilting axial line direction to open the lid body.

5. The recording apparatus according to claim 2, wherein the hinge member is provided on an inside of the housing, and wherein the hinge member is concealed on an inside of the housing when the lid body is closed.

6. The recording apparatus according to claim 2, wherein the hinge member is provided with a spring member which biases the lid body in a closing direction when the lid body is opened at an opening angle in a range from a closed state to a predetermined opening angle, and biases the lid body in an opening direction when the lid body is further opened at the opening angle in a range from the predetermined opening angle to a further opened state.

7. The recording apparatus according to claim 1, wherein a reading mechanism unit which reads a document, and a medium supply port in which it is possible to set a medium are included on a top portion of the apparatus main body, wherein the lid body opens and closes the medium supply port, wherein the reading mechanism unit is provided with a document cover which opens and closes a document stand on which the document is placed and has a same opening direction as the lid body, wherein the lid body and the document cover have widths corresponding to a horizontal width of the apparatus main body and a top surface of the lid body and a top surface of the document cover form the same surface, and wherein an end portion of an opposite side from the free end side of the lid body and a rear surface of the apparatus main body form the same surface.

8. The recording apparatus according to claim 1, wherein a reading mechanism unit which reads a document and a medium supply port which is capable of supplying the medium are included on a top portion of the apparatus main body, wherein the reading mechanism unit includes a document cover which opens and closes a document stand on which a document is placed, wherein the lid body opens and closes the medium supply port, and wherein the recording apparatus further includes a regulating member which is capable of assuming a storage state in which the regulating member is positioned on an inside of the lid body and is closed in a state in which the lid body is closed, and a regulating state in which the regulating member opens together with an opening operation of the lid body and forms a surface which intersects a top surface of the document cover to regulate slipping and falling of an object from a top surface of the document cover into the medium supply port, and a biasing member which biases the regulating member from the storage state to the regulating state.

9. The recording apparatus according to claim 8, wherein the regulating member is configured to be capable of switching between the storage state and the regulating state by tilting.

10. The recording apparatus according to claim 9, wherein the regulating member is provided with an induction portion with which the lid body comes into contact and which leads the regulating member to the storage state when the lid body is changed from an opened state to a closed state.

11. A recording apparatus comprising:

a medium supply port which is provided on a top portion of an apparatus main body to be capable of setting a medium therethrough, the apparatus main body being provided with a recorder which performs recording on the medium;

a reading mechanism unit which is provided on the top portion of the apparatus main body to be capable of opening and closing and which reads a document;

a medium supply port cover which opens and closes the medium supply port and is provided on the apparatus main body; and a document cover which is a cover which opens and closes a document stand with which the reading mechanism unit is provided, has a same opening direction as the medium supply port cover, and is provided on the reading mechanism unit, wherein the document cover and the medium supply port cover are in a positional relationship in which a distal end of the medium supply port cover comes into contact with the document cover in a process in which the reading mechanism unit is opened from a state in which the reading mechanism unit and the medium supply port cover are closed and the document cover is opened, and the document cover applies an external force to the medium supply port cover in the opening direction.

12. The recording apparatus according to claim 11, wherein in the process in which the reading mechanism unit is opened from a state in which the reading mechanism unit and the medium supply port cover are closed and the document cover is opened, a repulsive force which the document cover receives from the medium supply port cover does not exceed a magnitude which is necessary for closing the document cover.

13. The recording apparatus according to claim 11, further comprising:

a rocking member which is capable of engaging with the document cover and the medium supply port cover and is capable of rocking, wherein the rocking member is configured to rock to push up the medium supply port cover when the document cover is opened from a state in which the reading mechanism unit, the document cover, and the medium supply port cover are closed.

14. The recording apparatus according to claim 11, wherein in the process in which the reading mechanism unit is opened from a state in which the reading mechanism unit and the medium supply port cover are closed and the document cover is opened, an angle, from a contact position at which the medium supply port cover comes into contact with the document cover, formed between a top surface of the document cover of a tilting shaft side of the document cover and a top surface of the medium supply port cover, is an acute angle.

15. The recording apparatus according to claim 11, wherein a first inclined surface is formed on a distal end of the medium supply port cover, wherein a second inclined surface which faces the first inclined surface is formed on a base end side of the document cover, and wherein when the reading mechanism unit is opened from a state in which the reading mechanism unit, the document cover, and the medium supply port cover are closed, the second inclined surface is provided to push up the first inclined surface in a direction in which the medium supply port cover opens.

16. The recording apparatus according to claim 15, wherein in plan view of the document cover and the medium supply port cover, at least a portion of the second inclined surface overlaps the first inclined surface.

17. The recording apparatus according to claim 11, further comprising:

a regulating member which is capable of assuming a storage state in which the regulating member is positioned on an inside of the medium supply port cover and is closed in a state in which the medium supply port cover is closed, and a regulating state in which the regulating member opens together with an opening operation of the medium supply port and forms a surface which intersects a top surface of the document cover to regulate slipping and falling of an object from a top surface of the document cover into the medium supply port; and a biasing member which biases the regulating member from the storage state to the regulating state.

18. The recording apparatus according to claim 17, wherein the regulating member is configured to be capable of switching between the storage state and the regulating state by tilting.

19. The recording apparatus according to claim 18, wherein the regulating member is provided with an induction portion with which the medium supply port cover comes into contact and which leads the regulating member to the storage state when the medium supply port cover is changed from an opened state to a closed state.

* * * * *